US006603456B1

(12) United States Patent
Aoki et al.

(10) Patent No.: US 6,603,456 B1
(45) Date of Patent: Aug. 5, 2003

(54) SIGNAL AMPLIFIER CIRCUIT LOAD DRIVE CIRCUIT AND LIQUID CRYSTAL DISPLAY DEVICE

(75) Inventors: Yoshiro Aoki, Saitama-ken (JP); Masao Karue, Saitama-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/433,212

(22) Filed: Nov. 4, 1999

(30) Foreign Application Priority Data

Feb. 9, 1999 (JP) ..... 11-031795
Oct. 27, 1999 (JP) ..... 11-305942
Oct. 27, 1999 (JP) ..... 11-305952

(51) Int. Cl.[7] ..... G09G 3/36
(52) U.S. Cl. ..... 345/100; 345/98
(58) Field of Search ..... 345/96, 98, 100; 327/111, 112, 434, 437, 537; 330/116

(56) References Cited

U.S. PATENT DOCUMENTS 3,906,223 A * 9/1975 White ..... 250/227.21
4,781,437 A * 11/1988 Shields et al. ..... 345/87
5,654,673 A * 8/1997 Shinohara ..... 330/277
5,777,515 A * 7/1998 Kimura ..... 330/257
6,054,976 A * 4/2000 Kubota et al. ..... 345/100
6,307,431 B1 * 10/2001 Botti et al. ..... 330/10

* cited by examiner

*Primary Examiner*—Richard Hjerpe
*Assistant Examiner*—Kevin Nguyen
(74) *Attorney, Agent, or Firm*—Oblon, Spivak, McClelland, Maier & Neustadt, P.C.

(57) ABSTRACT

A differential voltage between the threshold voltage of an amplitude amplifying logic circuit 20 and a reference voltage V1 is stored in a capacitor C1. When an input signal IS is input to the amplitude amplifying logic circuit 20, it is input after adding to the voltage of the input signal IS the voltage stored in the capacitor C1. In this manner, any difference between the threshold voltage V1 of the amplitude amplifying logic circuit 20 and the reference voltage can be absorbed. Therefore, a signal amplifier circuit can operate normally even when the threshold voltage of the amplitude amplifying logic circuit 20 in the signal amplifier circuit varies.

10 Claims, 54 Drawing Sheets

SIGNAL AMPLIFIER CIRCUIT LOAD DRIVE CIRCUIT AND LIQUID CRYSTAL DISPLAY DEVICE

BACKGROUND OF THE INVENTION

1. Field of the Invention

This invention relates to a signal amplifier circuit, a load drive circuit and a liquid crystal display device using them.

2. Description of the Related Art

A liquid display device, in general, is made up of a pixel array portion with a matrix arrangement of signal lines and scanning lines, and drive circuits for driving the signal lines and the scanning lines. Conventionally, since the pixel array portion and the drive circuits were formed on separate substrates, it was difficult to reduce the cost of the liquid display device, and it was also difficult to increase the ratio of the real screen size relative to the outer dimension of the liquid crystal display device.

Recently, however, since the manufacturing technology for making TFT (thin film transistor) on a glass substrate by using polysilicon as its material has been progressed, it has been made possible to make the pixel array portion and the drive circuits on a common glass substrate by using the technology.

Apart from this, especially as a technological tendency of recent liquid crystal display devices integral with a drive circuit, it is getting more and more active to develop a liquid crystal device enabling direct input of a digital signal to the drive circuits on a glass substrate by configuring the drive circuits in the liquid crystal device to have the function of converting the digital signal to an analog video signal.

In a liquid display device particularly of a direct viewing type, however, digital input signals introduced from outside are supplied to the signal line drive circuit through a wiring on glass having a large resistance load and capacitance load. Therefore, in order to ensure direct supply of digital input signals from outside to the drive circuit on the glass substrate, it was necessary to supply digital input signal by using a signal supply circuit with a large drive power. As a result, it was necessary to additionally use another signal drive circuit for the digital input signals of the large drive power.

Moreover, since making uniform and good-property polysilicon TFT on a glass substrate is still difficult, the drive circuit on the glass substrate cannot be driven directly with digital input signals having an amplitude used in an external circuit unchanged, and it was necessary to additionally use a signal amplifier circuit for amplifying the amplitude of the digital input signals.

That is, it was necessary for the drive circuit on the glass substrate to include a signal amplifier circuit. And, it was necessary to introduce digital input signal into the signal amplifier circuit, amplify their amplitude, then output them as digital output signals, and use the digital output signals to activate the drive circuit.

However, because it was difficult to form polysilicon TFT with a uniform property on the glass substrate, it was also difficult to unify the property of the amplitude amplifying logic circuit provided in the signal amplifier circuit. Therefore, threshold voltage of the amplitude amplifying logic circuit may vary among blocks or products.

In case where, for example, a digital input signal has an amplitude from 4V to 6V, and it is to be amplified into a signal having an amplitude from 0V to 10V by the signal amplifier circuit, threshold voltage of the amplitude amplifying logic circuit in the signal amplifier circuit should be set to 5 V. However, in some cases, polysilicon TFT forming the amplitude amplifying logic circuit varied in property and caused the threshold voltage to become 4.5 V or 5.5 V. In this case, a difference was produced between the timing when the digital input signal changes from 4V to 6V and the timing when the digital output signal changes from 0V to 10V.

In addition, when the threshold voltage of the amplitude amplifying logic circuit came largely offset to become 6.5 V, the digital output signal did not change to 10 V even upon entry of the digital signal having the amplitude from 4V to 6V. So, defective products were produced.

Furthermore, making polysilicon TFT having a uniform property on a glass substrate is still difficult, and it results in variation in the threshold voltage and mobility. Therefore, even if the pixel array portion and the drive circuit are formed on a common substrate, there is still the possibility that variation in property of TFT causes a deterioration of the display quality such as inconsistent in luminance, and power consumption increases as well.

SUMMARY OF THE INVENTION

The invention has been made taking these points into consideration, and its object lies in providing a signal amplifier circuit capable of operating normally even under variation in threshold voltage of an amplitude amplifying logic circuit in a signal amplifier circuit. That is, it is the object of the invention to provide a signal amplifier circuit normally operable even when the property of polysilicon TFT forming the amplitude amplifying logic circuit is not always uniform.

Another object of the invention is to provide a load drive circuit preventing that a voltage supplied to a driven load fluctuates due to an influence from unevenness of the transistor property.

A feature of the signal amplifier circuit according to the invention lies in comprising:

- an amplitude amplifying logic circuit for amplifying a signal having the first amplitude to a signal having the second amplitude larger than the first amplitude, and outputting it as the digital output signal;
- a differential voltage hold circuit having one end connected to the amplitude amplifying logic circuit for temporarily holding a differential voltage between a reference voltage of a voltage value for switching the digital input signal between HIGH and LOW and a voltage substantially equal to the threshold voltage for switching the logic of the amplitude amplifying logic circuit between HIGH and LOW;
- a threshold voltage setting circuit for setting one end of the differential voltage hold circuit in a voltage substantially equal to the threshold voltage of the amplitude amplifying logic circuit when setting in the differential voltage hold circuit the differential voltage which the differential voltage hold circuit should hold;
- a reference voltage setting circuit for setting the other end of the differential voltage hold circuit in a reference voltage for switching the logic of the digital input signal between HIGH and LOW when setting in the differential voltage hold circuit the differential voltage which the differential voltage hold circuit should hold; and
- a digital signal input circuit for inputting the digital input signal to the other end of the differential voltage hold circuit after the differential voltage hold circuit holds the differential voltage.

A feature of the liquid crystal display device according to the invention lies in comprising:

a pixel array portion formed on a transparent substrate, having signal lines and scanning lines aligned in longitudinal and transverse directions and having pixel electrodes near respective nodes of those lines; and a drive circuit formed on the transparent substrate to drive the signal lines and/or the scanning lines, and functioning to convert a digital video signal into an analog video signal, the drive circuit including a plurality of signal amplitude amplifier circuits supplied with a digital input signal having a first amplitude and amplifying the amplitude of the digital input signal to output it as a digital output signal having a second amplitude larger than the first amplitude, the signal amplitude amplifier circuit having:

an amplitude amplifying logic circuit for amplifying a signal having the first amplitude to a signal having the second amplitude larger than the first amplitude, and outputting it as the digital output signal;

a differential voltage hold circuit having one end connected to the amplitude amplifying logic circuit for temporarily holding a differential voltage between a reference voltage of a voltage value for switching the digital input signal between HIGH and LOW and a voltage substantially equal to the threshold voltage for switching the logic of the amplitude amplifying logic circuit between HIGH and LOW;

a threshold voltage setting circuit for setting one end of the differential voltage hold circuit in a voltage substantially equal to the threshold voltage of the amplitude amplifying logic circuit when setting in the differential voltage hold circuit the differential voltage which the differential voltage hold circuit should hold;

a reference voltage setting circuit for setting the other end of the differential voltage hold circuit in a reference voltage for switching the logic of the digital input signal between HIGH and LOW when setting in the differential voltage hold circuit the differential voltage which the differential voltage hold circuit should hold; and a digital signal input circuit for inputting the digital input signal to the other end of the differential voltage hold circuit after the differential voltage hold circuit holds the differential voltage.

A feature of the load drive circuit according to the invention, configured to introduce an input signal having a predetermined voltage amplitude and supplying the voltage of the input signal to a signal line applied with a load, lies in comprising:

a voltage change circuit for changing the voltage of the signal line;

a first switch for ON/OFF control of conduction between the voltage change circuit and the signal line;

a logic circuit whose output logic is inverted when an input voltage reaches a predetermined threshold voltage for ON/OFF control of the first switch;

a differential voltage hold circuit for holding a differential voltage between a voltage substantially equal to the threshold voltage of the logic circuit and the voltage of the input signal;

a threshold voltage setting circuit for setting one end of the differential voltage hold circuit in a voltage substantially equal to the threshold voltage of the logic circuit; and an input voltage setting circuit for setting the other end of the differential voltage hold circuit in the voltage of the input signal when setting in the differential voltage hold circuit the differential voltage which the differential voltage hold circuit should hold.

A feature of the liquid crystal display device according to the invention lies in comprising:

a pixel array portion formed on a transparent substrate, having signal lines and scanning lines aligned in longitudinal and transverse directions and having pixel electrodes near respective nodes of those lines;

a signal line drive circuit formed on the transparent substrate to drive the signal lines; and a scanning line drive circuit formed on the transparent substrate to drive the scanning lines, the signal line drive circuit including a plurality of load drive circuits supplied with an input video signal having a predetermined voltage amplitude to supply the voltage of the input video signal to the signal lines to which the pixel electrodes are connected, each load drive circuit including:

a voltage change supply circuit for changing the voltage of the signal line;

a first switch for ON/OFF control of conduction between the voltage change circuit and the signal line;

a logic circuit whose output logic is inverted for ON/OFF control of the first switch when the input voltage reaches a predetermined threshold voltage;

a differential voltage hold circuit for holding a differential voltage between a voltage substantially equal to the threshold voltage of the logic circuit and the voltage of the input video signal;

a threshold voltage setting circuit for setting one end of the differential voltage hold circuit in a voltage substantially equal to the threshold voltage of the logic circuit when the differential voltage the differential voltage hold circuit should hold is set in the differential voltage hold circuit; and an input voltage setting circuit for setting the other end of the differential voltage hold circuit in the voltage of the input signal when the differential voltage which the differential voltage hold circuit should hold is set in the differential voltage hold circuit.

DETAILED DESCRIPTION OF THE PREFERRED EMBODIMENTS

First Embodiment

The first embodiment of the invention is directed to absorbing variation in threshold voltage of an amplitude amplifying logic circuit in a signal amplifier circuit by means of a capacitor so that the signal amplifier circuit normally operates even upon variation in threshold voltage of the amplitude amplifying logic circuit. It is explained below in detail with reference to the drawings.

Figure 4:
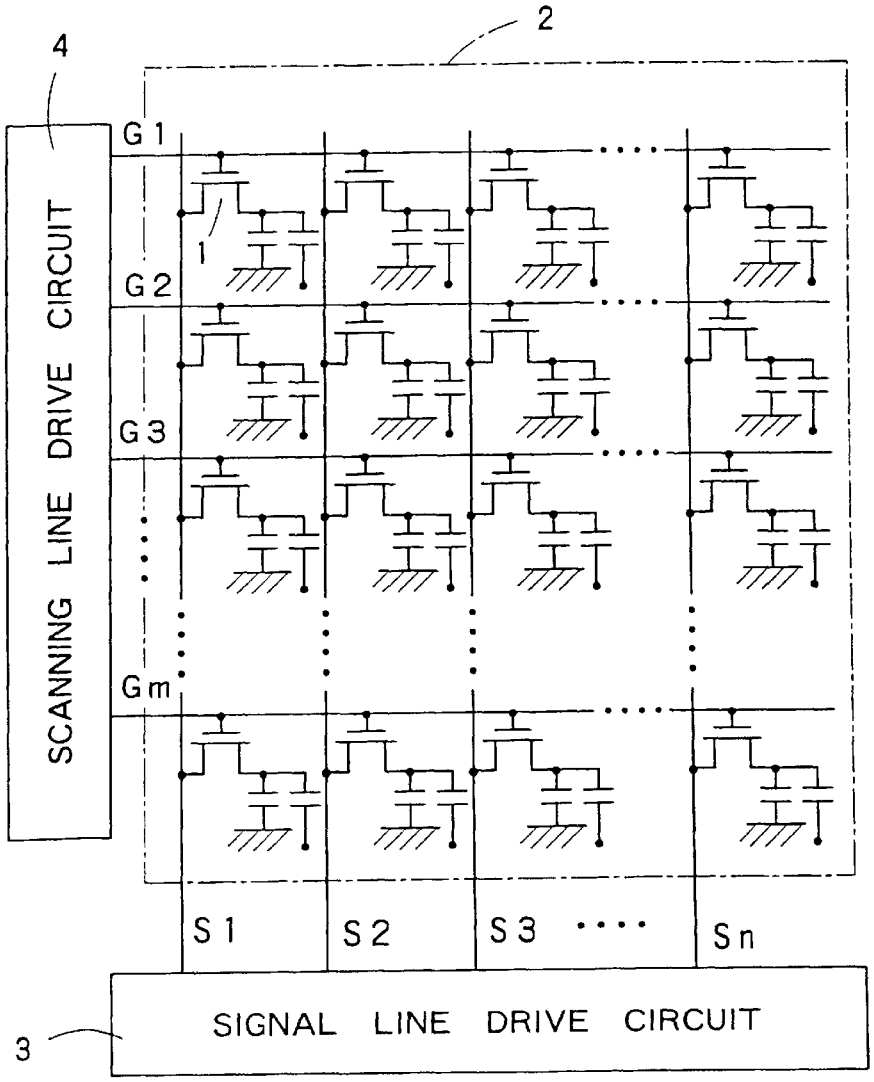
FIG. 4 is a diagram showing an entire structure of a liquid crystal display device to which the invention is employed.

Referring to FIG. 4, first explained is entire circuit structure of a liquid display device integrally incorporating a drive circuit according to this embodiment. As shown in FIG. 4, the liquid crystal display device is made up of a pixel array portion 2, signal line drive circuit 3 and scanning line drive circuit 4. Formed in the pixel array 2 are signal lines S1~Sn and scanning lines G1~Gm in columns and rows, and formed near their crossing points are pixel displaying TFT1. The signal line drive circuit 3 is a circuit for driving these signal lines S1~Sn. In this embodiment, a video signal still in form of a digital signal is introduced directly to the signal line drive circuit 3. The scanning line drive circuit 4 is a circuit for driving the scanning lines G1~Gm.

Figure 2:
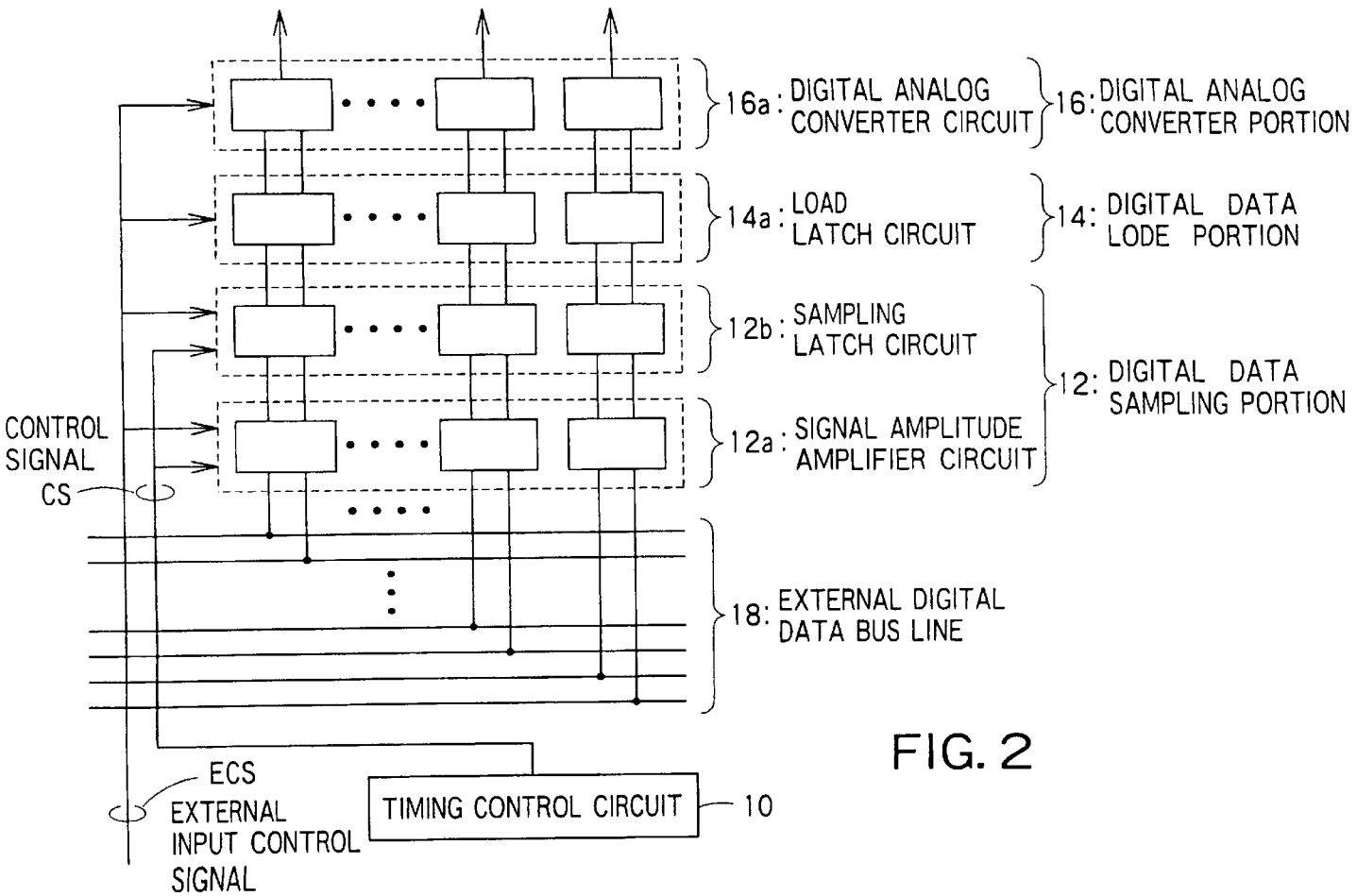
FIG. 2 is a general block diagram of interiors of circuits in respective stages in FIG. 3.
Figure 3:
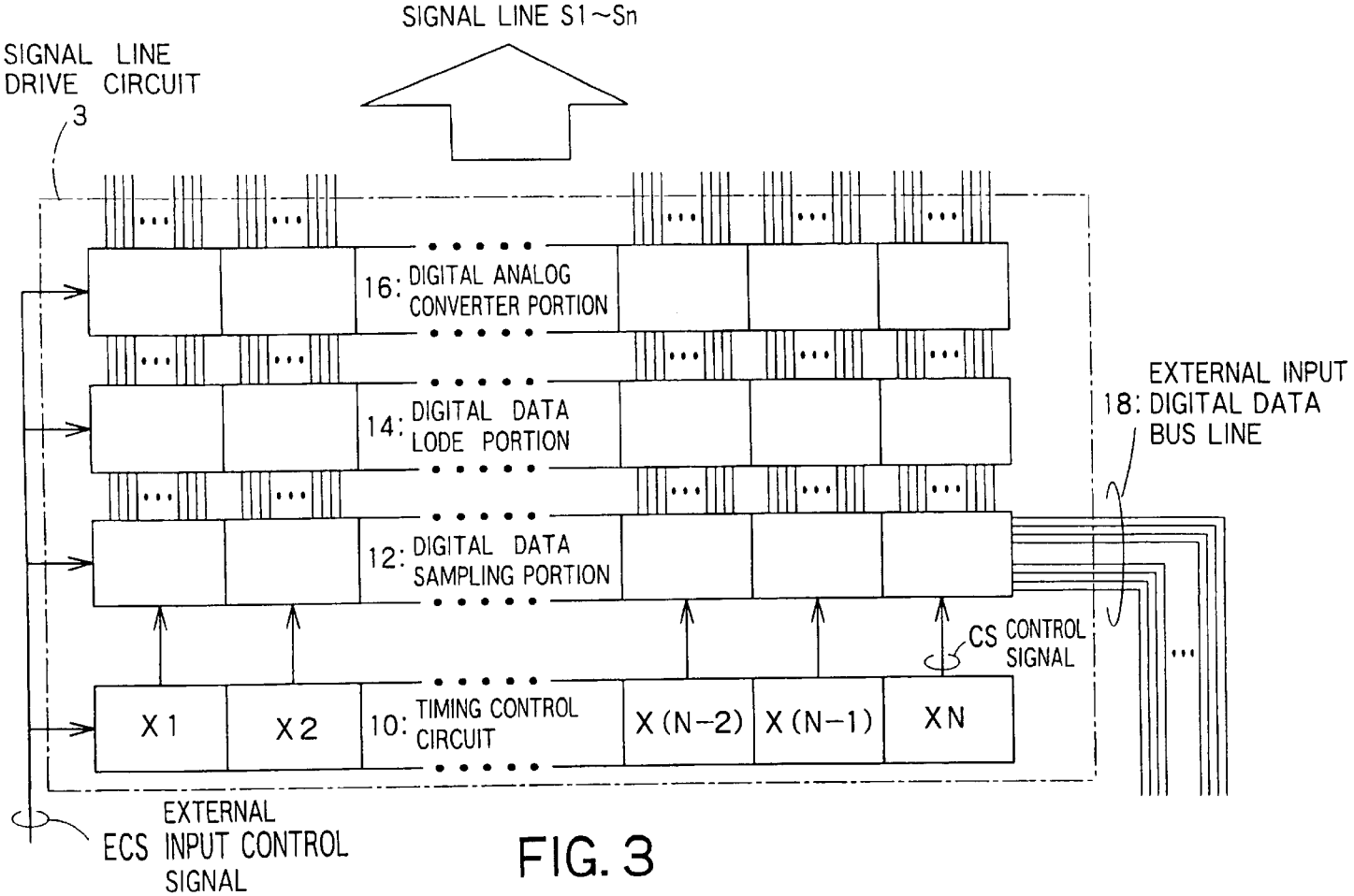
FIG. 3 is a diagram showing an interior arrangement of a signal line drive circuit of a liquid crystal display device to which the invention is employed.

Next referring to FIG. 2 and FIG. 3, structure of the signal line drive circuit 3 in this embodiment is explained. FIG. 3 is a general block diagram showing entire structure of the signal line drive circuit 3 having N stages according to the embodiment, and FIG. 2 is a general block diagram of the inside circuit of each stage.

As shown in FIG. 3, the signal line drive circuit 3 includes a timing control circuit 10, digital data sampling portion 12, digital data load portion 14 and digital analog converter portion 16. To these timing control circuit 10, digital data sampling portion 12, digital data load portion 14, and digital analog converter 16, an external input control signal ECS for controlling the timing of transferring data among these circuits is input.

The timing control circuit 10 is a circuit for controlling which one of N-stages of blocks should do sampling of digital data from an external input digital data bus line 18. The timing control circuit 10 outputs a control signal CS for controlling its timing to the digital data sampling portion 12. The digital data sampling portion 12 is responsive to the control signal CS to sample out a digital signal from the external input digital data bus line 18. That is, each stage of the digital data sampling portion 12 having N stages does sampling in response to the control signal CS, taking a digital signal, which is a video signal, as digital data sequentially from the external input digital data bus line 18.

The digital data load portion 14 has the function of taking digital data from the digital data sampling portion 12 and stores it for a moment. That is, digital data, which are video signals sequentially taken into the digital data sampling portion 12 for every stage, are transferred simultaneously at a predetermined timing to the digital data load portion 14, and stored there. These digital data stored in the digital data load portion 14 are transferred to the digital analog converter portion 16 simultaneously at a predetermined timing. The digital analog converter portion 16 converts the digital data introduced from the digital data load portion 14 into analog data.

That is, in the signal line drive circuit 3 shown in FIG. 3, digital signals as video signals input from the outside are amplified in the data sampling portion 12 and stored there as digital data for a moment. After that, these digital data move to the data load portion 14 at every predetermined timing. Then, the digital analog converter portion 16 converts the digital data to video signals in form of analog data at every predetermined timing, and outputs them to the signal lines S1~Sn.

As shown in FIG. 2, for each signal line in the liquid crystal display device, a pair of digital signal lines are provided in the external input digital data bus line 18. These digital signal lines are connected to the digital data sampling portion 12. The digital data sampling portion 12 includes a signal amplitude amplifier circuit 12*a* and a sampling latch circuit 12*b* for each signal line. These signal amplitude amplifier circuit 12*a* and sampling latch circuit 12*b* are supplied with a control signal CS from the timing control circuit 10. In addition, the digital data load portion 14 includes a load latch circuit 14*a* for each signal line, and the digital analog converter portion 16 includes a digital analog converter circuit 16*a* for each signal line.

All portions shown in FIG. 2 and FIG. 3 are formed on a common glass substrate of the liquid crystal display device shown in FIG. 4. Transistors forming the signal line drive circuit 3 and the scanning line drive circuit 4 shown in FIG. 4 are made in the same manufacturing process as that of pixel driving TFT1.

Figure 1:
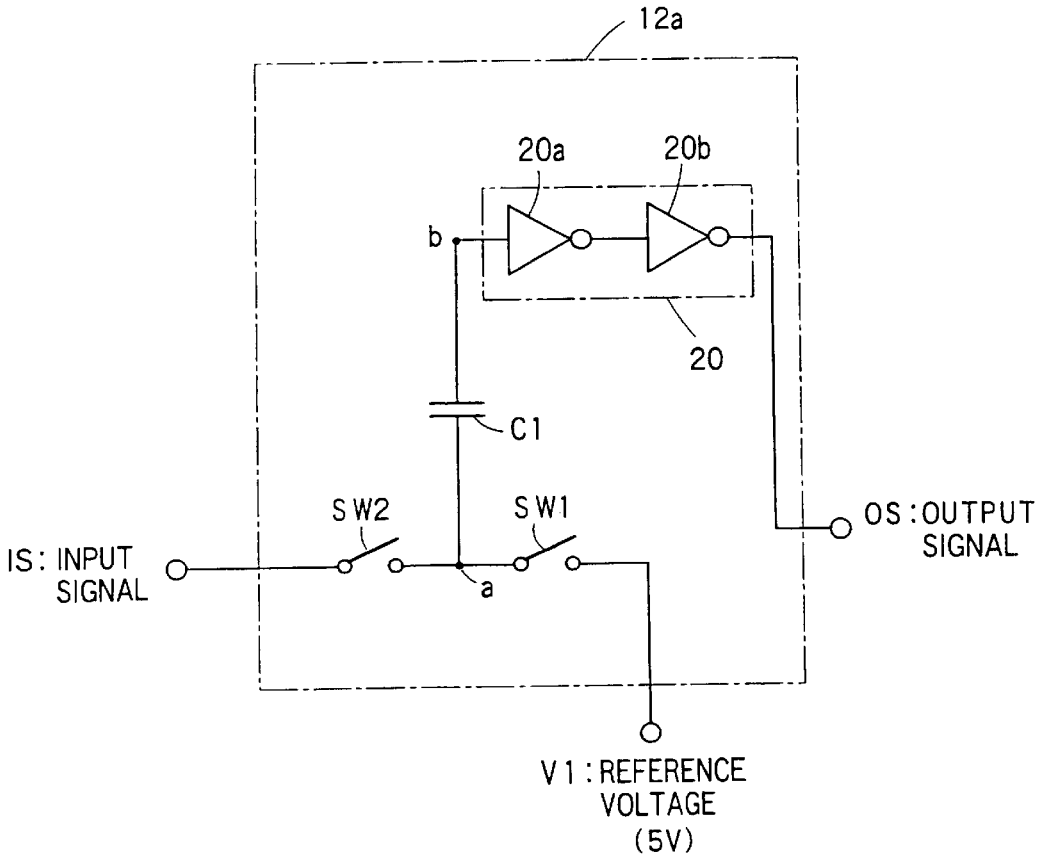
FIG. 1 is a diagram showing a circuit arrangement of a signal amplifier circuit according to the first embodiment of the invention.

Next referring to FIG. 1, structure of the signal amplitude amplifier circuit 12*a* in this embodiment is explained. FIG. 1 is a circuit diagram showing structure of a major part of the signal amplitude amplifier circuit 12*a* for explaining the basic concept of the invention.

As shown in FIG. 1, the signal amplitude amplifier circuit 12*a* in this embodiment includes a switch SW1, switch SW2, capacitor C1 and amplitude amplifying logic circuit 20. The amplitude amplifying logic circuit 20 includes inverters 20*a*, 20*b* connected in series. The signal amplitude amplifier circuit 12*a* increases the amplitude of an input signal IS which is a digital signal having a small amplitude, and outputs its as output signal OS in form of a digital signal.

More specifically, one end of the switch SW2 is connected to an input terminal, and the input signal IS is input to it. The input signal IS is a digital signal having a small amplitude from the external input digital data bus line 18. In this embodiment, the input signal IS is a digital signal having the amplitude form 4V to 6V. The other end of the switch SW2 is connected to one end of the switch SW1. To the other end of the switch SW1, a reference voltage V1 is input. In this embodiment, the reference voltage V1 is determined 5V. That is, since the amplitude of the input signal IS is 4V~6V, the medium voltage, 5V, is used as the reference voltage for switching between HIGH and LOW.

Connected between the switch SW2 and the switch SW1 is one end of the capacitor C1. The capacitor C1 is an element for holding between a node a and a node b a differential voltage between the threshold voltage of the amplitude amplifying logic circuit 20 and the reference voltage V1. That is, the capacitor C1 constitutes a circuit differential voltage hold circuit in this embodiment. The other end of the capacitor C1 is connected to the input end of an inverter 20*a*. Output end of the inverter 20*a* is connected to the input end of an inverter 20*b*. Output end of the inverter 20*b* is connected to the output terminal, and the output signal OS is output from this output terminal. The output signal OS is a digital signal increased in amplitude from the input signal IS. In this embodiment, the output signal OS is a digital signal having the amplitude from 0V to 10V.

In this embodiment, the amplitude amplifying logic circuit 20 is an insulating gate type logic circuit which is made up of a polycrystalline silicon type thin-film transistor.

Figure 5:
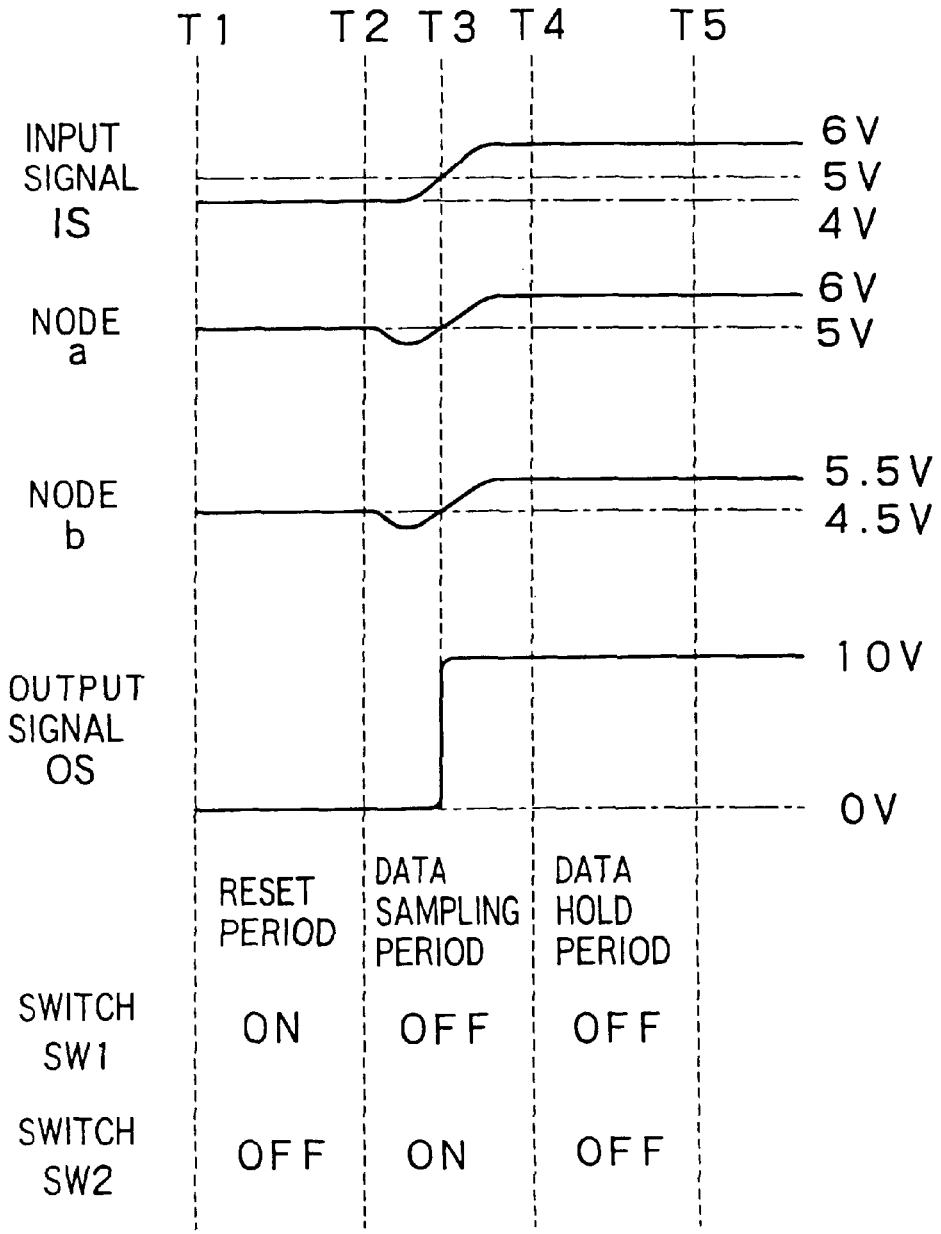
FIG. 5 is a diagram showing a timing chart for explaining operation of the signal amplifier circuit according to the first embodiment shown in FIG. 1.

Next explained is operation of the signal amplitude amplifier circuit 12*a* shown in FIG. 1 with reference to FIG. 5. FIG. 5 is a diagram showing a timing chart which shows operation of the signal amplitude amplifier circuit 12*a* shown in FIG. 1.

As shown in FIG. 5, the period between time T1 and time T2 is the reset period. That is, in the period between time T1 and time T2, the control signal CS is sent from the timing control circuit 10 to a block in a certain stage within the signal line drive circuit 3 of FIG. 3. As a result, the switch SW1 of the signal amplitude amplifier circuit 12*a* shown in FIG. 1 turns ON, and the switch SW2 turns OFF. In the period between time T1 and T2, 5V is input to the node a as the reference voltage V1. Simultaneously with it, the node b is set in the threshold voltage of the amplitude amplifying logic circuit 20 by some means. For example, in case that the threshold voltage of the amplitude amplifying logic circuit 20 is 4.5V, the node b is set in 4.5V. Therefore, voltage of −0.5V is stored in the capacitor C1. The threshold voltage of the logic circuit 20 for the amplitude amplifier circuit somewhat varies among blocks, and among products as well. Means for setting the node b in the threshold voltage variable in this manner will be explained later.

The next period between time T2 and time T4 is the sampling period. That is, in the period from Time T2 to time T4, the timing control circuit 10 turns the switch SW1 OFF and switch SW2 ON. Therefore, the input signal IS is introduced to the node a. For example, if the input signal IS changes from 4V to 6V, then the node a changes from 5V to 6V. At that time, since the capacitor C1 has the storage of −0.5, the node b changes from 4.5V to 5.5V. Here, since the threshold voltage of the amplitude amplifying logic circuit 20 is 4.5V, the output signal OS of the amplitude amplifying logic circuit 20 changes from 0V to 10V at time T3. That is, at time T3 when the input signal IS exceeds 5V preset as the reference voltage V1, the output signal OS of the amplitude amplifying logic circuit 20 changes from 0V to 10V.

The next period between time T4 and time T5 is the data hold period. That is, in the period from time T4 to time T5, the timing control circuit 10 turns both switches SW1 and SW2 OFF. As a result, the input signal IS which is the digital signal having the amplitude of 2V input in the preceding data sampling period (from time T2 to time T4) is held and output as the output signal OS in form of a digital signal having the amplitude of 10V.

As a method for temporarily holding data, a sampling latch circuit 12*b* as shown in FIG. 2 is typically used jointly. In this case, used as the sampling latch circuit 12*b* is a flip-flop circuit or a data holding capacitor element, for example.

By repeating the above-explained operations, sampling of the digital signal as the input signal IS is progressed for every stage of every block to the block in the N stage. In a later predetermined period, these samples digital signals are moved simultaneously to the digital data load portion 14, and again, sampling of the digital data is conducted sequentially in the digital data sampling portion 12 in response to the control signal CS of the timing control circuit 10.

Digital data moved to the digital data load portion 14 are converted simultaneously into analog video signals by the digital analog converter portion 16 in parallel to the data sampling period (from time T2 to time T4), and output to respective columns of the signal lines S1~Sn. By repeating these operations for each of the blocks from the first stage to the N stage in the signal line drive circuit 3, and repeating them by the number of rows of the scanning lines G1 to Gm, an image is displayed.

As explained above, in the liquid crystal display device according to this embodiment, since the signal amplitude amplifier circuit 12*a* is provided in the digital data sampling portion 12, sampling is possible with any input signal IS even having small changes in digital data. Therefore, also in large-scale liquid display devices or those using a large number of display colors and digital signals, it is possible to limit the size of its external circuit and to reduce its power consumption. That is, the signal line drive circuit 3 operative with digital signals can be built in the liquid crystal display device without increasing the size of the external circuit or increasing the power consumption.

In addition, since the capacitor C1 absorbs variation in threshold voltage of the amplitude amplifying logic circuit 20, output signals OS can be switched to 0V and 10V about the reference voltage V1 (5V) of the input signal IS. That is, in the reset period (from time T1 to time T2), by storing in the capacitor C1 the differential voltage between the reference voltage V1 and the threshold voltage of the amplitude amplifying logic circuit 20, the node b is set in the threshold voltage of the amplitude amplifying logic circuit 20.

By determining the voltage at the node b in this manner, when the input signal IS changes from LOW to HIGH, the output signal OS can be changed from 0V to 10V at the point of time when the input signal IS exceeds the reference voltage V1. That is, when the input signal IS goes beyond the reference voltage V1, the output signal OS can beswitched from 0V to 10V. In contrast, when the input signal changes from HIGH to LOW, the output signal OS can be switched from 10V to 0V at the time when the input signal IS decreases below the reference voltage V1. That is, the output signal OS can be changed from 10V to 0V when the input signal IS goes below the reference voltage V1.

Also when the threshold voltage of the amplitude amplifying logic circuit 20 varies largely, the amplitude amplifying logic circuit 20 can be made to operate normally. That is, the offset amount of the threshold voltage of the amplitude amplifying logic circuit 20 may exceed 1V. For example, if the threshold voltage of the amplitude amplifying logic circuit 20 becomes 6.5V, conventional signal amplifier circuits could not change the output signal OS to HIGH (10V) by using the input signal IS having the amplitude from 4V to 6V. In contrast, in the signal amplitude amplifier circuit 12*a* according to this embodiment, since 1.5V is stored in the capacitor C1 in the reset period and the voltage at the node b is set in 6.5V, the voltage at the node b exceeds 6.5V when the input signal IS exceeds 5V in the data sampling period. Therefore, even in this case, the output signal OS can be switched to HIGH (10V).

Second Embodiment

The second embodiment of the invention is directed to a signal amplifier circuit 12*a* having a specific circuit for storing in the capacitor C1 in the first embodiment a differential voltage between the threshold voltage of the amplitude amplifying logic circuit 20 and the reference voltage V1.

Figure 6:
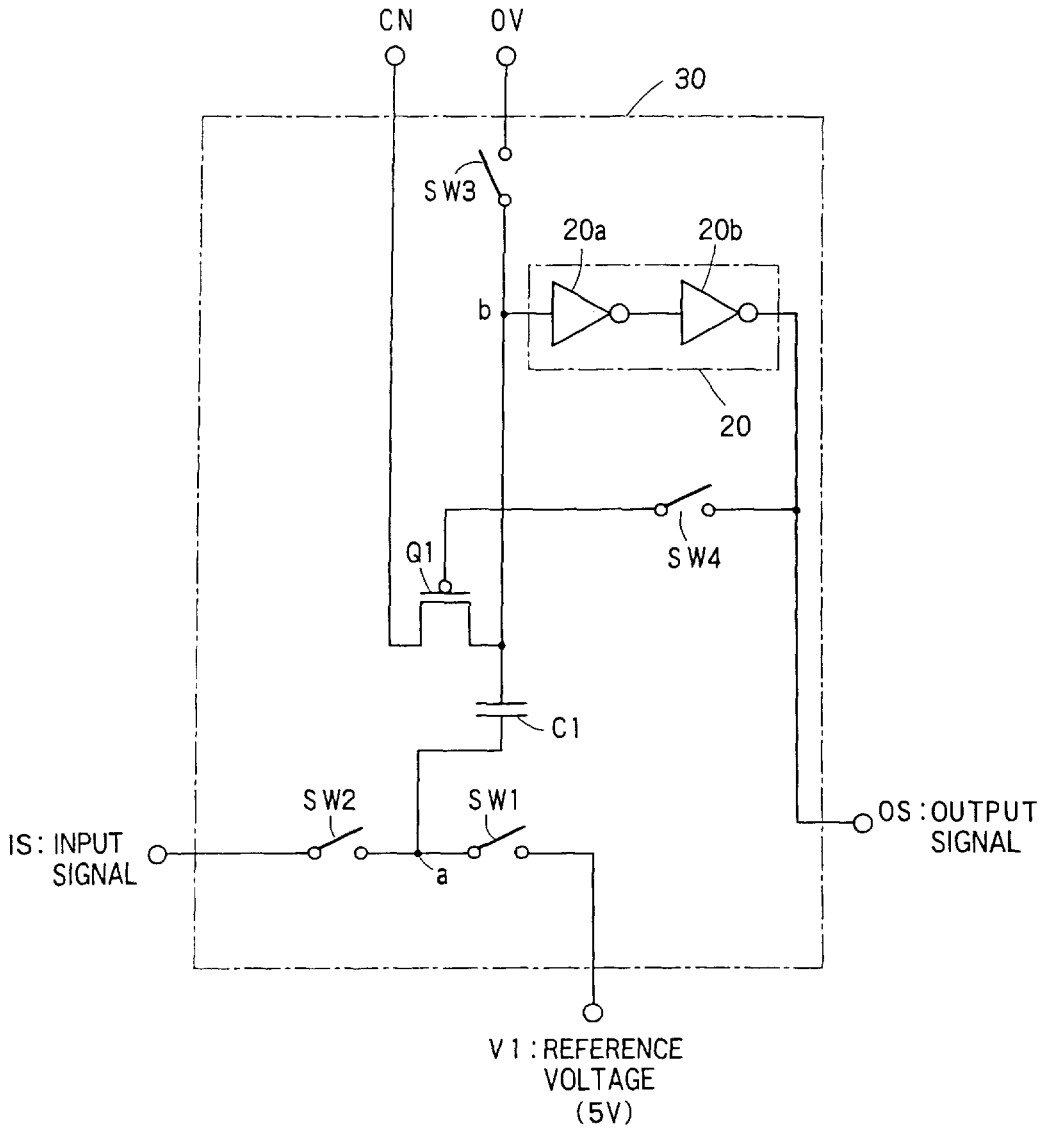
FIG. 6 is a diagram showing a circuit arrangement of a signal amplifier circuit according to the second embodiment of the invention.
Figure 7:
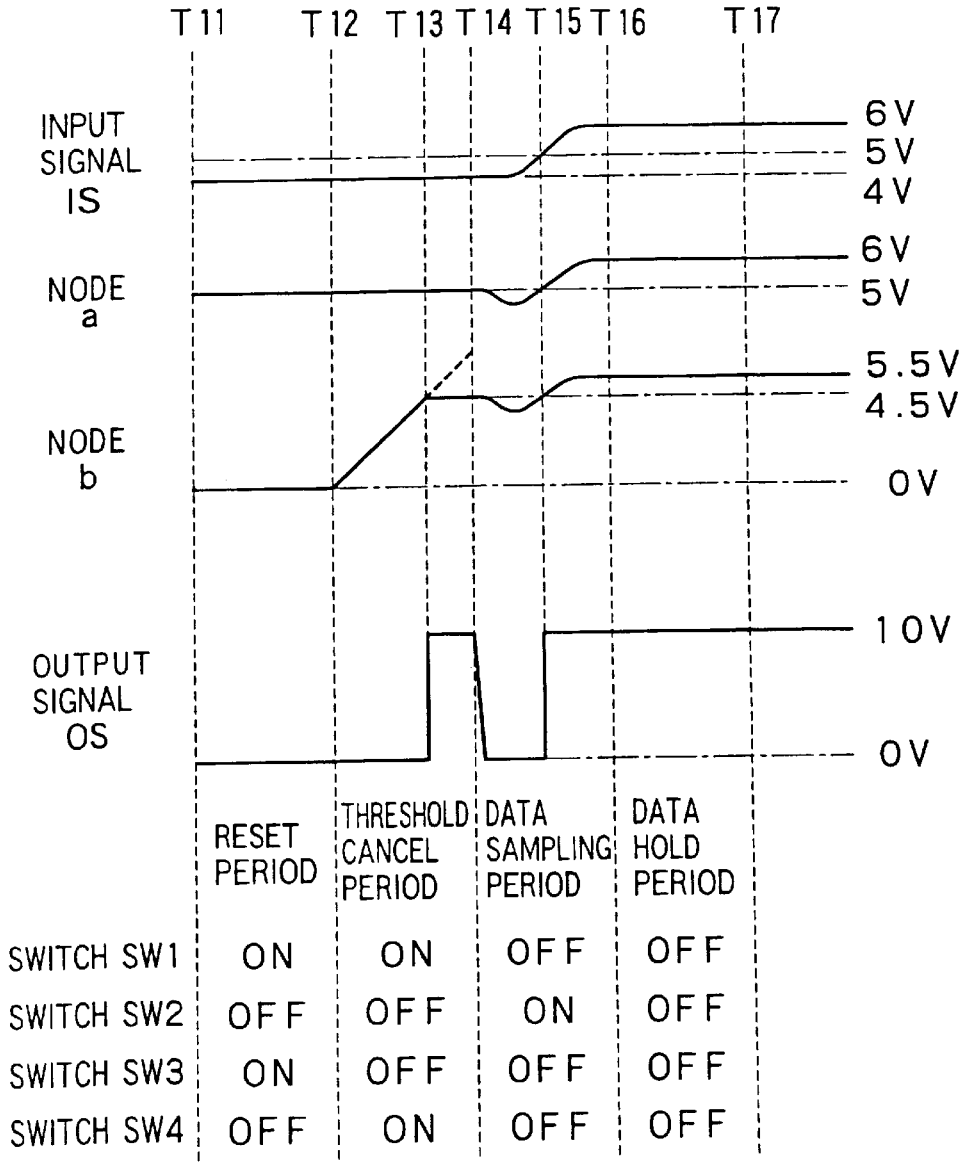
FIG. 7 is a diagram showing a timing chart for explaining operation of the signal amplifier circuit according to the second embodiment shown in FIG. 6.

FIG. 6 is a circuit diagram showing structure of a major part of the signal amplifier circuit according to the second embodiment of the invention, and FIG. 7 is a diagram showing a timing chart which shows operations of the signal amplifier circuit shown in FIG. 6.

As shown in FIG. 6, the signal amplifier circuit 30 according to the second embodiment includes switches SW3, SW4 and transistor Q1 which is a p-type MOS transistor, in addition to the signal amplitude amplifier circuit 12*a* according to the above-explained first embodiment.

A difference of the circuit arrangement from that of the first embodiment lies in the node b being connected to one end of the switch SW3. The other end of the switch SW3 is connected to a 0V terminal, which is connected to a 0V voltage source. The node b is also connected to the output terminal of the transistor Q1. Input terminal of the transistor Q1 is connected to a cancel terminal CN. The cancel terminal CN is supplied with a cancel voltage linearly varying from 0V to 10V in each cycle. Control terminal of the transistor Q1 is connected to one end of the switch SW4. The other end of the switch SW4 is connected to the output of an inverter 20*b*.

In this embodiment, the switch SW1 and the voltage source of the reference voltage V1 constitute a reference voltage hold circuit for maintaining the node a in the reference voltage when having the capacitor C1 hold the differential voltage. Further, the switch SW4, transistor Q1, 0V voltage source and voltage source of the cancel voltage make up a threshold voltage detector circuit for setting the node b in the threshold voltage of the signal amplifying logic circuit 20 when having the capacitor C1 hold the differential voltage.

Next explained are operations of the signal amplifier circuit 30 shown in FIG. 6 with reference to FIG. 7. That is, control signal CS is sent from the timing control circuit 10 in the period from time T11 to time T12, so the switch SW1 and switch SW3 of the signal amplifier 30 turn ON, and the switch SW2 and switch SW4 turn OFF. In the period from time T11 to time T12, 5V, for example, as the reference voltage V1 is input to the node a. At the same time, 0V is input to the node b.

The next period from time T12 to time T14 is the threshold value cancel period. In the period from time T12 to time T14, the timing control circuit 10 turns the switch SW1 and switch SW ON, and turns the switch SW2 and switch SW3 OFF. As a result, the transistor Q1 turns ON. In the period of one cycle from time T12 to time T14, the cancel terminal CN changes from 0V to 10V. As a result, while the reference voltage V1 (5V) is maintained with the switch SW1 being ON, the voltage at the node b gradually changes from 0V to 10V. Then, at the time T13 where the node b exceeds 4.5V, for example, as the threshold voltage of the amplitude amplifying logic circuit 20, output of the amplitude amplifying logic circuit 20 is inverted. As a result, output signal OS of the amplitude amplifying logic circuit 20 becomes 10V, and the transistor Q1 turns OFF. Thereby, the node b is set in 4.5V which is the voltage for inverting the output signal OS as the output logic of the amplitude amplifying logic circuit 20. That is, the node b is set in the threshold voltage of the amplitude amplifying logic circuit 20. Therefore, −0.5V is stored in the capacitor C1.

The next period from time T14 to time T16 is the data sampling period. That is, in time T14 to time T16, the timing control circuit 10 turns the switch SW2 ON and turns the switch SW1, switch SW3 and switch SW4 OFF. Therefore, input signal IS is input to the node a. For example, when the input signal IS changes from 4V to 6V, output signal OS changes from 0V to 10V upon crossing 5V set as the reference voltage V1. This occurs because −0.5V is stored in the capacitor C1, which permits the voltage of the node b to become 5V+(−0.5V)=4.5V at time T15 where the input signal IS becomes 5V and exceeds 4.5V as the threshold voltage of the amplitude amplifying logic circuit 20. Therefore, output signal OS of the amplitude amplifying logic circuit 20 changes from 0V to 10V.

The next period from time T16 to time T17 is the data hold period. That is, in the period from time T16 to time T17, the timing control circuit 10 turns the switches SW1 to SW4 OFF. In the period from time T16 to time T17, the input signal IS in form of a digital signal having the amplitude of 2V, which was input in the data sampling period (from time T14 to time T16), is held temporarily as output signal OS which is a digital signal having the amplitude of 10V. Operations other than those of the signal amplifier circuit 30 are identical to those of the first embodiment.

Thus, even by using the signal amplifier circuit 30 according to this embodiment as the signal line drive circuit 3, it is ensured to operate the signal line drive circuit 3 with digital signals without increasing the size of the external circuit and its power consumption.

Additionally, the signal amplifier circuit 30 in the liquid crystal display device according to this embodiment enables sampling of a digital signal of an input signal IS having a small amplitude even when there are varieties in characteristics of elements in the signal line drive circuit and the threshold voltage of the amplitude amplifying logic circuit 20 somewhat varies among blocks or products. That is, even when the threshold voltage of the signal amplifying logic circuit 20 varies, normal operation of the signal amplifier circuit 30 is ensured.

Third Embodiment

The third embodiment of the invention is directed to a modification of the above-explained second embodiment in technique for holding the reference voltage at the node a in the threshold value cancel period. This is explained below in detail with reference to the drawings.

Figure 8:
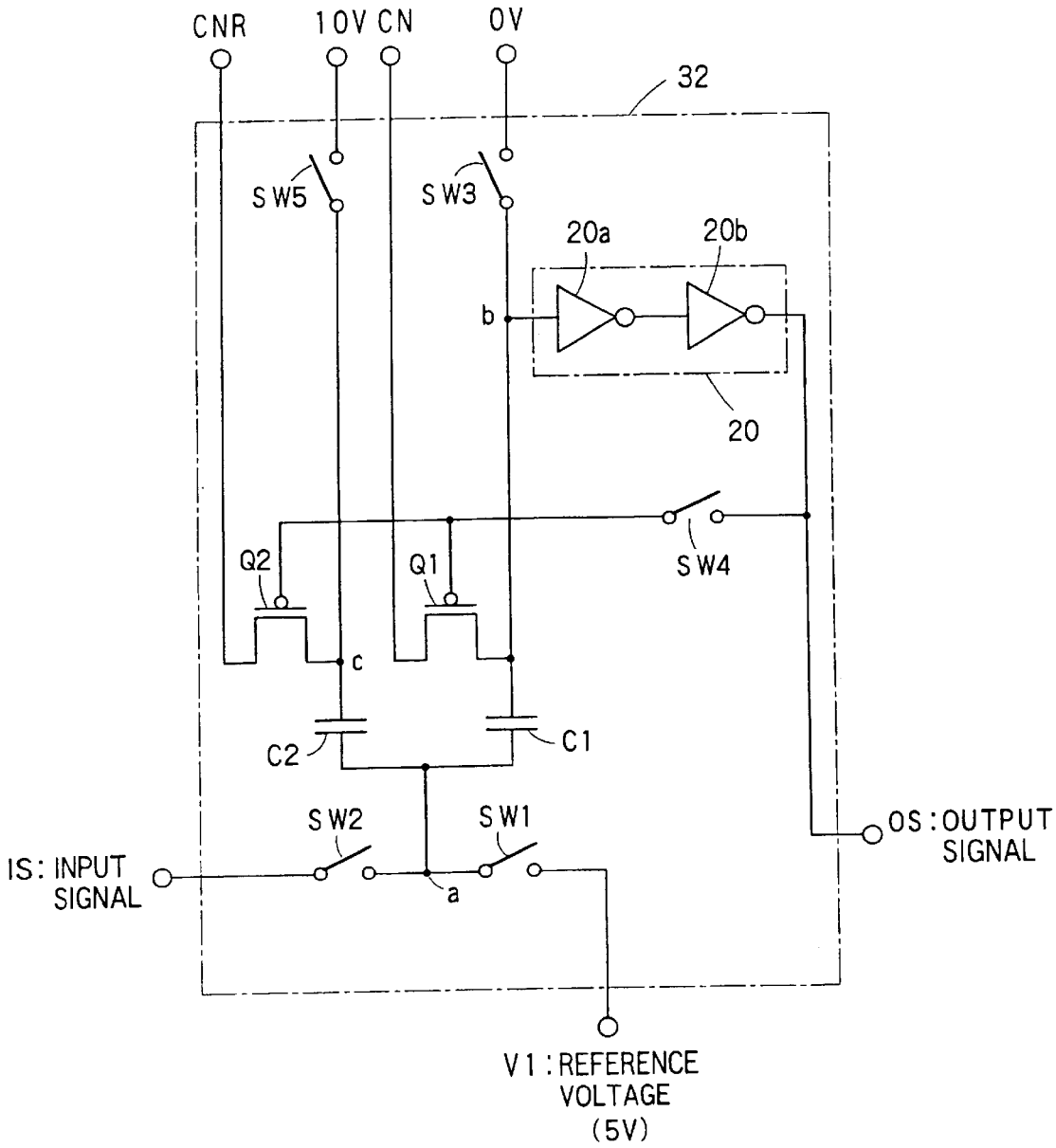
FIG. 8 is a diagram showing a circuit arrangement of a signal amplifier circuit according to the third embodiment of the invention.
Figure 9:
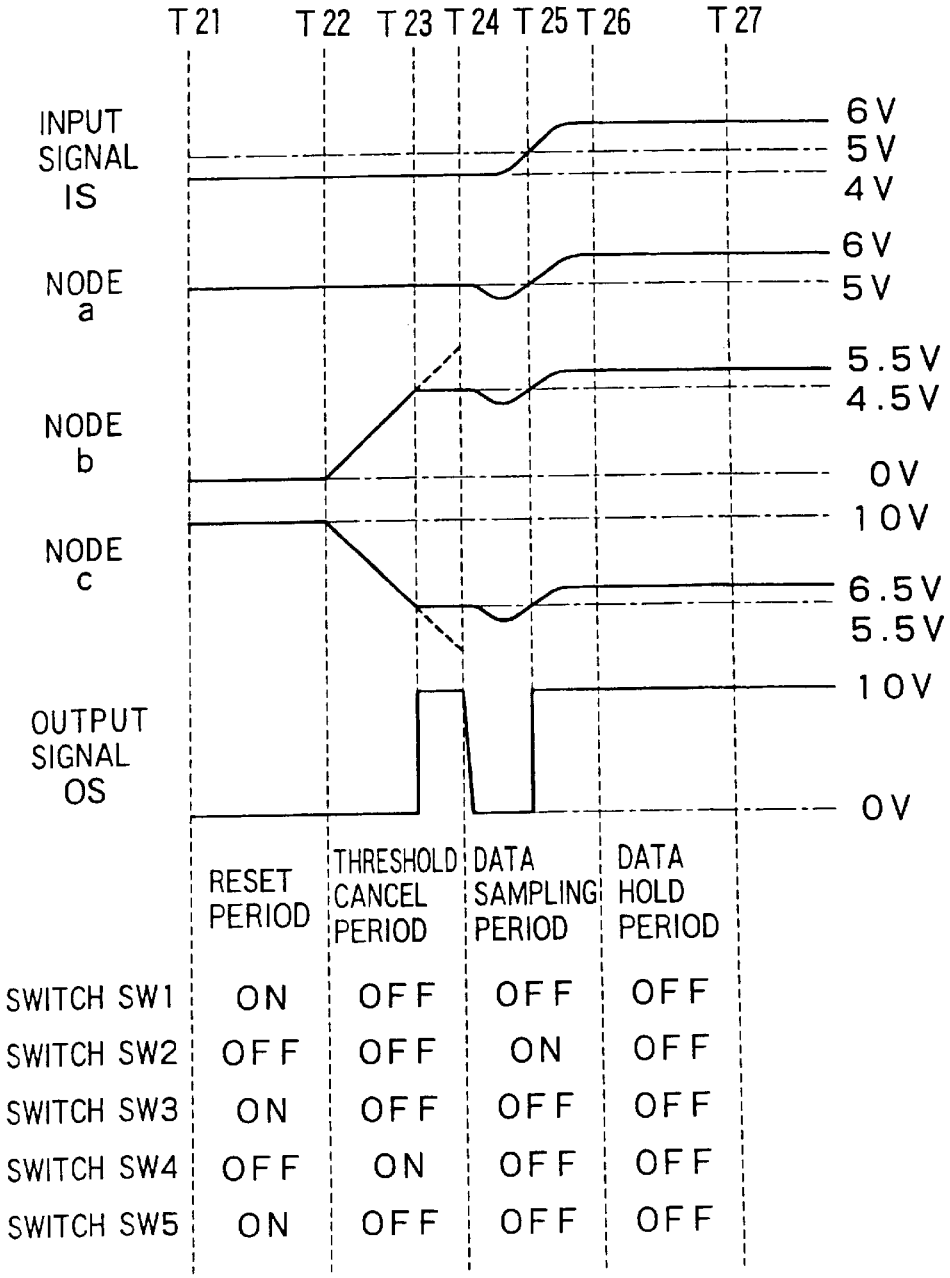
FIG. 9 is a diagram showing a timing chart for explaining operation of the signal amplifier circuit according to the third embodiment shown in FIG. 8.

FIG. 8 is a circuit diagram showing structure of a major part of a signal amplifier circuit according to the third embodiment of the invention. FIG. 9 is a diagram showing a timing chart which shows operations of the signal amplifier circuit shown in FIG. 8.

As shown in FIG. 8, the signal amplifier circuit 32 according to the third embodiment includes, in addition to the signal amplifier circuit 30 according to the second embodiment, a switch SW5, capacitor C2, and transistor Q2 which is a p-type MOS transistor.

A difference of the circuit arrangement from that of the second embodiment lies in the node a between the switch SW2 and the switch SW1 being connected to one end of the capacitor C2. The other end of the capacitor C2 is connected to one end of the switch SW5. The other end of the switch SW5 is connected to a 10V terminal to which a 10V voltage source is connected. The pother end of the capacitor C2 is connected to the output terminal of the transistor Q2. Input terminal of the transistor Q2 is connected to a reverse cancel terminal CNR which is supplied with a cancel voltage linearly varying from 10V to 0V in each cycle.

Control terminal of the transistor Q2 is connected to one end of the switch SW4. The other end of the switch SW4 is connected to the output of the inverter 20*b*.

In this embodiment, switches SW4, SW5 transistor Q2, capacitor C2, 10V voltage source and voltage source of the reverse cancel voltage make up a reference voltage hold circuit for maintaining the node a in the reference voltage while having the capacitor C1 hold the differential voltage. Further, the switch SW4, transistor Q1, 0V voltage source and voltage source of the cancel voltage make up a threshold voltage detector circuit for setting the node b in the threshold voltage of the signal amplifier logic circuit 20 upon having the capacitor C1 hold the differential voltage.

Next explained are operations of the signal amplifier circuit 32 shown in FIG. 8 with reference to FIG. 9. First, the period from time T21 to time T22 is the reset period. That is, in the period from time T21 to time T22, control signal CS is sent from the timing control circuit 10, which turns the switch SW1, switch SW3 and switch SW5 of the signal amplifier circuit 30 ON, and turns the switch SW2 and switch SW4 OFF. In this period from time T21 to time T22, 5V, for example, as the reference voltage V1 is input to the node a. Simultaneously, 0V is input to the node b, and 10V to the node c.

The next period from time T22 to time T24 is the threshold value cancel period. In the period from time T22 to time T24, the timing control circuit 10 turns the switch SW4 ON and turns the other switches SW1 through SW3 and SW5 OFF. As a result, transistors Q1 and Q2 turn ON. In this period from time T22 to time T24, the cancel terminal CN changes from 0V to 10V. Consequently, the node b changes from 0V toward 10V, and the reverse cancel terminal CNR changes from 10V to 0V. Then, the node c changes from 10V toward 0V. As a result, the voltage at the node s is maintained in the reference voltage V1 (5V). Then, at time T23 where the node b exceeds 4.5V, for example, as the threshold voltage of the amplitude amplifying logic circuit 20, output of the amplitude amplifying logic circuit 20 is inverted. As a result, output signal OS from the amplitude amplifying logic circuit 20 becomes 10V, and transistors Q1 and Q2 turn OFF. Accordingly, the node b is set in 4.5V which is the voltage causing the output signal OS as the output logic of the amplitude amplifying logic circuit 20 to invert. That is, the node b is set in the threshold voltage of the amplitude amplifying logic circuit 20. On the other hand, the node c is set in 10V−4.5V (voltage at the node b)=5.5V.

The next period from time T24 to time T26 is the data sampling period. That is, in time T24 to time T26, the timing control circuit 10 turns the switch SW2 ON and turns the switch SW1, switch SW3 through switch SW5 OFF. Therefore, input signal IS is input to the node a. For example, when the input signal IS changes from 4V to 6V, output signal OS changes from 0V to 10V upon crossing 5V set as the reference voltage V1. That is, since the voltage at the node b exceeds 4.5V as the threshold voltage of the amplitude amplifier logic circuit 20 at time T25 where the input signal IS becomes 5V, output signal OS of the amplitude amplifying logic circuit 20 changes from 0V to 10V.

The next period from time T26 to time T27 is the data hold period. That is, in the period from time T26 to time T27, the timing control circuit 10 turns the switches SW1 through SW5 OFF. In this period from time T26 to time T27, input signal IS which is a digital signal having the amplitude of 2V introduced in the data sampling period (from time T24 to time T26) is held temporarily as output signal OS in form of a digital signal having the amplitude of 10V. Operations other than those of the signal amplifier circuit 30 are identical to those of the first embodiment.

Thus, even by using the signal amplifier circuit 32 according to this embodiment as the signal line drive circuit 3, it is ensured to operate the signal line drive circuit 3 with digital signals without increasing the size of the external circuit and its power consumption.

Additionally, the signal amplifier circuit 32 in the liquid crystal display device according to this embodiment enables sampling of a digital signal of an input signal IS having a small amplitude even when there are varieties in characteristics of elements in the signal line drive circuit and the threshold voltage of the amplitude amplifying logic circuit 20 somewhat varies among blocks or products. That is, even when the threshold voltage of the signal amplifying logic circuit 20 varies, normal operation of the signal amplifier circuit 32 is ensured.

Fourth Embodiment

The fourth embodiment of the invention is directed to a modification of the above-explained third embodiment in technique for holding the reference voltage at the node a in the threshold cancel period. It is explained below in detail with reference to the drawings.

Figure 10:
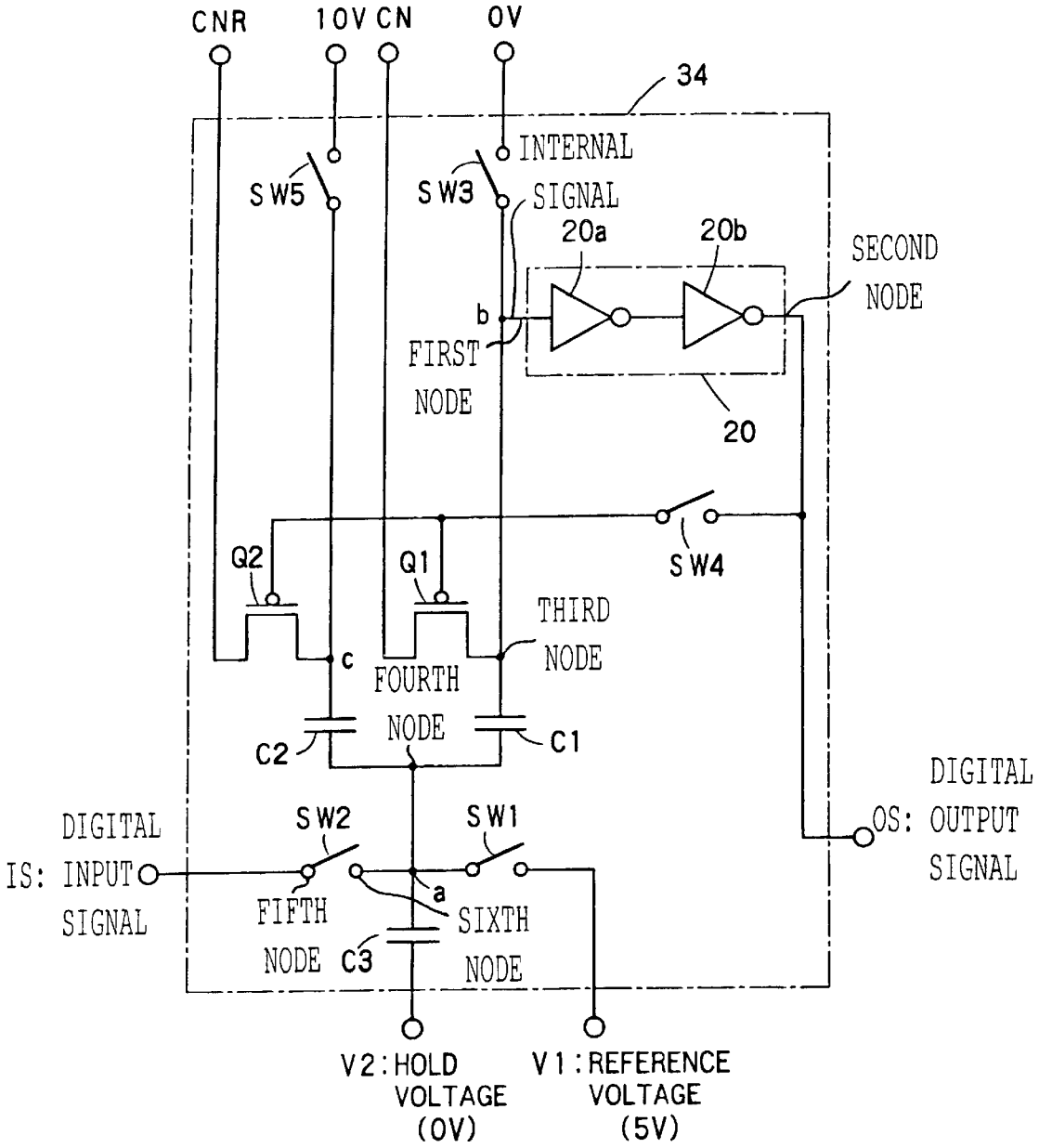
FIG. 10 is a diagram showing a circuit arrangement of a signal amplifier circuit according to the fourth embodiment of the invention.

FIG. 10 is a circuit diagram showing structure of a major part of a signal amplifier circuit according to the fourth embodiment of the invention.

As shown in FIG. 10, the signal amplifier circuit 34 according to the fourth embodiment includes a capacitor C3 in addition to the signal amplifier circuit 32 according to the above-explained third embodiment. A difference in circuit arrangement from the third embodiment lies in that one end of the capacitor C3 is connected to the node a, and the other end of the capacitor C3 is connected to a hold voltage V2. Although 0V is applied as the old voltage in this embodiment, the hold voltage may be any fixed voltage.

In this embodiment, switches SW4, SW5, transistor Q2, capacitors C2, C3, 10V voltage source, voltage source of the reverse cancel voltage, and voltage source of the hold voltage V2 make up the reference voltage hold circuit for holding the reference voltage at the node a when having the capacitor C1 hold the differential voltage.

Operations of the signal amplifier circuit 34 are identical to those of the signal amplifier circuit 32 according to the foregoing third embodiment, and their explanation is omitted.

By adding the capacitor C3 to the node a, the voltage at the node a can be more easily held in 5V in the threshold value cancel period (from time T22 to time T24) shown in FIG. 9. That is, since the voltage of 5V, in this example, is stored in the capacitor C3 in the reset period (from time T21 to time T22), it is possible to hold the node a in 5V throughout the threshold value cancel period.

Fifth Embodiment

The fifth embodiment of the invention is directed to a modification of the foregoing fourth embodiment in technique for switching transistors in the signal amplifier circuit 34. It is explained below in detail with reference to the drawings.

Figure 11:
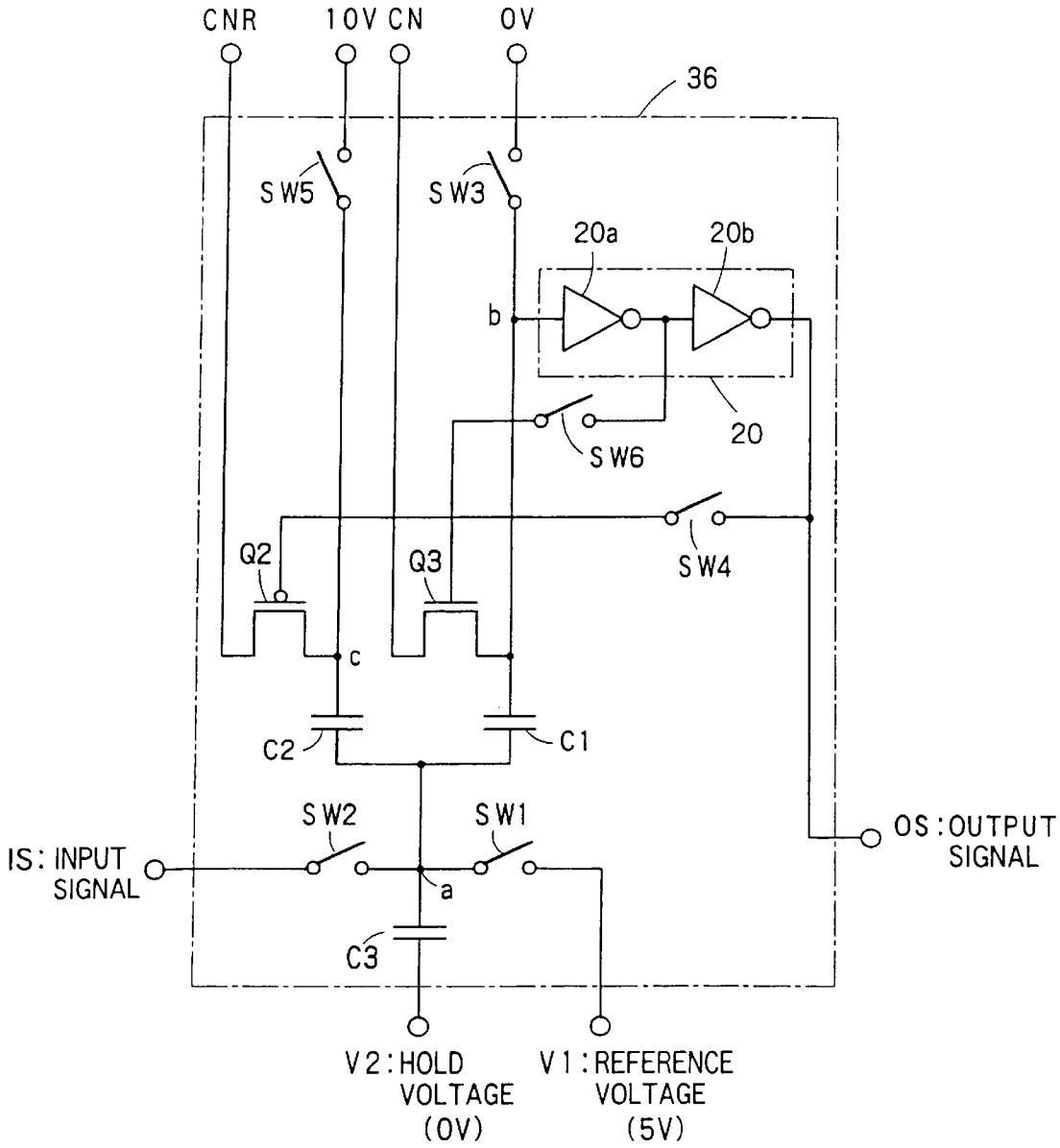
FIG. 11 is a diagram showing a circuit arrangement of a signal amplifier circuit according to the fifth embodiment of the invention.
Figure 12:
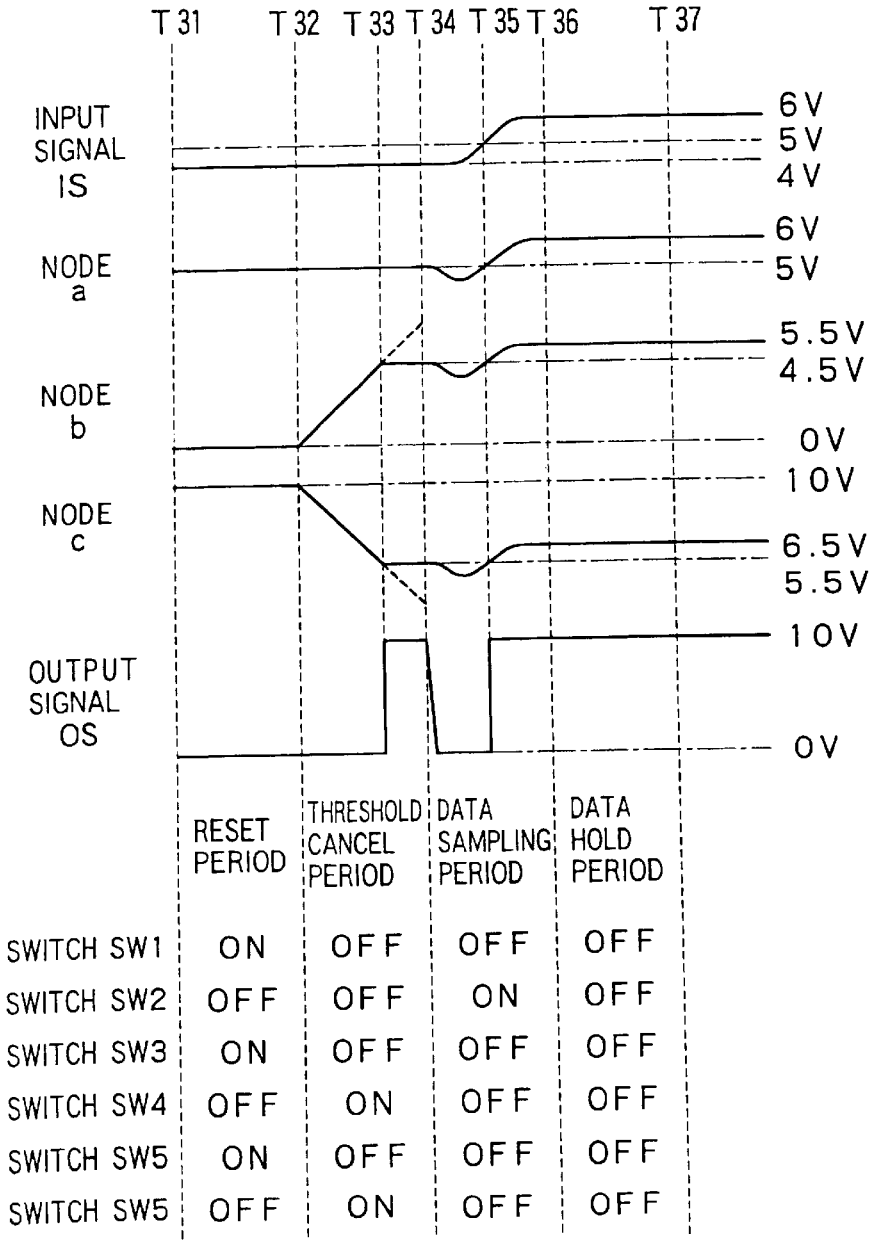
FIG. 12 is a diagram showing a timing chart for explaining operation of the signal amplifier circuit according to the fifth embodiment shown in FIG. 11.

FIG. 11 is a circuit diagram showing structure of a major part of the signal amplifier circuit 36 according to the fifth embodiment of the invention. FIG. 12 is a diagram showing a timing chart of operations of the signal amplifier circuit 36 shown in FIG. 11.

As shown in FIG. 11, the signal amplifier circuit 36 according to the fifth embodiment is based on the signal amplifier circuit 34 according to the fourth embodiment, but replaces its transistor Q1, i.e., p-type MOS transistor, by a transistor Q3 which is an n-type MOS transistor, and adds a switch SW6.

A difference in circuit arrangement from the fourth embodiment lies in the control terminal of the transistor Q3 being connected to one end of the switch SW6. The other end of the switch SW6 is connected to the output of the inverter 20*a* in the amplitude amplifying logic circuit 20.

In this embodiment, the switch SW6, transistor Q3, 0V voltage source, and voltage source of the cancel voltage make up the threshold voltage detector circuit for setting the node b in the threshold voltage of the signal amplifying logic circuit 20 when having the capacitor C1 hold the differential voltage.

Next explained are operations of the signal amplifier circuit 36 shown in FIG. 11 with reference to FIG. 12. First, the period from time T31 to time T32 is the reset period. That is, in the period from time T31 to time T32, control signal Cs is sent from the timing control circuit 10, which turns the switches SW1, SW3 and SW5 ON of the signal amplifier circuit 36 and turns the switches SW2, SW4 and SW6 OFF. In this period from time T31 to time T32, 5V, for example, is input as the reference voltage V1 to the node s. Therefore, voltage of 5V is stored in the capacitor C3. Simultaneously, 0V is input to the node b, and 10V is input to the node c.

The next period from time T32 to time T34 is the threshold value cancel period. In the period from time T32 to time T34, the timing control circuit 10 turn the switches SW4 to SW6 ON and tuns the other switches SW1 to SW3 and SW5 OFF. As a result, transistors Q1 and Q3 turn ON. In this period from time T32 to time T34, the cancel terminal CN changed from 0V to 10V. Therefore, the node b changes from 0V toward 10V. And, the reverse cancel terminal CNR changes from 10V to 0V. Therefore, the node c changes from 10V toward 0V. Furthermore, since the voltage of 5V is stored in the capacitor C3, voltage at the node a is held in the reference voltage V1 (5V). Then, at time T33 where the node b exceeds the threshold voltage of the amplitude amplifying logic circuit, namely, 4.5V, for example, output of the amplitude amplifying logic circuit 20 is inverted.

As a result, output signal OS of the amplitude amplifying logic circuit 20 output from the inverter 20*b* becomes 10V, and transistor Q1 turns OFF. Additionally, the signal output from the inverter 20*a* becomes 0V, and the transistor Q3 also turns OFF. Thereby, the node b is set in 4.5V which is the voltage at which the output signal OS as the output logic of the amplitude amplifying logic circuit 20 is inverted. That is, the node b is set in the threshold voltage of the amplitude amplifying logic circuit 20. Therefore, the differential voltage, −0.5V, is stored in the capacitor C1. On the other hand, the node c is set in 10V−4.5V (voltage at the node b)=5.5V.

The next period from time T34 to time T36 is the data sampling period. That is, in time T34 to time T36, the timing control circuit 10 turn the switch SW2 ON, and turns the switches SW1 and SW3 to SW6 OFF. Therefore, input signal IS is input to the node a. For example, when the input signal IS changes from 4V to 6V, output signal OS changes from 0V to 10V upon crossing 5V set as the reference voltage V1. That is, since the voltage at the node b exceeds the threshold voltage, 4.5V, of the amplitude amplifying logic circuit 20 at time T35 where the input signal IS becomes 5V, output signal OS of the amplitude amplifying logic circuit 20 changes from 0V to 10V.

The next period from time T36 to time T37 is the data hold period. That is, in the period from time T36 to time T37, the timing control circuit 10 turns the switches SW1 to SW6 OFF. In this period from time T36 to time T37, the input signal IS, which is a digital signal having the amplitude of 2V introduced in the data sampling period (from time T34 to time T36), is temporarily held as the output signal OS in form of a digital signal having the amplitude of 10V. Operations other than those of the signal amplifier circuit 36 are identical to those of the first embodiment.

As explained above, even when using the signal amplifier circuit 36 according to the embodiment as the signal line drive circuit 3, the signal line drive circuit 3 is ensured to operate with digital signals without increasing the size of the external circuit and its poser consumption.

Additionally, the signal amplifier circuit 36 in the liquid crystal display device according to this embodiment enables sampling of a digital signal of an input signal IS having a small amplitude even when there are varieties in characteristics of elements in the signal line drive circuit and the threshold voltage of the amplitude amplifying logic circuit 20 somewhat varies among blocks or products. That is, even when the threshold voltage of the signal amplifying logic circuit 20 varies, normal operation of the signal amplifier circuit 36 is ensured.

Furthermore, by adding the capacitor C3 to the node a, the voltage at the node a can be more easily held in 5V in the threshold value cancel period (from time T32 to time T34) shown in FIG. 12. That is, since the voltage of 5V, in this example, is stored in the capacitor C3 in the reset period (from time T31 to time T32), it is possible to keep the node a in 5V throughout the threshold value cancel period.

Sixth Embodiment

The sixth embodiment of the invention uses a transfer gate instead of transistors Q2, Q3 in the foregoing fifth embodiment. This is explained below in detail with reference to the drawings.

Figure 13:
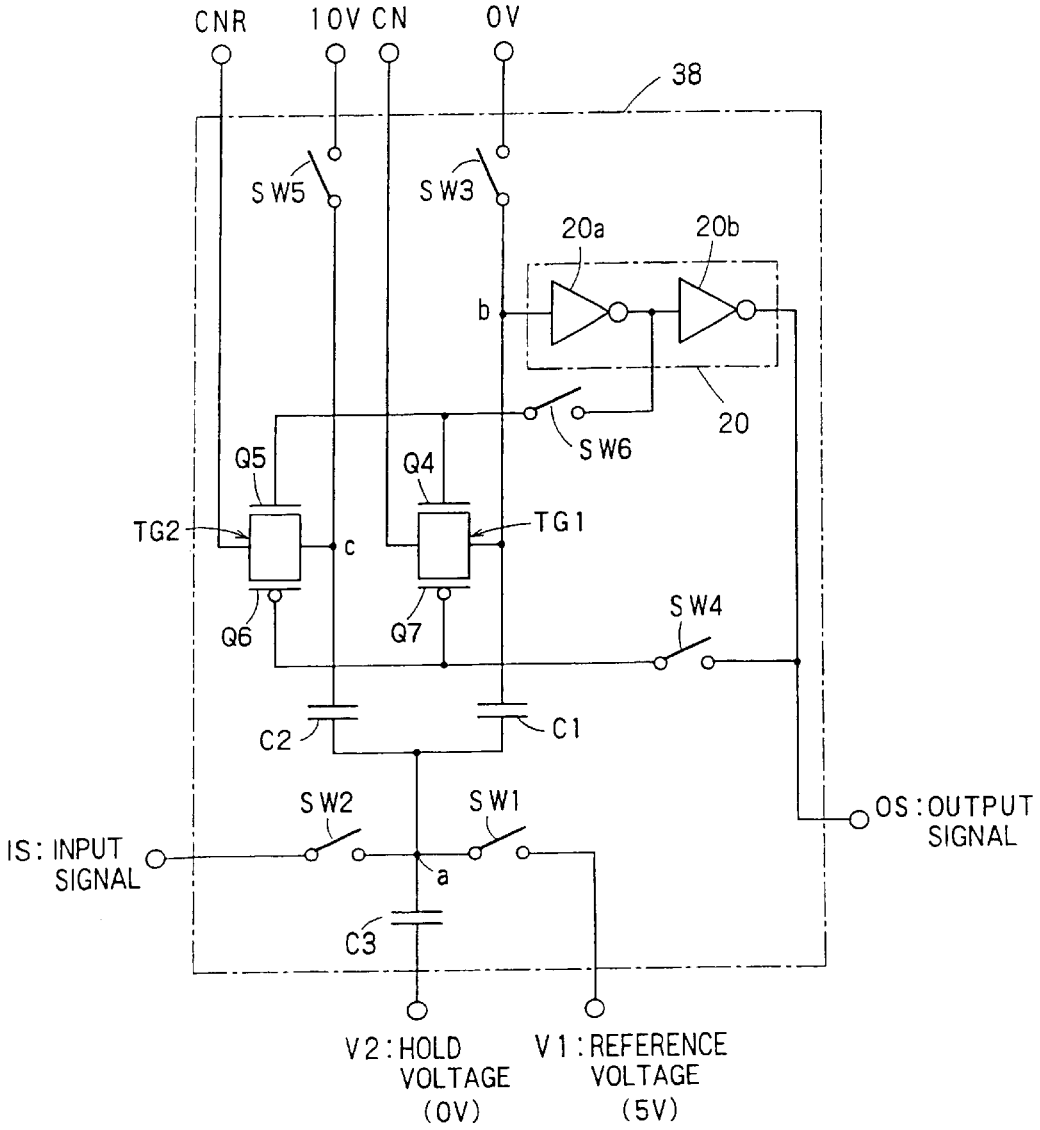
FIG. 13 is a diagram showing a circuit arrangement of a signal amplifier circuit according to the sixth embodiment of the invention.

FIG. 13 is a circuit diagram showing structure of a major part of a signal amplifier circuit according to the sixth embodiment of the invention.

As shown in FIG. 13, the signal amplifier circuit 38 according to the sixth embodiment includes transfer gates TG1 and TG2 instead of the transistors Q2 and Q3 in the signal amplifier circuit 36 according to the fifth embodiment. A difference in circuit arrangement from the fifth embodiment lies in that the transfer gate TG1 is connected to the node b. The transfer gate TG1 is make up of a transistor Q4 which is an n-type MOS transistor, and a transistor Q7 which is a p-type transistor. Connected to the node c is the transfer gate TG2. The transfer gate TG2 is made up of a transistor Q5 which is an n-type MOS transistor, and a transistor Q6 which is a p-type transistor.

In this embodiment, switches SW4, SW5, SW6, transfer gate TG2, capacitor C2, 10V voltage source, and voltage source of the reverse cancel voltage make up the reference voltage hold circuit for maintaining the node a in the reference voltage when having the capacitor C1 hold the differential voltage. Further, switches SW4, SW6, transfer gate TG1, 0V voltage source, and voltage source of the cancel voltage make up the threshold voltage detector circuit for setting the node b in the threshold voltage of the signal amplifying logic circuit 20 when having the capacitor C1 hold the differential voltage.

Operations of the signal amplifier circuit 38 according to this embodiment are identical to those of the signal amplifier circuit 36 according to the foregoing fifth embodiment, and their explanation is omitted.

Seventh Embodiment

The seventh embodiment of the invention is a modification in technique for setting the differential voltage of the capacitor in the second to sixth embodiments. It is explained below in detail with reference to the drawings.

Figure 14:
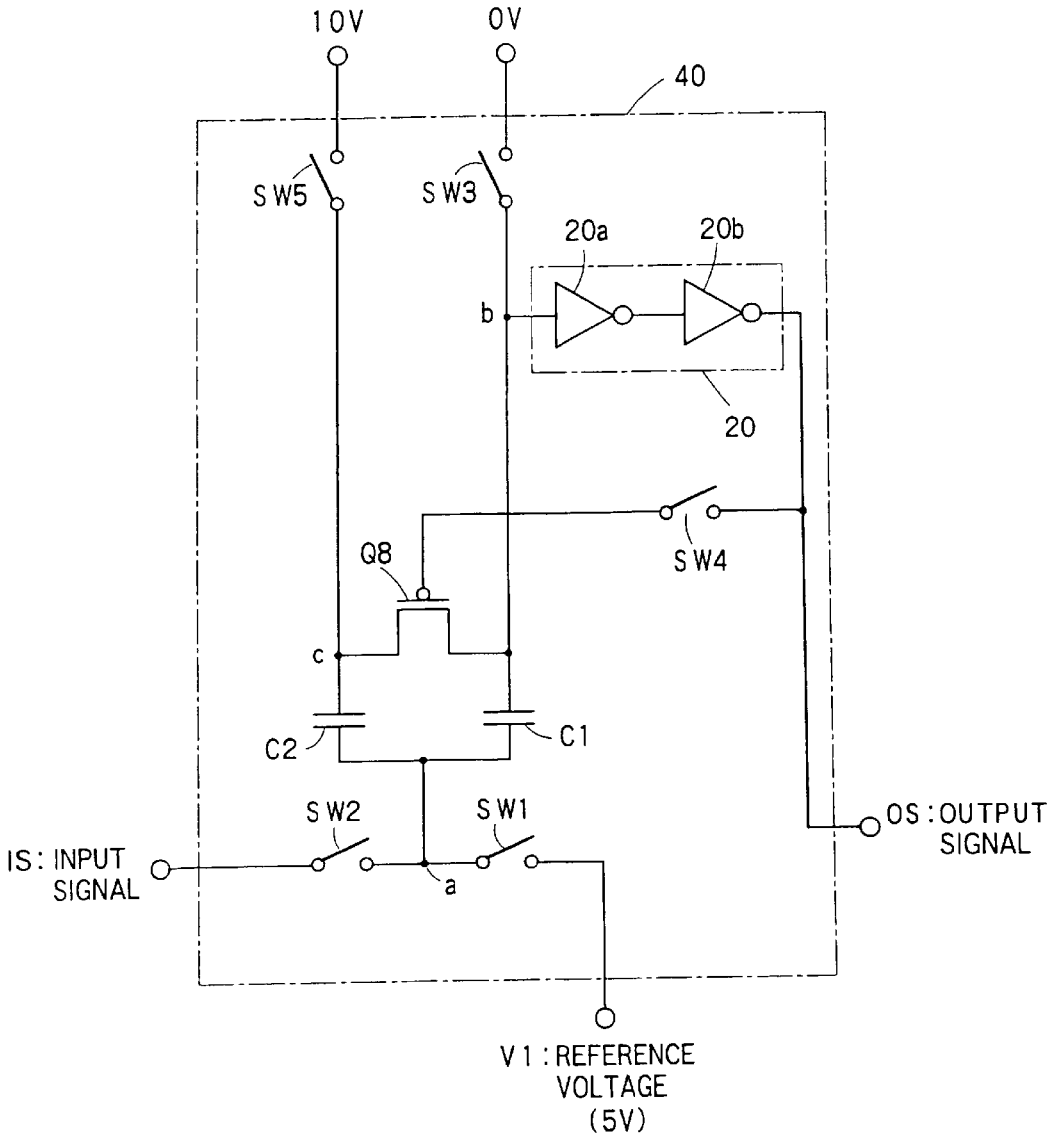
FIG. 14 is a diagram showing a circuit arrangement of a signal amplifier circuit according to the seventh embodiment of the invention.
Figure 15:
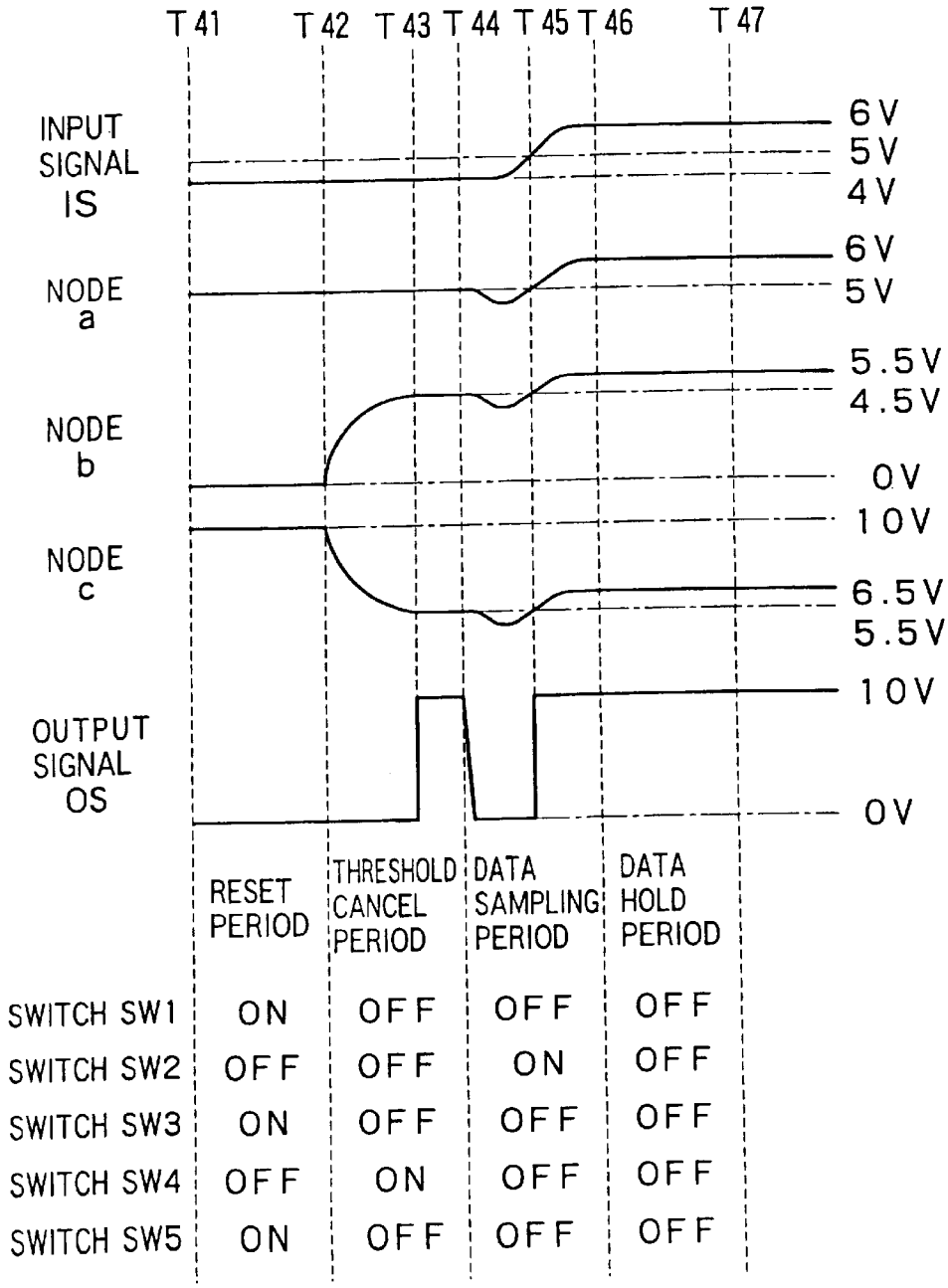
FIG. 15 is a diagram showing a timing chart for explaining operation of the signal amplifier circuit according to the seventh embodiment shown in FIG. 14.

FIG. 14 is a circuit diagram showing structure of a major part of a signal amplifier circuit according to the seventh embodiment of the invention. FIG. 15 is a diagram showing a timing chart of operations of the signal amplifier circuit shown in FIG. 14.

As shown in FIG. 14, the signal amplifier circuit 40 according to the seventh embodiment is different from the third embodiment in including a transistor Q8 which is a p-type MOS transistor used additionally.

A difference in circuit arrangement from the third embodiment lies in the transistor Q8 being connected between one end of the capacitor C1 and one end of the capacitor C2. Control terminal of the transistor Q8 is connected to one end of the switch SW4. The other end of the switch SW4 is connected to the output of the inverter 20*b*.

In this embodiment, switches SW4, SW5, transistor Q8, capacitor C2 and 10V voltage source make up the reference voltage hold circuit for maintaining the node a in the reference voltage when having the capacitor C1 hold the differential voltage. Further, switches SW3 to SW5, transistor Q8, 0V voltage source and 10V voltage source make up the threshold value detector circuit for setting the node b in the threshold voltage of the signal amplifying logic circuit 20 when having the capacitor C1 hold the differential voltage.

Next explained are operations of the signal amplifier circuit 40 shown in FIG. 14 with reference to FIG. 15. First, the period from time T41 to time T42 is the reset period. That is, in the period from time T41 to time T42, control signal Cs is sent from the timing control circuit 10, which turns the switches SW1, SW3 and SW5 of the signal amplifier circuit 40 ON, and turns the switches SW2 and SW4 OFF. In this period from time T41 to time T42, the reference voltage V1, for example, 5V, is input to the node d. Simultaneously, 0V is input to the node b, and 10V is input to the node c.

The next period from time T42 to time T44 is the threshold value cancel period. That is, in the period from time T42 to time T44, the timing control circuit 10 turns the switches SW1 to SW3 and SW5 OFF, and turns the switch SW4 ON. As a result, the transistor Q8 turns ON. In this period from time T42 to time T44, the capacitors C1 and C2 are short-circuited via the transistor Q8. Therefore, while the node a maintains 5V as the reference voltage V1, the voltage at the node b changes from 0V toward 10V. Then, at time T43 where the node b exceeds the threshold voltage of the amplitude amplifying logic circuit 20, 4.5V, for example, output of the amplitude amplifying logic circuit 20 is inverted, and the output signal OS becomes 10V. Therefore, the transistor Q8 turns OFF. As a result, the node b is set in the threshold voltage which is the voltage where the output logic of the amplitude amplifying logic circuit 20 is inverted. That is, the differential voltage between the threshold voltage of the amplitude amplifying logic circuit 20 and 5V as the reference voltage V1 is stored in the capacitor C1. That is, in this embodiment, voltage of −0.5V is stored in the capacitor C1.

The next period from time T44 to time T46 is the data sampling period. That is, in the period from time T44 to time T46, the timing control circuit 10 turns the switch SW2 ON and turns the other switches SW1 and SW3 to SW5 OFF. Let the input signal IS, for example, change from 4V to 6V in this period from time T44 to time T46. In this case, output signal OS of the amplitude amplifying logic circuit 20 changes from 0V to 10V at the point of time T45 upon crossing 5V set as the reference voltage V1. That is, at time T4 where the input signal IS surpasses 5V, the voltage at the node b exceeds 4.5V which is the threshold voltage of the amplitude amplifying logic circuit 20. Therefore, output signal OS of the amplitude amplifying logic circuit 20 changes from LOW to HIGH.

The next period from time T46 to time T47 is the data hold period. That is, in the period from time T46 to time T47, the timing control circuit 10 turns the switches SW1 through SW5 OFF. In this period from time T46 to time T47, input signal IS in form of a digital signal having the amplitude of 2V introduced in the data sampling period (from time T44 to time T46) is temporarily held as output signal OS in form of a digital signal having the amplitude of 10V. Operations other than those of the signal amplifier circuit 40 are identical of those of the first embodiment.

As explained above, even when using the signal amplifier circuit 40 according to the embodiment as the signal line drive circuit 3, it is ensured to operate the signal line drive circuit 3 with digital signals without increasing the size of the external circuit and its power consumption.

Additionally, the signal amplifier circuit 40 in the liquid crystal display device according to the embodiment enables sampling of a digital signal of an input signal IS having a small amplitude even when there are varieties in characteristics of elements in the signal line drive circuit and the threshold voltage of the amplitude amplifying logic circuit 20 somewhat varies among blocks or products. That is, even when the threshold voltage of the signal amplifying logic circuit 20 varies, normal operation of the signal amplifier circuit 40 is ensured.

Eighth Embodiment

The eighth embodiment of the invention is a modification in technique for setting the differential voltage of the capacitor C1 in the foregoing seventh embodiment. It is explained below in detail with reference to the drawings.

Figure 16:
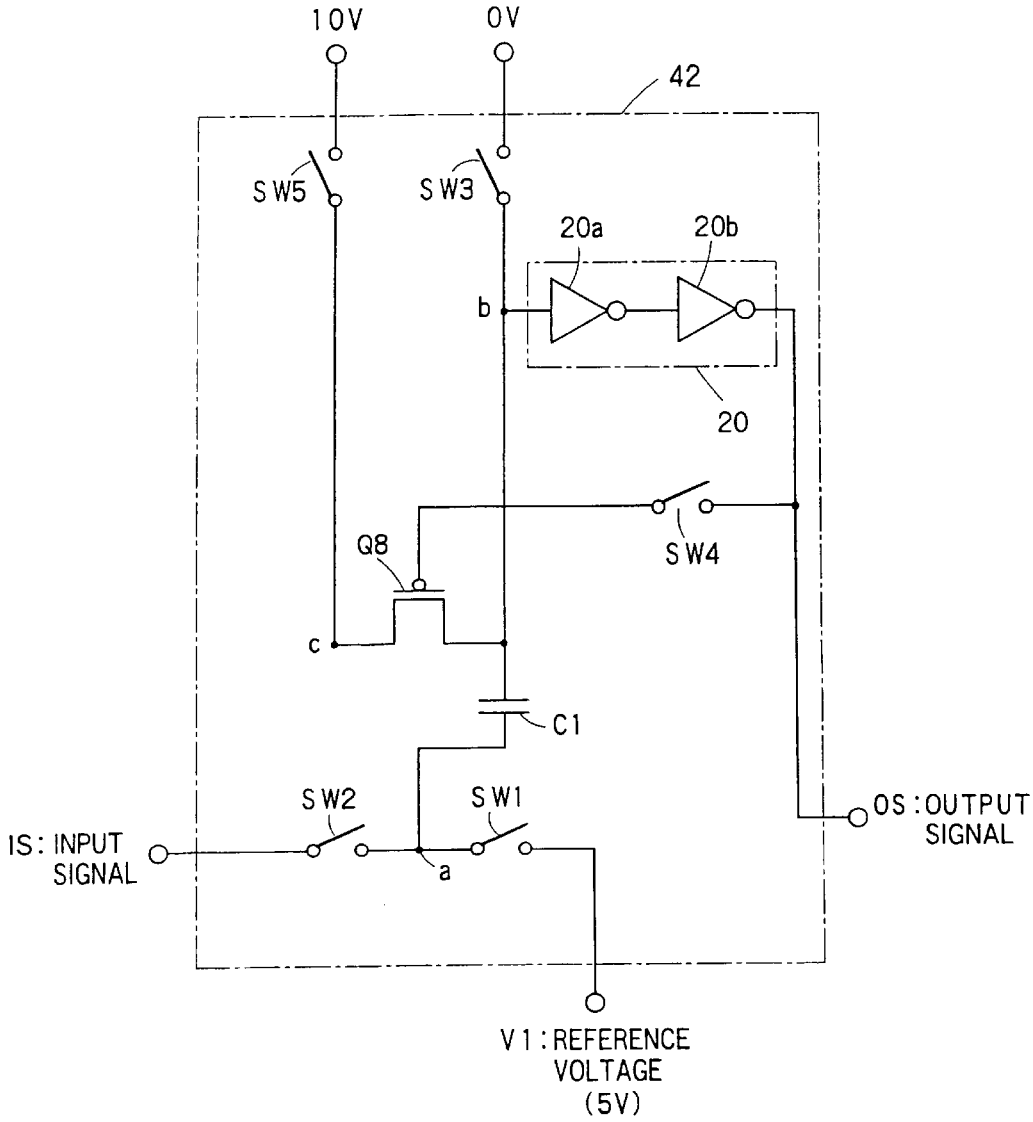
FIG. 16 is a diagram showing a circuit arrangement of a signal amplifier circuit according to the eighth embodiment of the invention.
Figure 17:
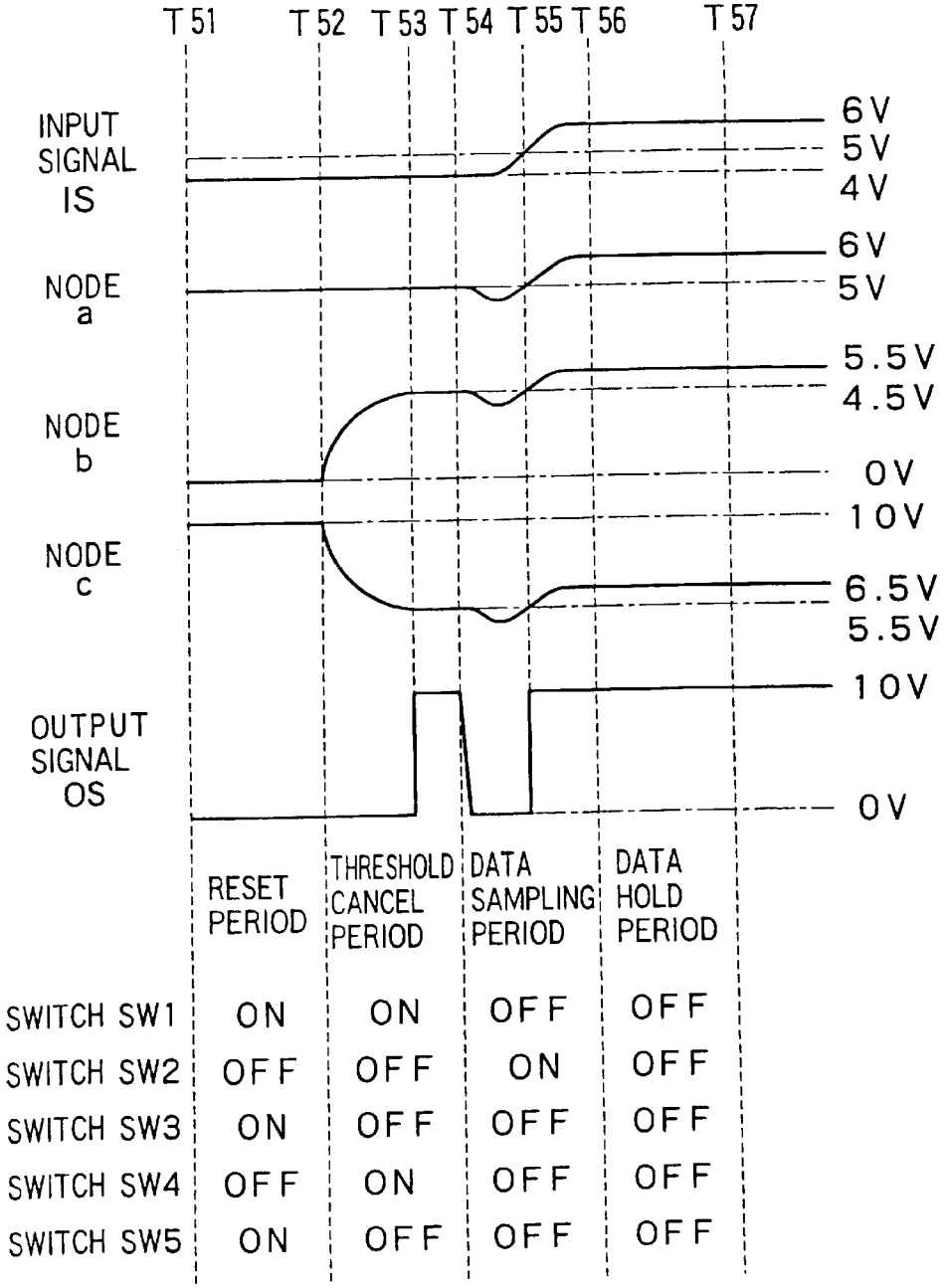
FIG. 17 is a diagram showing a timing chart for explaining operation of the signal amplifier circuit according to the eighth embodiment shown in FIG. 16.

FIG. 16 is a circuit diagram showing structure of a major part of a signal amplifier circuit according to the eighth embodiment of the invention. FIG. 17 is a diagram showing a timing chart of operations of the signal amplifier circuit shown in FIG. 16.

In this embodiment, the switch SW1 and the voltage source of the reference voltage V1 make up the reference voltage hold circuit for maintaining the node a in the reference voltage when having the capacitor C1 hold the differential voltage. Further, the switches SW3 to SW5, transistor Q8, 0V voltage source and 10V voltage source make up the threshold voltage detector circuit for setting the node b in the threshold voltage of the signal amplifying logic circuit 20 when having the capacitor C1 hold the differential voltage.

As shown in FIG. 16, the signal amplifier circuit 42 according to the eighth embodiment is different from the seventh embodiment in omitting the capacitor C2.

Next explained are operations of the signal amplifier circuit 42 shown in FIG. 16 with reference to FIG. 17. First, the period from time T51 to time T52 is the reset period. That is, in the period from time T51 to time T52, control signal CS is sent from the timing control circuit 10, which turns the switches SW1, SW3 and SW5 of the signal amplifier circuit 40 ON, and turns the switches SW2 and SW4 OFF. In this period from time T51 to time T52, the reference voltage V1, 5V, for example, is input to the node a. Simultaneously, 0V is input tot the node b, and 10V is input to the node c.

The next period from time T52 to time T54 is the threshold value cancel period. That is, in the period from time T52 to time T54, the timing control circuit 10 turns the switches SW2, SW3 and SW5 OFF, and turns the switches SW1 and SW4 ON. As a result, the transistor Q8 turns ON. In this period from time T52 to time T54, capacitors C1 and C2 are short-circuited through the transistor Q8. Additionally, since the switch SW is ON, voltage at the node a is maintained in 5V which is the reference voltage V1. Therefore, while the voltage at the node a is maintained in 5V, voltage at the node b changes from 0V toward 10V. Then, at time T53 where the node b exceeds 4.5V, for example, determined as the threshold voltage of the amplitude amplifying logic circuit 20, output of the amplitude amplifying logic circuit 20 is inverted, and output signal OS becomes 10V. Therefore, the transistor Q8 turns OFF. As a result, the node b is set in the threshold voltage at which the output logic of the amplitude amplifying logic circuit 20 is inverted. That is, the differential voltage between the threshold voltage of the amplitude amplifying logic circuit 20 and 5V as the reference voltage V1 is stored in the capacitor C1. In this example, voltage of −0.5V is stored in the capacitor C1.

The next period from time T54 to time T56 is the data sampling period. That is, in the period from time T54 to time T56, the timing control circuit 10 turn the switch SW2 ON, and turns the other switches SW1 and SW3 to SW5 OFF. Let the input signal IS change from 4V to 6V, for example, In this period from time T54 to time T56. In this case, output signal OS of the amplitude amplifying logic circuit 20 changes from 0V to 10V at the point of time T55 when crossing 5V set as the reference voltage V1. That is, at time T55 where the voltage of the input signal IS exceeds 5V, voltage at the node b exceeds 4.5V which is the threshold voltage of the amplitude amplifying logic circuit 20. Therefore, output signal OS of the amplitude amplifying logic circuit 20 changes from LOW to HIGH.

The next period from time T56 to time T57 is the data hold period. That is, in the period from time T56 to time T57, the timing control circuit 10 turn the switches SW1 to SW5 OFF. In this period from time T56 to time T57, input signal IS in form of a digital signal having the amplitude of 2V input in the data sampling period (from time T54 to time T56) is temporarily held as output signal OS in form of a digital signal having the amplitude of 10V. Operations other than those of the signal amplifier circuit 42 are identical as those of the first embodiment.

As explained above, even when using the signal amplifier circuit 42 according to the embodiment as the signal line drive circuit 3, it is ensured to operate the signal line drive circuit 3 with digital signals without increasing the size of the external circuit and its power consumption.

Additionally, the signal amplifier circuit 42 in the liquid crystal display device according to the embodiment enables sampling of a digital signal of an input signal IS having a small amplitude even when there are varieties in characteristics of elements in the signal line drive circuit and the threshold voltage of the amplitude amplifying logic circuit 20 somewhat varies among blocks or products. That is, even when the threshold voltage of the signal amplifying logic circuit 20 varies, normal operation of the signal amplifier circuit 42 is ensured.

Moreover, since the signal amplifier circuit 42 according to the invention omits the capacitor C2 from the seventh embodiment, its circuit arrangement is simplified.

Ninth Embodiment

The ninth embodiment of the invention is a modification in technique for holding the reference voltage at the node a in the threshold value cancel period in the foregoing seventh embodiment. It is explained below in detail with reference to the drawings.

Figure 18:
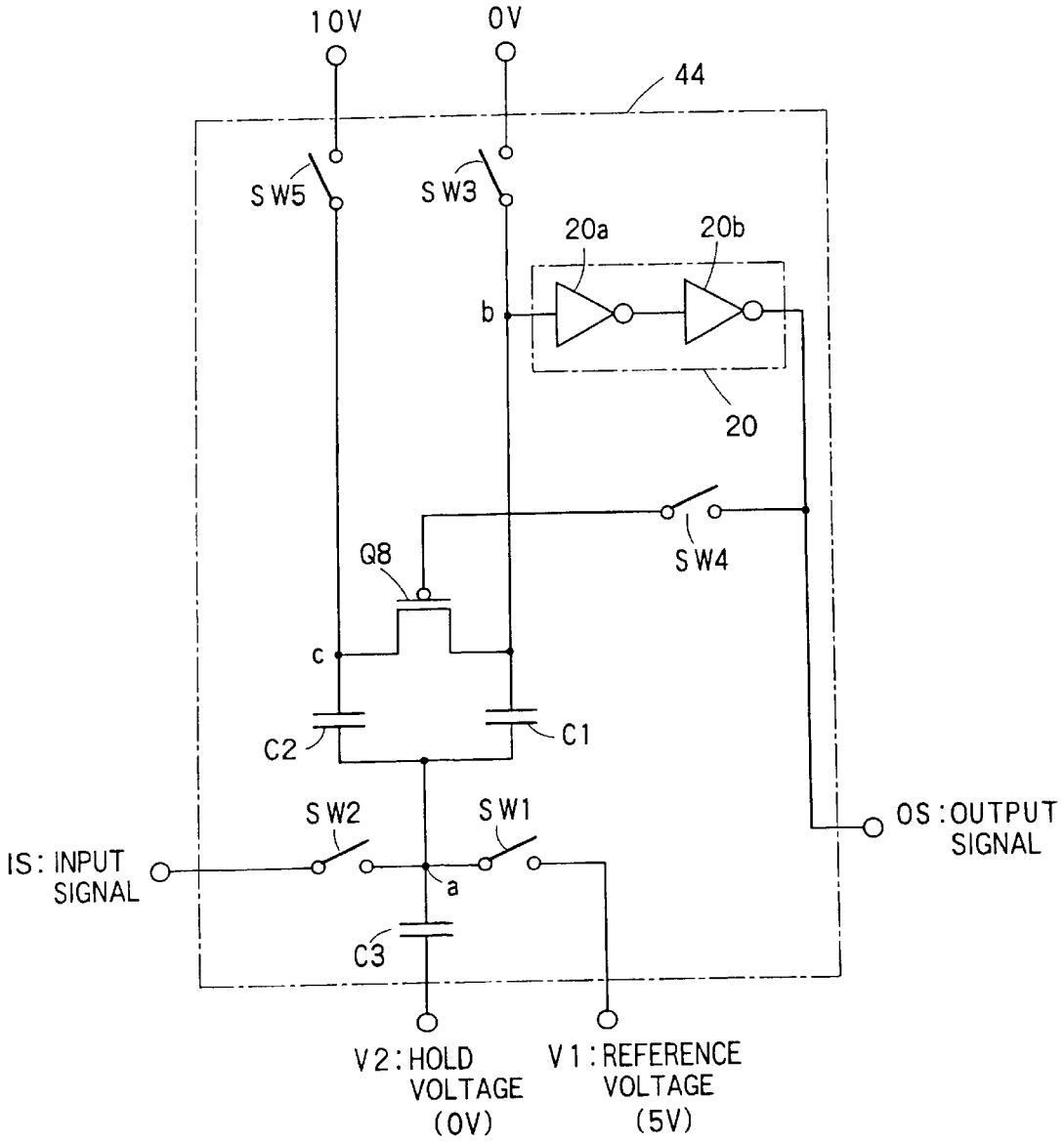
FIG. 18 is a diagram showing a circuit arrangement of a signal amplifier circuit according to the ninth embodiment of the invention.

FIG. 18 is a circuit diagram showing structure of a major part of a signal amplifier circuit according to the ninth embodiment of the invention.

As shown in FIG. 18, the signal amplifier circuit 44 according to the ninth embodiment includes a capacitor C3 in addition to the signal amplifier circuit 40 according to the seventh embodiment. A difference in circuit arrangement from the seventh embodiment lies in that one end of the capacitor C3 is connected to the node a, and the other end of the capacitor C3 is connected to the hold voltage V2. In this embodiment, 0V is applied as the hold voltage; however, any fixed voltage is acceptable.

In this embodiment, the switches SW4, SW5, transistor Q8, capacitors C2, C3 and 10V voltage source make up the reference voltage hold circuit for maintaining the node a in the reference voltage when having the capacitor C1 hold the differential voltage. Further, the switches SW3 through SW5, transistor Q8, 0V voltage source and 10V voltage source make up the threshold voltage detector circuit for setting the node b in the threshold voltage of the signal amplifying logic circuit 20 when having the capacitor C1 hold the differential voltage.

Operations of the signal amplifier circuit 44 according to the embodiment are identical to those of the signal amplifier circuit 40 according to the seventh embodiment. So, their explanation is omitted.

By adding the capacitor C3 to the node a, voltage at the node a is more easily held in 5V in the threshold value cancel period (from time T42 to time T44) shown in FIG. 15. That is, since the voltage of 5V is stored in the capacitor C3, in this example, in the reset period (from time T41 to time T42), it is easy to keep 5V at the node a throughout the threshold value cancel period.

Tenth Embodiment

The tenth embodiment of the invention uses a transfer gate TG3 instead of the transistor Q8 used in the ninth embodiment. It is explained below in detail with reference to the drawings.

Figure 19:
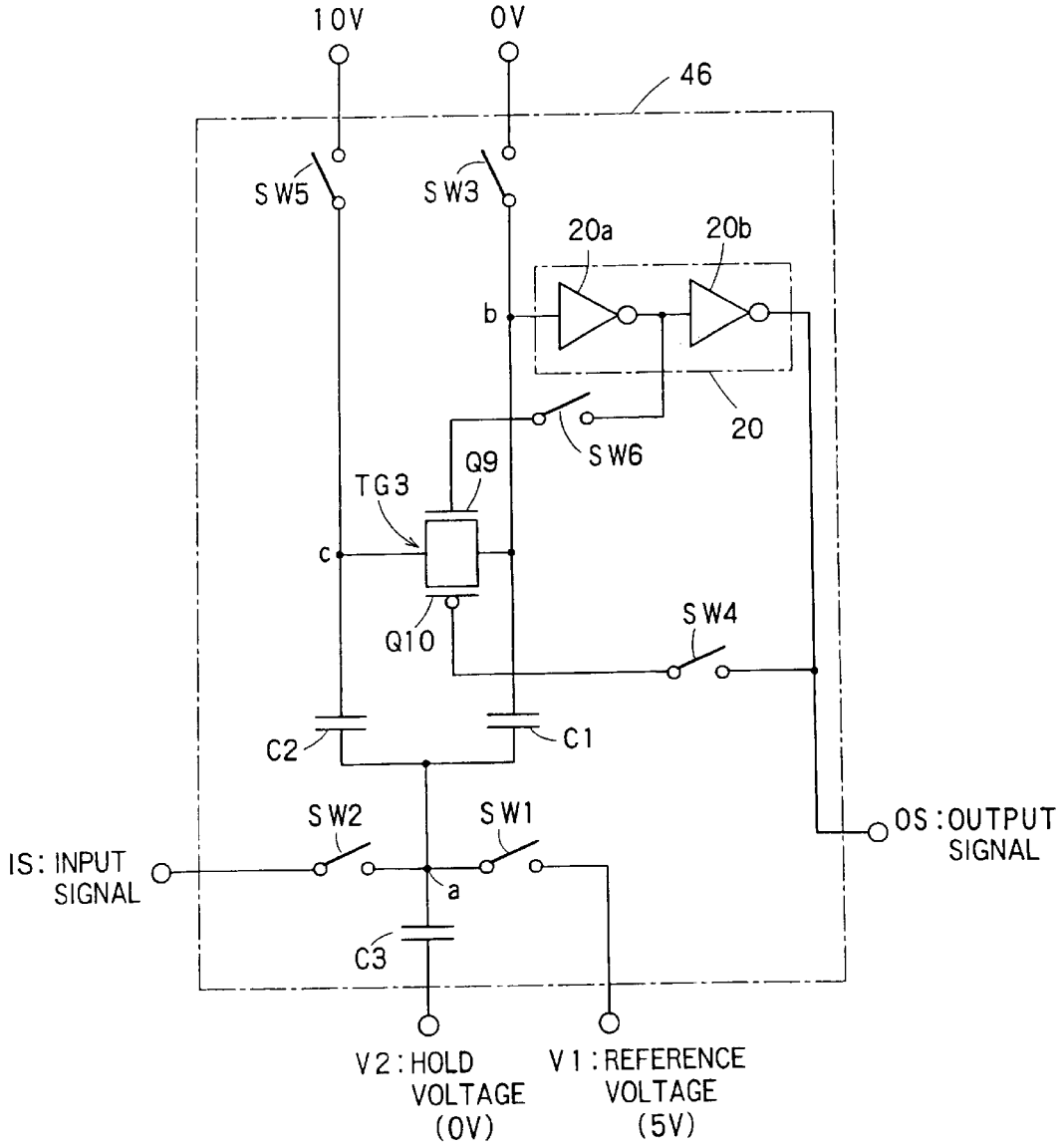
FIG. 19 is a diagram showing a circuit arrangement of a signal amplifier circuit according to the tenth embodiment of the invention.
Figure 20:
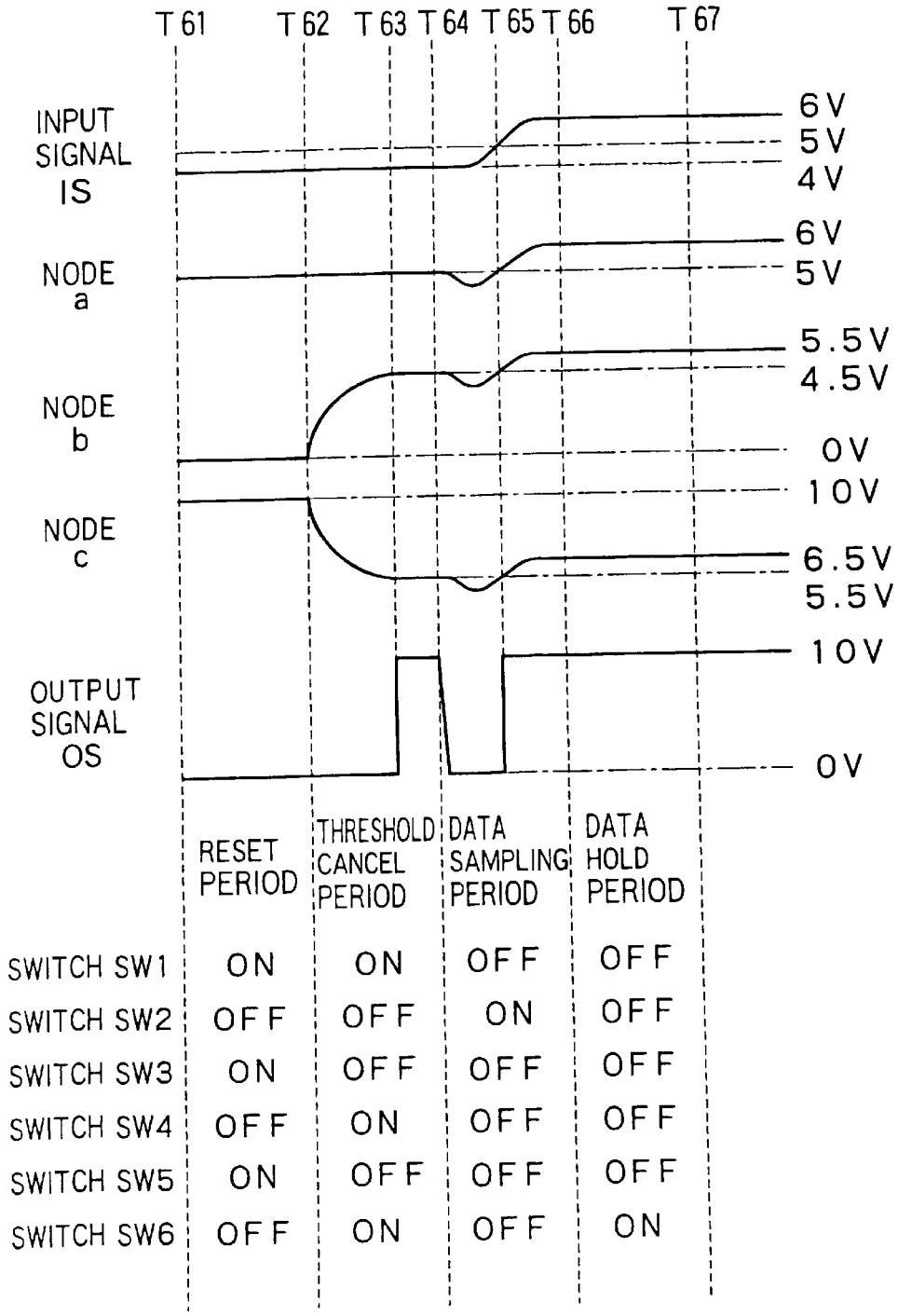
FIG. 20 is a diagram showing a timing chart for explaining operation of the signal amplifier circuit according to the tenth embodiment shown in FIG. 19.

FIG. 19 is a circuit diagram showing structure of a major part of a signal amplifier circuit according to the tenth embodiment of the invention, and FIG. 20 is a diagram showing a timing chart of operations of the signal amplifier circuit shown in FIG. 19.

As shown in FIG. 19, the signal amplifier circuit 46 according to the tenth embodiment is different from the foregoing ninth embodiment in using the transfer gate TG3 in lieu of the transistor Q8. The transfer gate TG3 is made up of a transistor Q9 which is an n-type MOS transistor, and a transistor Q10 which is a p-type MOS transistor. Control terminal of the transistor Q9 is connected to one end of the switch SW6. The other end of the switch SW 6 is connected to the output of the inverter 20*a* of the amplitude amplifying logic circuit 20. Control terminal of the transistor Q10 is connected to one end of the switch SW4. The other end of the switch SW4 is connected to the output of the inverter 20*b* of the amplitude amplifying logic circuit 20.

In this embodiment, switches SW4 to SW6, transfer gate TG3, capacitors C2, C3 and 10V voltage source make up the reference voltage hold circuit for keeping the reference voltage at the node a when having the capacitor C1 hold the differential voltage. Further, switches SW3 to SW6, transfer gate TG3, 0V voltage source and 10V voltage source make up the threshold voltage detector circuit for setting the node b in the threshold voltage of the signal amplifying logic circuit 20 when having the capacitor C1 hold the differential voltage.

Next explained are operations of the signal amplifier circuit 46 shown in FIG. 19 with reference to FIG. 20. First, the period from time T61 to time T62 is the reset period. That is, in the period from time T61 to time T62, control signal CS is sent from the timing control circuit 10, which turns the switches SW1, SW3 and SW5 of the signal amplifier circuit 46 ON, and turns the switches SW2, SW4 and SW6 OFF. In this period from time T61 to time T62, 5V, for example, as the reference voltage V1 is input to the node a. Simultaneously, 0V is input to the node b, and 10V is input to the node c.

The next period from time T62 to time T64 is the threshold value cancel period. That is, in the period from time T62 to time T64, the timing control circuit 10 turns the switches SW1 to SW3 and SW5 OFF, and turns the switches SW4 and SW6 ON. As a result, transistors Q9 and Q10 turn ON. That is, the transfer gate TG3 turns ON.

In this period from time T62 to time T64, capacitors C1 and C2 are short-circuited through these transistors Q9 and Q10. Therefore, while the voltage at the node a is maintained in 5V, voltage at the node changes from 0V toward 10V. Then, at time T63 where the node b exceeds the threshold voltage of the amplitude amplifying logic circuit 20, e.g., 4.5V, output of the amplitude amplifying logic circuit 20 is inverted, and output signal OS becomes 10V. Therefore, transistors Q9 and Q10 turn OFF. That is, the transfer gate TG3 turns ON. As a result, the node b is set in the threshold voltage which is the voltage making the output logic of the amplitude amplifying logic circuit 20 to invert. That is, the differential voltage between the threshold voltage of the amplitude amplifying logic circuit 20 and 5V as the reference voltage V1 is stored in the capacitor C1. In this embodiment, voltage of −0.5V is stored in the capacitor C1.

The next period from time T64 to time T66 is the data sampling period. That is, in the period from time T64 to time T66, the timing control circuit 10 turns the switch SW2 ON, and turns the other switches SW1, SW3 to SW6 OFF. Let the input signal IS change from 4V to 6V, for example, in this period from time T64 to time T66. In this case, at the point of time T65, output signal OS of the amplitude amplifying logic circuit 20 changes from 0V to 10V when crossing 5V set as the reference voltage V1. That is, at time T65 where the voltage of the input signal IS exceeds 5V, voltage at the node b exceeds 4.5V which is the threshold voltage of the amplitude amplifying logic circuit 20. Therefore, output signal OS of the amplitude amplifying logic circuit 20 changes from HIGH to LOW.

The next period from time T66 to time T67 is the data hold period. That is, in the period from time T66 to time T67, the timing control circuit 10 turns the switches SW1 to SW6 OFF. In this period from time T66 to time T67, input signal IS in form of a digital signal having the amplitude of 2V introduced in the data sampling period (from time T64 to time T66) is temporarily held as output signal OS in form of a digital signal having the amplitude of 10V. Operations other than those of the signal amplifier circuit 46 are identical to those of the first embodiment.

As explained above, also by using the signal amplifier circuit 46 according to the embodiment as the signal line drive circuit 3, it is ensured to operate the signal line drive circuit 3 with digital signals without increasing the size of the external circuit and its power consumption.

Additionally, the signal amplifier circuit 46 in the liquid crystal display device according to the invention enables sampling of a digital signal of an input signal IS having a small amplitude even when there are varieties in characteristics of elements in the signal line drive circuit and the threshold voltage of the amplitude amplifying logic circuit 20 varies among blocks or products. That is, even when the threshold voltage of the signal amplifying logic circuit 20 fluctuates, normal operation of the signal amplifier circuit 46 is ensured.

Eleventh Embodiment

The eleventh embodiment of the invention is directed to a circuit structure of the amplitude amplifying logic circuit 20 used in each of the foregoing embodiments.

Figure 21:
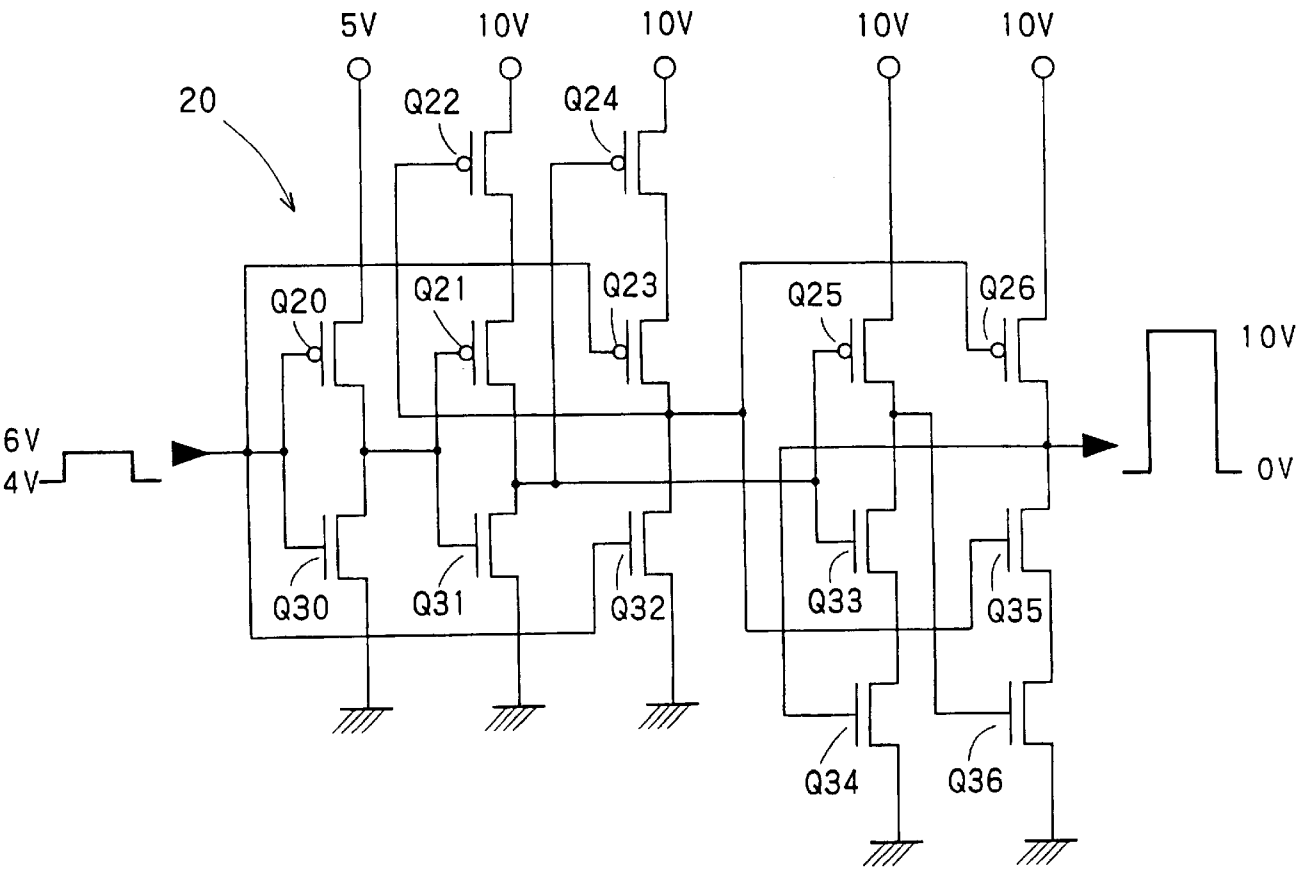
FIG. 21 is a diagram showing an example of circuit arrangement of an amplitude amplifying logic circuit used in the invention (eleventh embodiment)

FIG. 21 is a circuit diagram showing structure of the amplitude amplifying logic circuit 20. As shown in FIG. 21, the amplitude amplifying logic circuit 20 includes transistors Q20 to Q26 which are p-type MOS transistors, and transistors Q30 to Q36 which are n-type MOS transistors. Since the amplitude amplifying logic circuit 20 is a typically used level shifter circuit, no more explanation is made here.

The invention is not limited to the above-explained first to eleventh embodiments, but can be changed or modified in various modes. For example, also for he operation timing in the threshold value cancel period, for example, the operation for canceling the threshold value need not be done upon every data sampling if the threshold voltage of the amplitude amplifying logic circuit 20 is still held sufficiently in the capacitor C1.

Further, in each of those embodiments, although the threshold voltage of the amplitude amplifying logic circuit 20 is detected in the course of an upward change of the voltage at the node b, the threshold voltage of the amplitude amplifying logic circuit 20 may be detected in the course of a downward change of the voltage at the node b. That is, each of those embodiments is configured to detect the threshold voltage at the timing of a change of the output signal of the amplitude amplifying logic circuit from LOW to HIGH, but on the contrary, the threshold voltage may be detected at the timing of such a change from HIGH to LOW.

As explained above, according to the invention, since the differential voltage between the threshold voltage of the amplitude amplifying logic circuit and the reference voltage is absorbed by the difference voltage hold circuit, a signal amplifier circuit using the amplitude amplifying logic circuit can be operated normally even when there occur varieties in characteristics of elements forming the amplitude amplifying logic circuit and the threshold voltage of the amplitude amplifying logic circuit varies accordingly.

Twelfth Embodiment

Heretofore, the signal amplitude amplifier circuit 12*a* shown in FIG. 2 according to the invention has been explained. Next, however, the load drive circuit provided in the digital analog converter circuit 16*a* in FIG. 2 according to the invention is explained specifically with reference to the drawings. That is, explained below are examples using a load drive circuit according to the invention in a signal drive circuit of a liquid crystal display.

The load drive circuit according to the twelfth embodiment of the invention is intended to have a capacitor absorb variation in threshold voltage for having the logic output of the logic circuit to invert by holding the differential voltage between the voltage of the input video signal and the threshold voltage of a logic circuit and having the logic circuit to execute ON/OFF control of a transistor for controlling the voltage of the signal line supplying the input video signal. It is explained below in greater detail.

Figure 22:
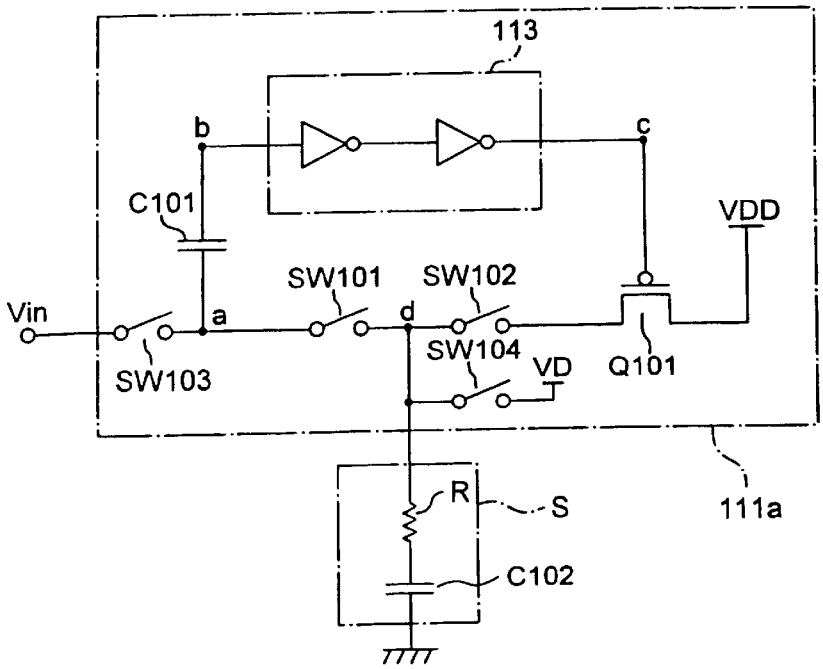
FIG. 22 is a circuit diagram showing structure of a major part of a load drive circuit as the twelfth embodiment.
Figure 23:
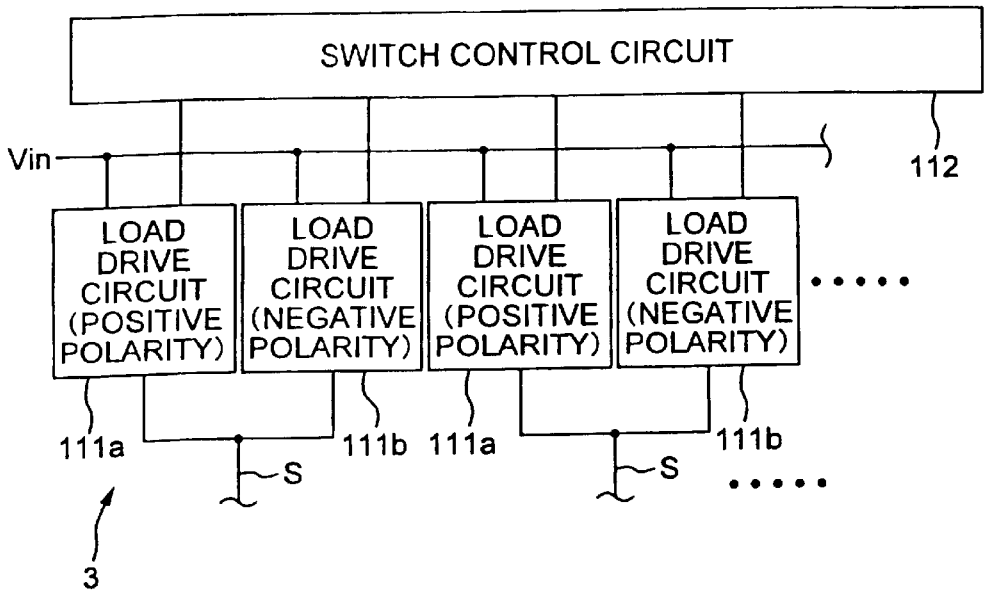
FIG. 23 is a general block diagram showing the entire structure of the load drive circuit.
Figure 24:
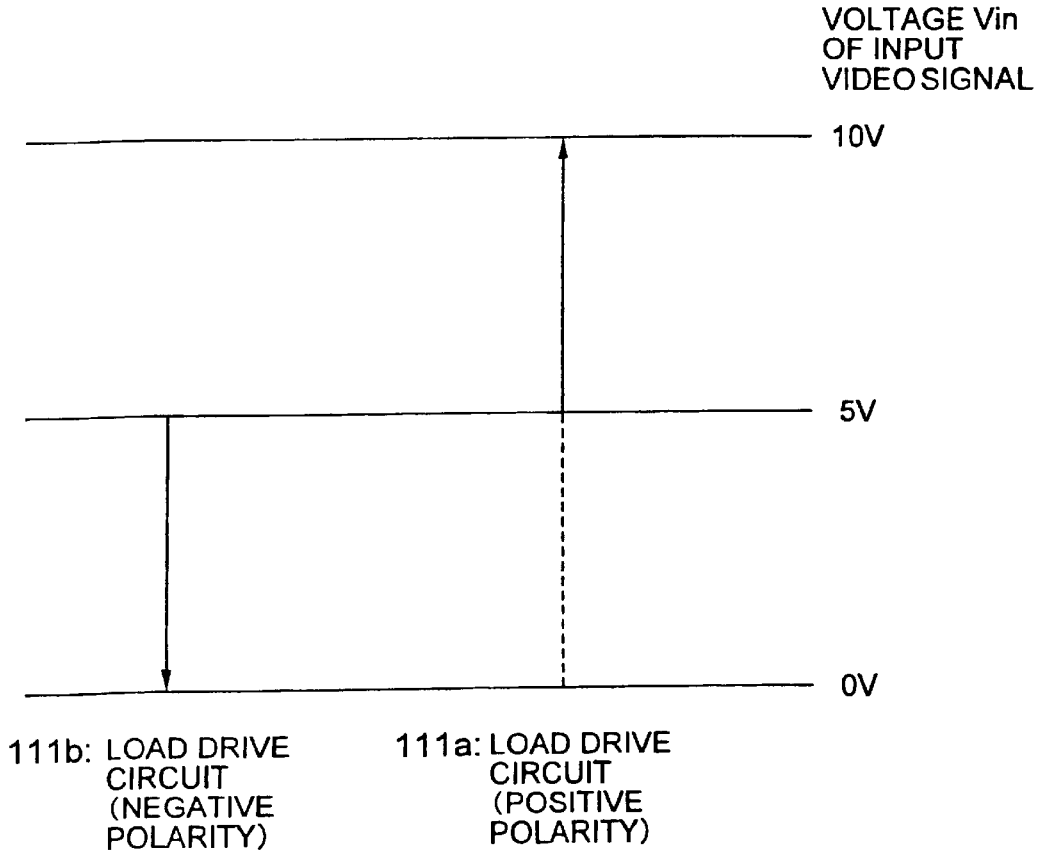
FIG. 24 is a diagram for explaining operative sections of a positive polarity load drive circuit and a negative polarity load drive circuit.

FIG. 22 is a circuit diagram showing structure of a major part of the load drive circuit according to the twelfth embodiment of the invention. FIG. 23 is a general block diagram showing entire structure of the load drive circuit. FIG. 24 is a diagram explaining operation blocks or sections of a positive polarity load drive circuit and a negative polarity load drive circuit.

The signal line drive circuit 3 in FIG. 4 includes the load drive circuit shown in FIG. 23. The load drive circuit of FIG. 23 includes a positive polarity drive circuit 111*a*, negative polarity load drive circuit 111*b*, and switch control circuit 112 for switching and controlling various switches in those load drive circuits 111*a* and 111*b*, which are provided in each signal line.

FIG. 24 is a diagram explaining functional blocks or sections of the positive polarity load drive circuit 111*a* and the negative polarity load drive circuit 111*b*. As shown in FIG. 24, in this embodiment, input video signal Vin is a signal between 0V and 10V, and the input video signal Vin is divided into two, namely, a part of 0V to 5V and the other part of 5V to 10V to drive the positive polarity load drive circuit 111*a* and the negative polarity load drive circuit 111*b*, respectively.

That is, the negative polarity load drive circuit 111*b* is a buffer circuit which functions to preset the signal line S in 5V and lower the voltage of the signal line S to the voltage of the input video signal Vin when the input video signal Vin is in 0V to 5V. The positive polarity load drive circuit 111*a* is a buffer circuit which functions to preset the signal line S in 5V and raise the voltage of the signal line S to the voltage of the input video signal Vin when the input video signal Vin is in 5V to 10V. It is controlled by the switch control circuit 112 which of these load drive circuits 111*a* and 111*b* should be driven.

In this embodiment, the voltage preset in the signal line S is selected in 5V which is the intermediate voltage of the input video signal Vin having the voltage amplitude of 0 to 10V; however, it may be preset in a voltage other than the intermediate voltage.

FIG. 22 is a circuit diagram of the positive polarity load drive circuit 111*a*. Each load drive circuit 111*a* includes, as shown in FIG. 22, switches SW101 to SW104, transistor Q101 being a PMOS transistor, logic circuit 113 connecting two inverters in two stages, and capacitor C101. Connected to the signal line S driven by the load drive circuits 111*a*, 111*b* are pixel display TFT, liquid crystal capacitance, auxiliary capacitance, and so on, as shown in FIG. 4. FIG. 22, however, illustrates the load of the signal line S in form of an equivalent circuit of the resistor R and the capacitor C102 for simplicity.

One end of the switch SW101 and one end of the switch SW102 are connected to the signal line S. The other end of the switch SW101 is connected to one end of the switch SW103 and one end of the capacitor C101. Supplied to the other end of the switch SW103 is the input video signal Vin. The other end of the capacitor C101 is connected to the input terminal of the logic circuit 113, and the output terminal of the logic circuit 113 is connected to the gate terminal of the transistor Q101. Supplied to the source terminal of the transistor Q101 is a first voltage VDD (for example, 10V), and connected to its drain terminal is the other end of the switch SW102. Connected to one end of the switch SW104 is the signal line S, and a second voltage VD (for example, 5V) is applied to the other end of the switch SW104. These switches SW101 to SW104 are controlled by the switch control circuit 112 shown in FIG. 23.

In FIG. 22, node of the switch SW101 and the capacitor C101 is labeled a, node of the capacitor C101 and the logic circuit 113 is labeled b, node of the logic circuit 113 and the transistor Q101 is labeled c, and node of the switches SW101 and SW102 is labeled d.

The capacitor 101 forms the differential voltage hold circuit in this embodiment, and the first voltage VDD forms the first voltage supply circuit in this embodiment.

Figure 25:
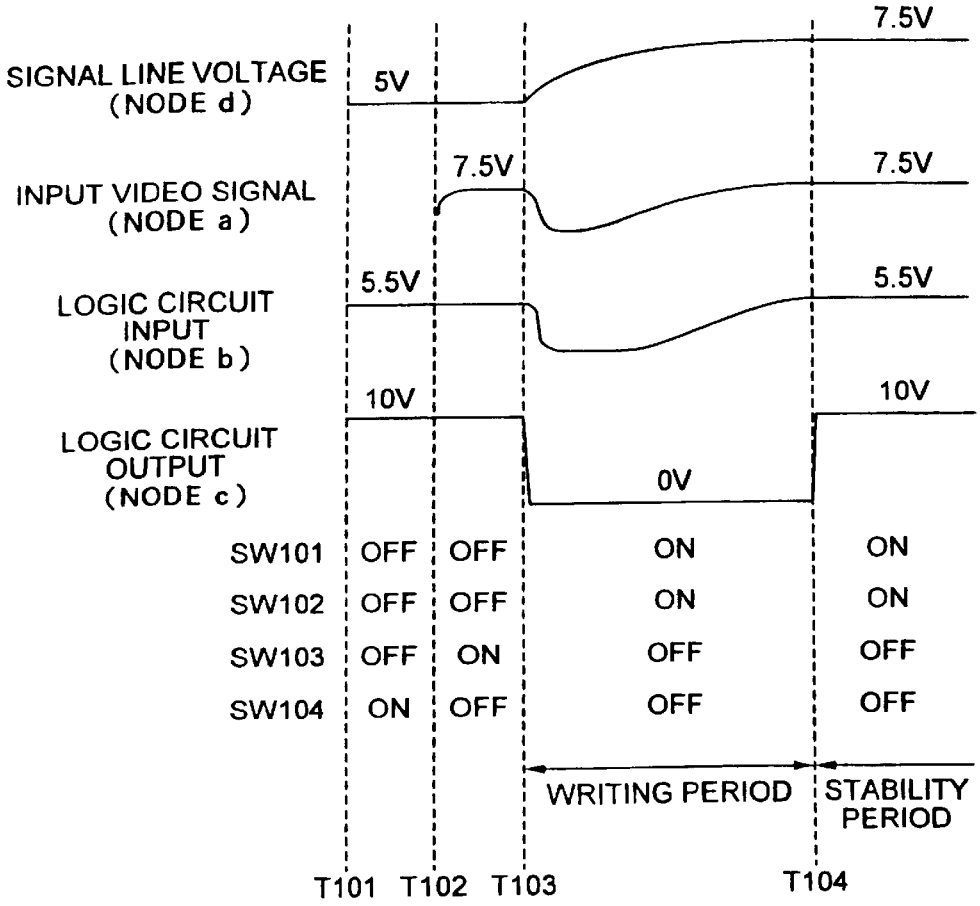
FIG. 25 is a timing chart of operations of different portions in the load drive circuit according to the twelfth embodiment.

FIG. 25 is a timing diagram of operations of respective portions in the load drive circuit 111*a*. Explained below are operations of the circuit of FIG. 22, using this timing diagram. First, in the period from time T101 to T102, the switch control circuit 112 turns the switches SW101 to SW103 OFF and turns the switch 104 ON. As a result, voltage of the signal line S (node d in FIG. 22) becomes the same voltage as the second voltage VD (for example, 5V).

Next, in the period from time T102 to T103, the switch control circuit 112 turns the switch SW103 alone ON. As a result, voltage at the node a in FIG. 22 becomes equal to the voltage of the input video signal Vin. FIG. 25 shows an example in which the voltage of the input video signal Vin is 7.5V. However, since the switch SW101 is OFF, voltage of the signal line S (node d in FIG. 22) maintains 5V.

Assuming here that the threshold voltage for inverting the output logic of the logic circuit 113 is 5.5V, voltage at the input terminal of the logic circuit 113 (node b in FIG. 22) is set in the threshold voltage of the logic circuit 113 by some means. A technique for setting the node b of FIG. 22 in the threshold voltage of the logic circuit 113 will be explained later with another embodiment. Once the input terminal of the logic circuit 113 is set in the threshold voltage, voltage at the output terminal of the logic circuit 113 (node c in FIG. 22) theoretically becomes about 5V which is the intermediate voltage between 0V and 10V. Actually, however, the voltage at the node b in FIG. 22 is some times slightly higher or lower than the threshold voltage, 5.5V. In this case, voltage at the output terminal of the logic circuit 113 (node c in FIG. 22) sometimes becomes 10V or sometimes becomes 0V. FIG. 25 shows an example in which it becomes 10V.

However, in the period from time T101 to time T102, the switches SW101 and SW102 are OFF. Therefore, whatever the output voltage of the logic circuit 113 is, it never affects the output of the input video signal Vin introduced to the signal line after time T103 which is explained later.

At that time, since the switch SW103 is ON, voltage at the node a in FIG. 22 is 7.5V which is the voltage of the input video signal Vin. Therefore, maintained in the capacitor C101 is the differential voltage (2V) between the voltage of the input video signal Vin (7.5V) and the threshold voltage of the logic circuit 113 (5.5V).

Next, after the time T103, the switch control circuit 112 turns the switches SW101 and SW102 ON and turns the switches SW103 and SW104 OFF. At the point of time T103, the node a in FIG. 22 is 7.5V whereas the node d is 5V. Therefore, when the switch SW101 turns ON, voltage at the node a drops due to affection by the node d. Since the capacitor C101 maintains the above-mentioned differential voltage (2V), voltage at the node b in FIG. 22, which is the opposite end of the capacitor C101, also drops following the voltage at the node a, and output of the logic circuit 113 inverts and becomes the LOW level (for example, 0V). As a result, the transistor Q101 turns ON, the first voltage VDD is supplied to the signal line S via the transistor Q101 and the switch SW102, and the voltage of the signal line S (node d in FIG. 22) gradually rises.

As the voltage of the signal line S rises, voltages at the node a and the node b in FIG. 22 also rise responsively. Eventually, at time T104, voltage of the signal line S becomes equal to the voltage of the input video signal Vin, i.e., 7.5V, and the voltage at the node a in FIG. 22 also becomes equal to 7.5V. Since the capacitor C101 holds the differential voltage (2V), voltage at the node b in FIG. 22 becomes the threshold voltage, 5.5V. Therefore, output of the logic circuit 113 again inverts and becomes HIGH level (for example, 10V). As a result, the transistor Q101 turns OFF.

When the transistor Q101 turns OFF, voltage at the node d in FIG. 22 decreases due to gradual discharge of the capacitor C102 on the signal line S or reallocation of electric charges in the signal line S, among others. However, at the point of time where the voltage at the input terminal of the logic circuit 113 (node b in FIG. 22) goes lower the threshold voltage of the logic circuit 113, the transistor Q101 again turns ON, and the voltage at the node d in FIG. 22 rises again. By repeating this operation while holding the differential voltage (2V) in the capacitor C102, the voltage on the signal line S (node d in FIG. 22) is held in the voltage of the input video signal Vin, i.e., 7.5V.

Figure 26:
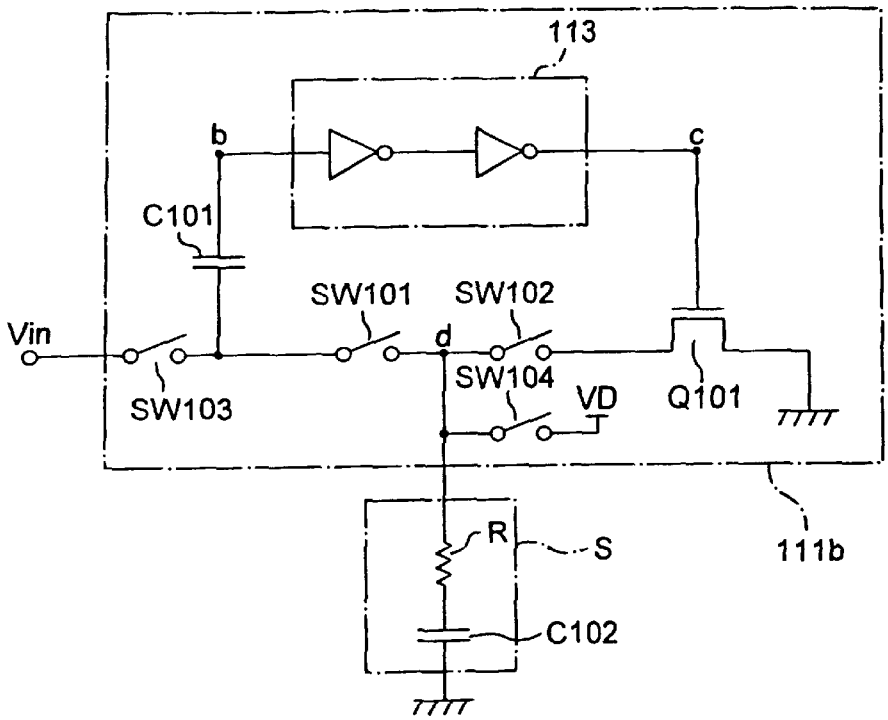
FIG. 26 is a circuit diagram showing detailed structure of the negative polarity load drive circuit in the twelfth embodiment.

FIG. 26 is a circuit diagram showing detailed structure of the negative polarity load drive circuit 111*b*. As shown in FIG. 26, the load drive circuit 111*b* is different from the load drive circuit 111*a* of FIG. 22 in that the transistor Q101 is n-type and the source electrode of the transistor Q101 is connected to ground, but it is identical in the other respect.

As explained above, since the twelfth embodiment is so configured that the switches SW101, SW102, logic circuit 113 and transistor Q101 make up a feedback loop under the condition having the differential voltage held in the capacitor C101 shown in FIG. 22, if the voltage of the signal line S becomes lower than the voltage of the input video signal Vin, then the transistor Q101 is turned ON to raise the voltage of the signal line S, and is later turned OFF when the voltage of the signal S becomes approximately equal to the voltage of the input video signal Vin. Thereby, the voltage of the signal line S is set in a voltage substantially equal to the voltage of the input video signal Vin.

That is, in the twelfth embodiment, since the input video signal Vin is supplied to the signal line after the differential voltage between the threshold voltage of the logic circuit 113 and the voltage of the input video signal is held in the capacitor C101, the voltage of the signal line S is not influenced from variation, if any, in threshold voltage of the transistor forming the logic circuit.

Thirteenth Embodiment

Since the logic circuit 113 shown in FIG. 22 is made up of a combination of transistors, there is the possibility that the circuit does normally operate due to changes in output level of the logic circuit 113 caused by varieties in threshold value and mobility of the transistors. Taking it into consideration, the thirteenth embodiment is characterized in specifically showing a threshold voltage setting circuit for setting the node b in the threshold voltage of the logic circuit 113 upon setting the differential voltage between the threshold voltage of the logic circuit 113 and the voltage of the input video signal Vin in the capacitor C101, and canceling variation in characteristics of the logic circuit 113.

Figure 27:
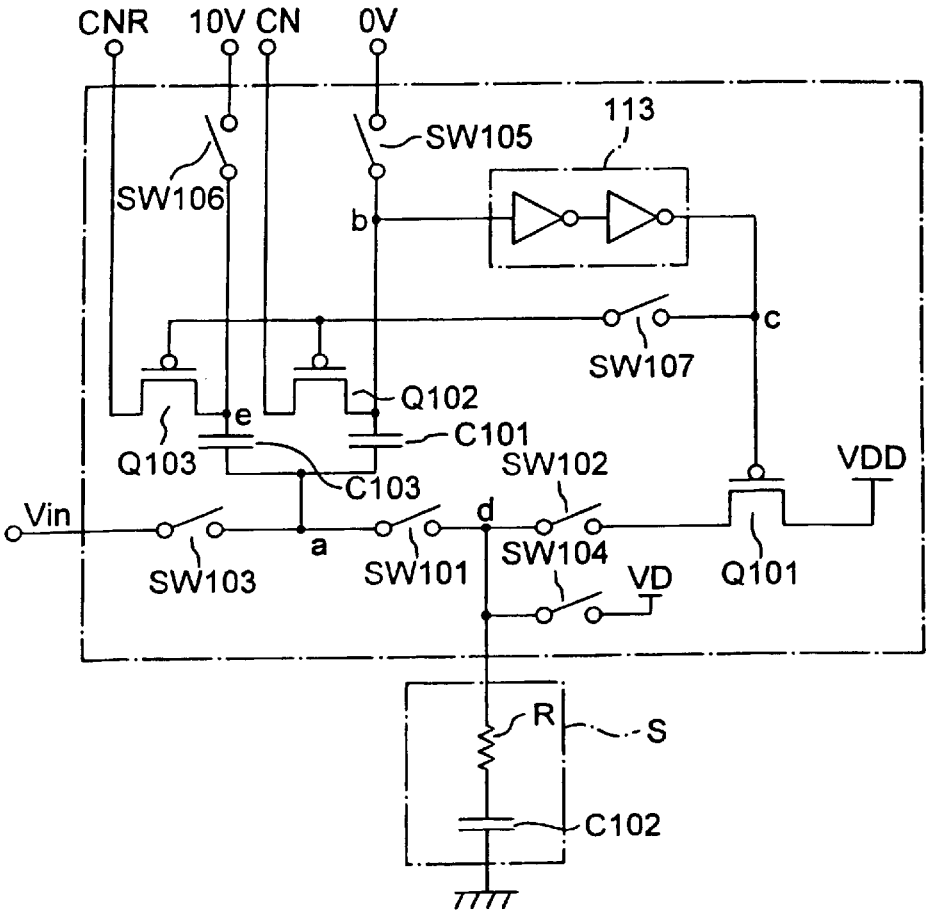
FIG. 27 is a circuit diagram of a load drive circuit as the thirteenth embodiment.

FIG. 27 is a circuit diagram of a load drive circuit according to the thirteenth embodiment, which is used as the signal line drive circuit 3 of a liquid crystal display device similarly to the twelfth embodiment. The load drive circuit of FIG. 27 includes, like that of FIG. 22, switches SW101 to SW104, transistor Q101 which is a PMOS transistor, logic circuit 113 connecting two stages of inverters in serial connection, and capacitor C101. Further, the load drive circuit of FIG. 27 includes a capacitor C103, switches SW105 to SW107, and PMOS transistors Q102, Q103, as well.

Respective ends of capacitors C101, C103 and respective ends of the switches SW101, SW103 are connected to each other. Connected to the other end of the capacitor C101 are the input terminal of the logic circuit 113 and one end of the switch SW105, and the other end of the switch SW105 is set in a third voltage (for example, 0V). Connected to the other end of the capacitor C103 is one end of the switch SW106, and a fourth voltage (for example, 10V) is applied to the other end of the switch SW106.

Connected to the output terminal of the logic circuit 113 are one end of the switch SW107 and gate terminal of the transistor Q101. Connected to the other end of the switch SW107 are gate terminals of the transistors Q102 and Q103. One of source/drain electrodes of the transistor Q102 is connected between the capacitor C101 and the switch SW105, and the other is connected to the cancel terminal CN. One of source/drain electrodes of the transistor A103 is connected between the capacitor C103 and the switch SW106, and the other is connected to the reverse cancel terminal CNR. The cancel terminal CN is applied with a cancel voltage which linearly changes from 0V to 10V in a certain cycle. The reverse cancel terminal CNR is applied with a reverse cancel voltage which linearly changes from 10V to 0V in a certain cycle.

In FIG. 27, nodes of the switches SW101, SW102 and the capacitors C101, C102 are labeled a, node of the capacitor C101 and the logic circuit 113 is labeled b, node of the logic circuit 113 and the transistor Q101 is labeled b, node of the switches SW101 and SW102 is labeled d, and node of the capacitor C103 and the switch SW106 is labeled e.

The capacitor C101 forms the differential voltage hold circuit in this embodiment, the first voltage VDD forms the first voltage supply circuit in this embodiment, and switches SW105 to SW107, transistors Q102, Q103 and capacitor C103 make up the threshold voltage setting circuit in this embodiment.

Figure 28:
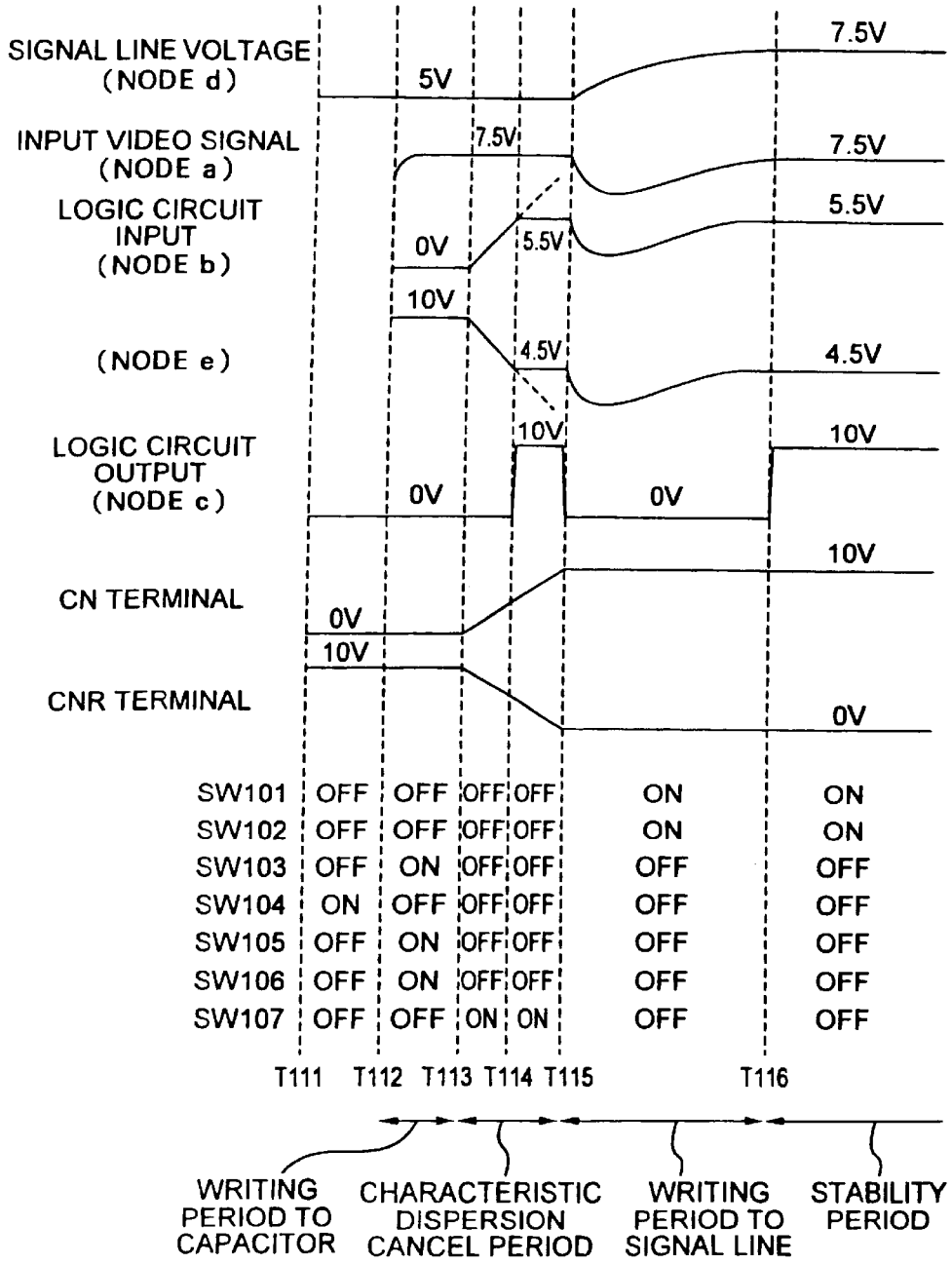
FIG. 28 is a timing chart of operations of different portions of the load drive circuit according to the thirteenth embodiment.

FIG. 28 is a timing diagram of operations in respective portions in the load drive circuit of FIG. 27. Operations of the circuit of FIG. 27 are explained below by using this timing diagram.

First, in the period from time T111 to time T112, the switch control circuit 112 turns the switch SW104 alone ON. As a result, voltage of the signal line S becomes the same voltage as the second voltage VD (for example, 5V).

Next, in the period from time T112 to T113, the switch control circuit 112 turns the switches SW101, SW102, SW104 and SW107 OFF, turns the switches SW103, SW105 and SW106 ON. As a result, voltage at the node a in FIG. 27 becomes the voltage of the input video signal Vin. FIG. 28 shows an example in which the voltage of the input video signal Vin is 7.5V. Since the switch SW101 is OFF, voltage of the signal line (node d in FIG. 27) is kept in 5V. Further, since the switches SW105 and SW106 are ON, the node of the capacitor C101 and the switch SW105 (node b in FIG. 27) becomes 0V, and the node of the capacitor C103 and the switch SW106 (node e in FIG. 27) becomes 10V. Since the switch SW107 is OFF, transistors Q102 and Q103 are both OFF.

Next in the period from time T113 to T115, the switch control circuit 112 turns the switch SW107 alone ON. Additionally, in the period from time T113 to time T115, the cancel terminal CN linearly changes from 0V to 10V, and the reverse cancel terminal CNR linearly changes from 10V to 0V. Setting of voltages at the CN terminal and the CNR terminal is done by the switch control circuit 112 or another circuit block.

At the point of time T113, since the output of the logic circuit 113 exhibits the LOW level, the transistors Q102 and Q103 both turn ON, voltage at the node of the capacitor C101 and the switch SW105 (node b in FIG. 27) gradually rises, and voltage at the node of the capacitor C103 and the switch SW106 (node e in FIG. 27) gradually decreases.

At time T114, voltage at the node b in FIG. 27 exceeds the threshold voltage of the logic circuit 113 (for example, 5.5V), output of the logic circuit 113 becomes the HIGH level (approximately 10V), and the transistors Q101 and the transistors Q102, Q103 turn OFF altogether. Therefore, in the period from time T114 to time T115, voltage at the node b in FIG. 27 becomes the threshold voltage of the logic circuit 113 (for example, 5.5V), and voltage at the node e in FIG. 27 becomes a predetermined voltage (for example, 4.5V).

That is, since the transistors Q102 and Q103 turn OFF at the point of time where the input voltage of the logic circuit 113 surpasses the threshold voltage of the logic circuit 113, voltage at the input terminal of the logic circuit 113 (node b in FIG. 27) is set to be equal to the threshold voltage of the logic circuit 113. At that time, since the node a in FIG. 27 is set in 7.5V, which is the voltage of the input video signal Vin, the capacitor C101 holds the differential voltage (2V) between the voltage of the input signal Vin (7.5V) and the threshold voltage of the logic circuit 113 (5.5V).

At the next time T115, the switch control circuit 112 turns the switch SW101 and SW102 ON and turns the switches SW103 to SW107 OFF. At the point of time T115, voltage of the signal line S is 5V, and voltage at the node a in FIG. 27 is 7.5V. Therefore, voltage at the node a in FIG. 27 decreases under influences from the voltage of the signal line S. Since the capacitor C101 holds the differential voltage (2V) as mentioned above, voltage at the input terminal of the logic circuit 113 (node b in FIG. 27) also decreases following the decrease of the voltage at the node a in FIG. 27. The voltage at the node b in FIG. 27 eventually decreases below the threshold voltage of the logic circuit 113, and output of the logic circuit 113 becomes the LOW level (about 0V). Therefore, the transistor Q101 turns ON, voltage of the signal line S (node d in FIG. 27) increases, and voltages at the nodes a, b and the c also increase responsively. During this series of operations, the capacitor C101 maintains the differential voltage (2V).

Next, at time T116, voltages of the signal line S and the node a become 7.5V equal to the voltage of the input video signal Vin. At that time, since the capacitor C101 holds the differential voltage (2V), voltage at the input terminal of the logic circuit 113 (node b in FIG. 27) becomes the threshold voltage, 5.5V. Therefore, output terminal of the logic circuit 113 becomes the HIGH level (about 10V). As a result, the transistor Q101 turns OFF, and the voltage of the signal line (node d in FIG. 27) gradually decreases due to discharge of the capacitor C102. However, when it decreases to a certain degree, the transistor Q101 again turns ON, and the voltage of the signal line S increases again.

In this manner, by repeating these operations while the capacitor C101 holds the differential voltage (2V), the signal line S (node d in FIG. 27) is maintained in the voltage of the input video signal Vin (about 7.5V).

Figure 29:
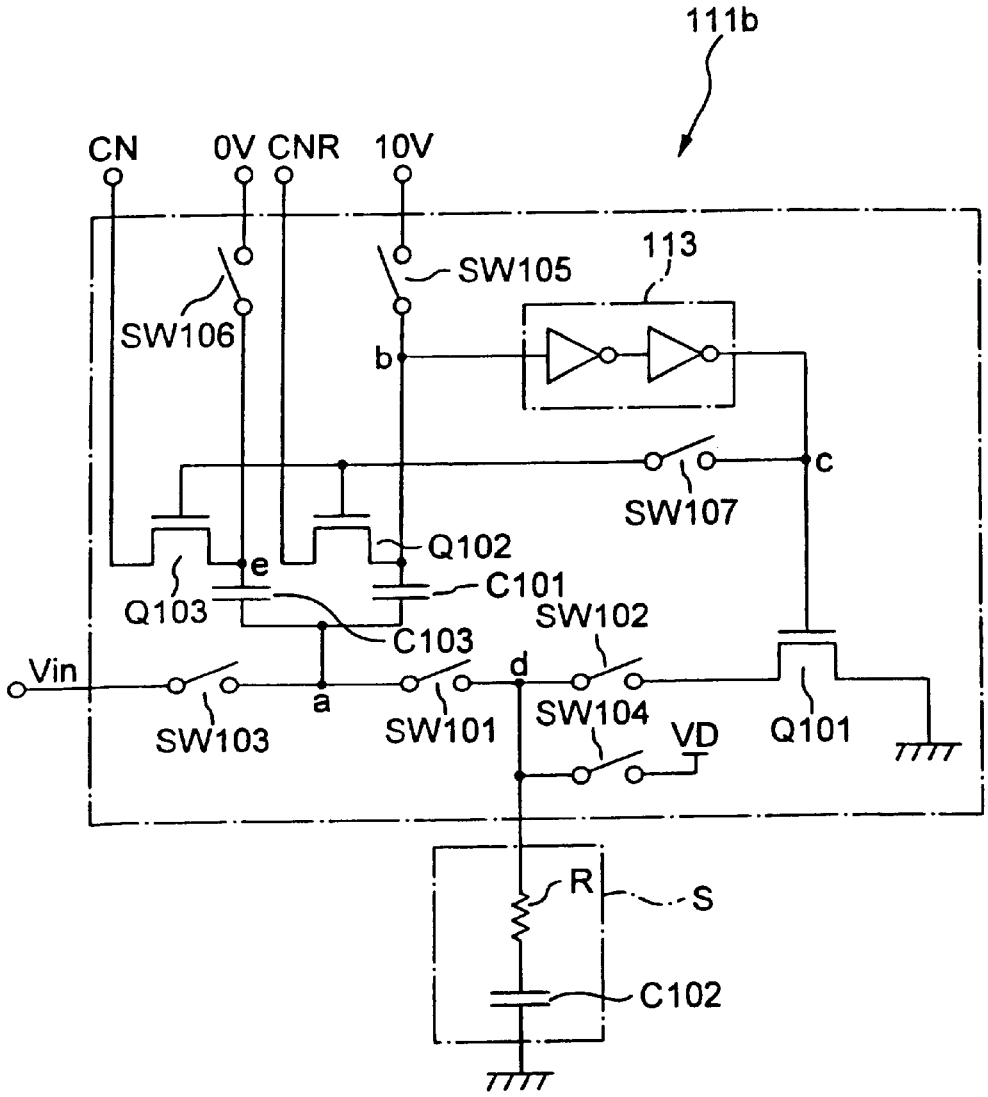
FIG. 29 is a circuit diagram showing detailed structure of a negative polarity load drive circuit in the thirteenth embodiment.

Shown in FIG. 29 is a circuit diagram of the negative polarity load drive circuit 111*b*. The negative polarity load drive circuit 111*b* is a buffer circuit which drives the signal S in the range of 0V to 5V. For this purpose, the transistor Q101 is an n-type MOS transistor whose source terminal is connected to ground, and the transistor Q102 and Q103 are also replaced by n-type MOS transistors. Further, the switch SW105 is connected to the 10V voltage terminal, and the switch SW106 is connected to the 0V voltage terminal. Source terminal of the transistor Q102 is connected to the reverse cancel terminal CNR, and drain terminal of the transistor Q103 is connected to the cancel terminal CN. In the other respects, its structure and operations are the same as those of the positive polarity load drive circuit 111*a*, and their detailed explanation is omitted here.

As explained above, since the circuit of FIG. 27 uses two capacitors C101 and C103, which discharge in the opposite directions, to turn the transistors Q102 and Q103 OFF when the input terminal of the logic circuit 113 (node b in FIG. 27) becomes the threshold value, the node b in FIG. 27 can be set in the threshold voltage of the logic circuit 113. Therefore, even when the threshold voltage of the logic circuit 113 varies, it is ensured to hold the differential voltage between the threshold voltage of the logic circuit and the voltage of the input video signal Vin in the capacitor C101.

Therefore, on and after the time T115 in FIG. 28, control can be made to lower the voltage of the signal line by turning the transistor Q101 OFF when the voltage of the signal line S surpasses the voltage of the input video signal Vin, and to raise the voltage of the signal line S by turning the transistor Q101 ON when the voltage of the signal line S decreases below the voltage of the input video signal Vin, and the voltage of the signal line S can be set in a voltage approximately equal to the voltage of the input video signal Vin.

Figure 30:
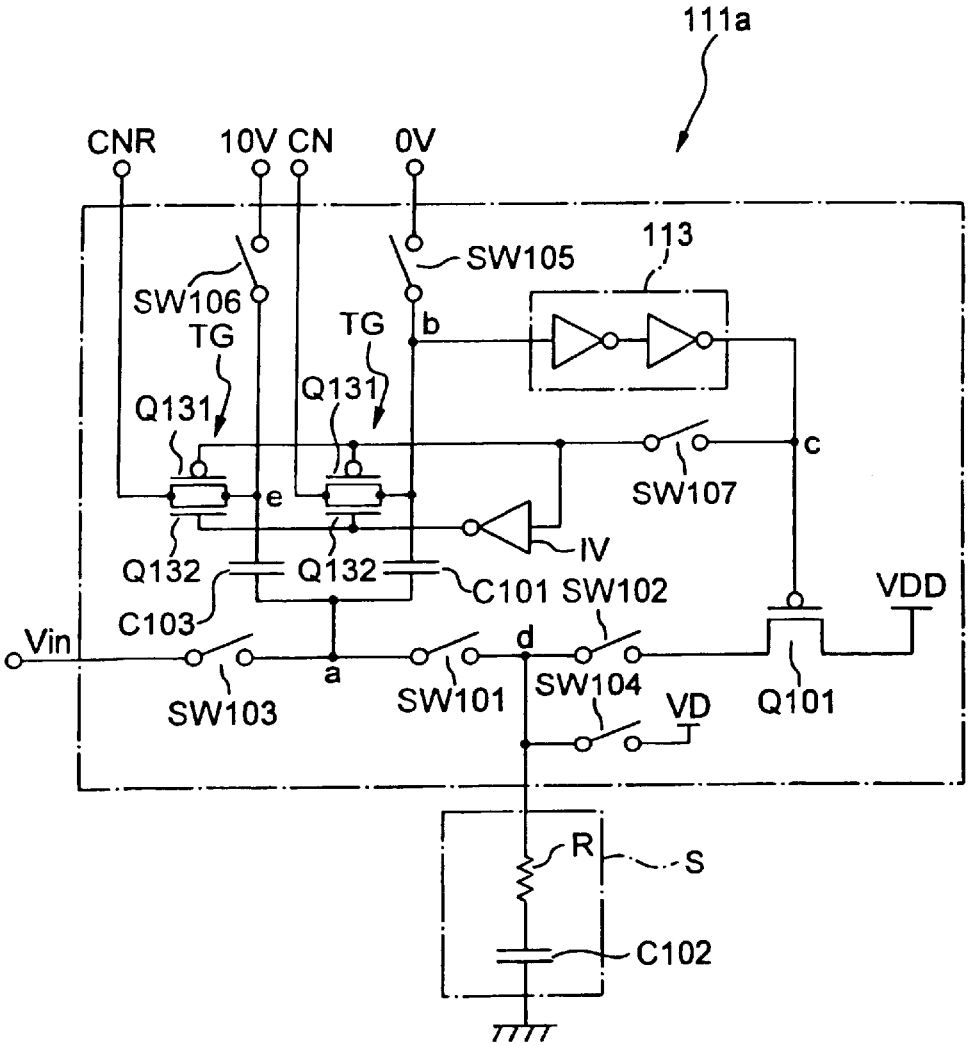
FIG. 30 is a circuit diagram showing a modification of a positive polarity load drive circuit in the thirteenth embodiment.
Figure 31:
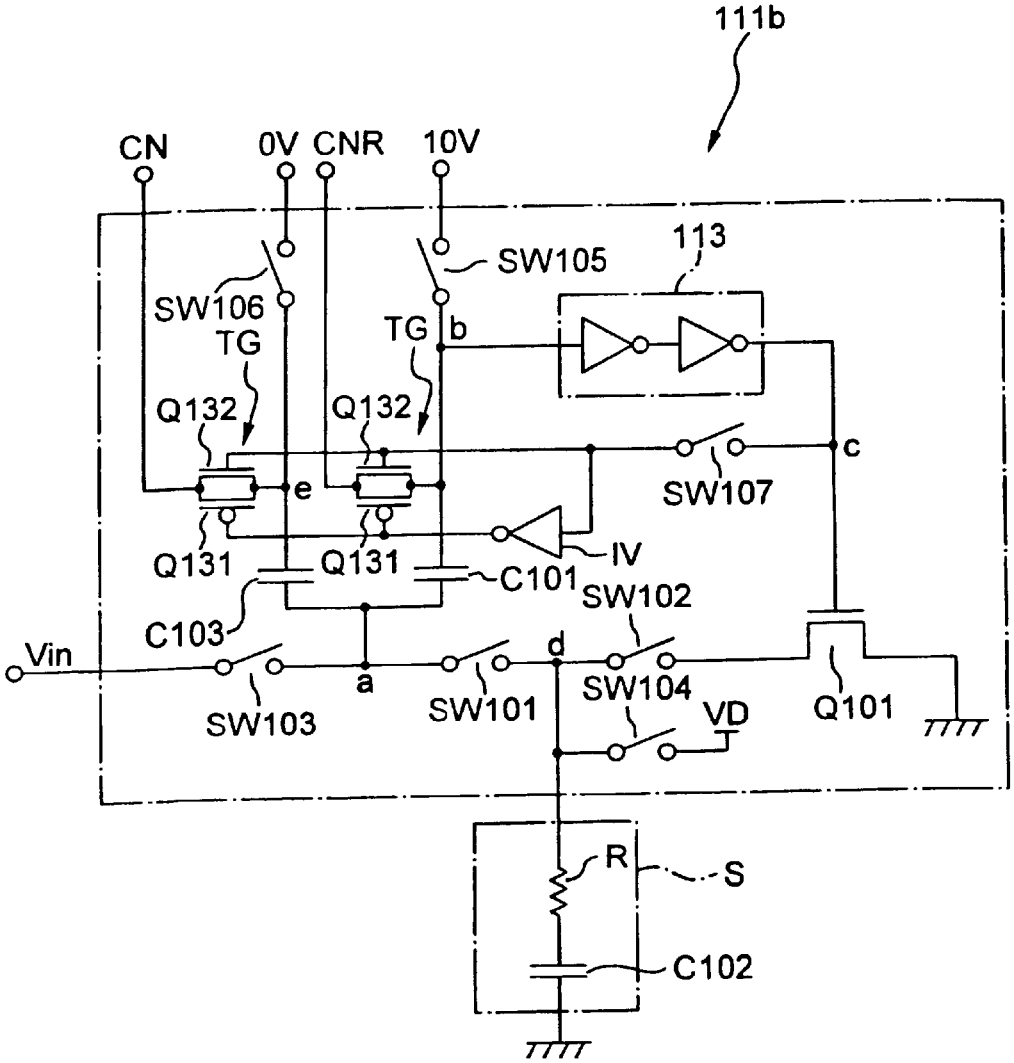
FIG. 31 is a circuit diagram showing a modification of the negative polarity load drive circuit in the thirteenth embodiment.

The transistors Q102 and Q103 used in this embodiment can be made up of a transfer gate TG. FIG. 30 is a circuit diagram of the positive polarity load drive circuit 111*a* replacing the transistors Q102 and Q103 by a-transfer gate TG, and FIG. 31 is a circuit diagram of the negative polarity load drive circuit 111*b* replacing the transistors Q102 and Q103 by a transfer gate TG. As shown in FIGS. 30 and 31, the transfer gate TG may be made up of a p-type MOS transistor Q131 and an n-type MOS transistor Q132, with the gate terminal of the p-type MOS transistor Q131 being connected to the switch SW107 via an inverter IV.

Fourteenth Embodiment

The fourteenth embodiment is a simplified version of the circuit according to the thirteenth embodiment (FIG. 27).

Figure 32:
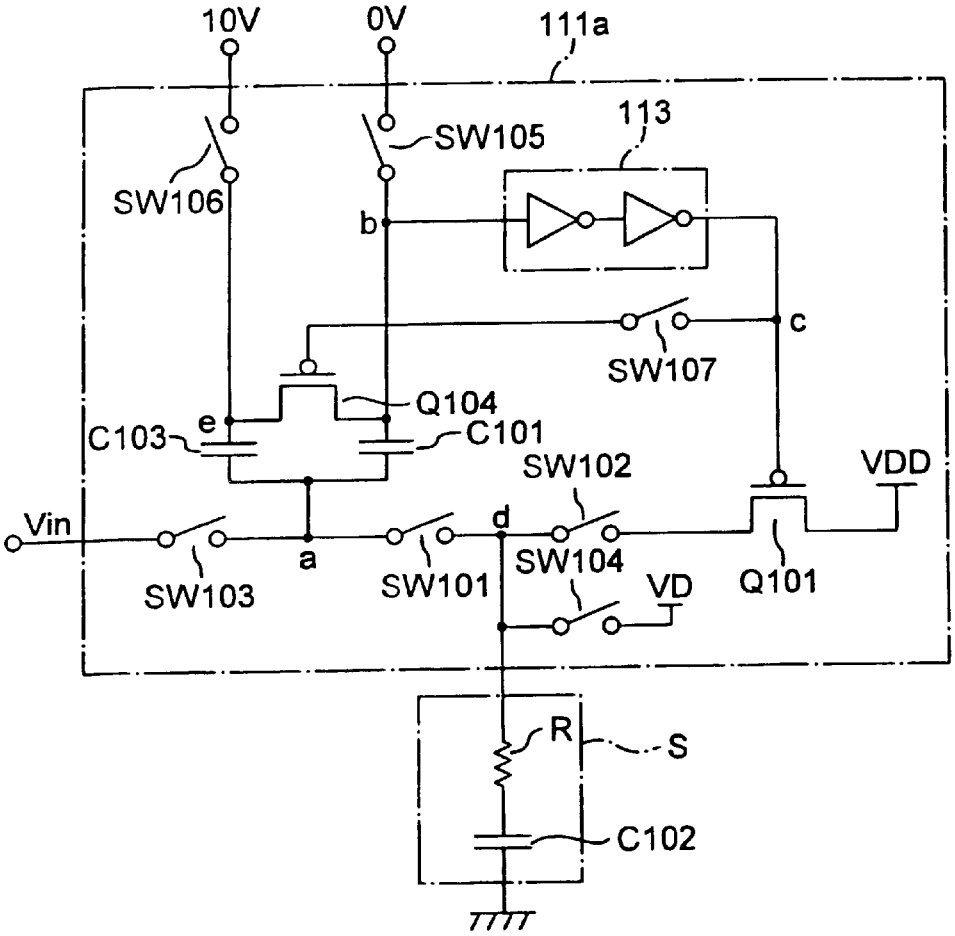
FIG. 32 is a circuit diagram of a load drive circuit as the fourteenth embodiment.

FIG. 32 is a circuit diagram of a load drive circuit according to the fourteenth embodiment, which is used as the signal line drive circuit 3 in a liquid crystal display device as shown in FIG. 4, for example, similarly to the twelfth and thirteenth embodiments.

The circuit of FIG. 32 is characterized in the use of the transistor Q104 in lieu of the transistors Q102 and Q103 in the circuit of FIG. 27. One of source/drain electrodes of the transistor Q104 is connected between the capacitor C101 and the switch SW105, and the other is connected between the capacitor C103 and the switch SW106. Gate terminal of the transistor Q104 is connected to one end of the switch SW107.

In FIG. 32, nodes of the switches SW101, SW103 and the capacitors C101, C103 are labeled a, node of the capacitor C101 and the logic circuit 113 is labeled b, node of the logic circuit 113 and the transistor Q101 is labeled c, node of the switches SW101 and SW102 is labeled d, and node of the capacitor C103 and the switch SW106 is labeled e.

The capacitor C101 forms the differential voltage hold circuit in this embodiment, the first voltage VDD forms the first voltage supply circuit in this embodiment, and switches SW105 to SW107, transistor Q104 and capacitor C103 make up the threshold voltage setting circuit in this embodiment.

Figure 33:
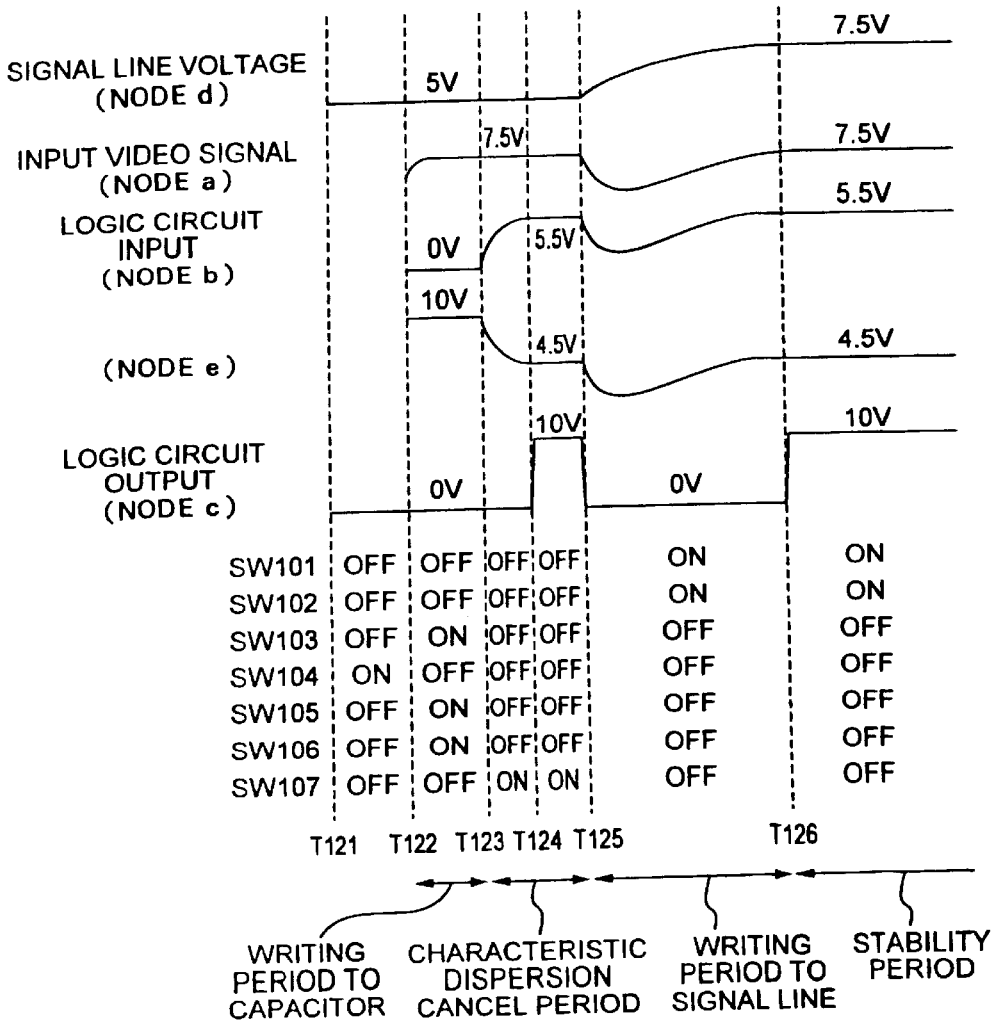
FIG. 33 is a timing chart of operations of different portions in the load drive circuit according to the fourteenth embodiment.

FIG. 33 is a timing diagram of operations of respective portions in the load drive circuit of FIG. 32. Operations of the circuit of FIG. 32 are explained below by using the timing diagram.

First, in the period from time T121 to T122, the switch control circuit 112 turns the switch SW104 alone ON. As a result, voltage of the signal line S becomes the same voltage as the second voltage VD (for example, 5V).

Next, in the period from time T122 to T123, the switch control circuit 112 turns the switches SW101, SW102, SW104 and SW107 OFF, and turns the switches SW103, SW105 and SW106 ON. As a result, voltage at the node a in FIG. 32 becomes the voltage of the input video signal Vin (for example, 7.5V). In this period, since the switch SW101 is OFF, voltage of the signal line S (node d in FIG. 32) maintains 5V. Additionally, since the switches SW105 and SW106 are ON, the node b in FIG. 32 becomes 0V, and the node e becomes 10V. Since the switch SW7 is OFF, the transistor Q104 turns OFF.

Next, in the period from time T123 to T125, the switch control circuit 112 turns the switch SW107 alone ON. At that time, since the transistor Q104 is ON, the node b and the node e in FIG. 32 are short-circuited, and both voltages move toward meeting with each other. Namely, the voltage at the node b gradually increases from 0V, and the voltage at the node e gradually decreases from 10V.

At time T 124, voltage at the input terminal of the logic circuit 113 (node b in FIG. 32) surpasses the threshold voltage of the logic circuit 113, and the output voltage of the logic circuit 113 changes to the HIGH level (for example, 10V). As a result, the transistor Q104 turns OFF, and the voltage at the node b does not rise any more. Accordingly, voltage at the input terminal of the logic circuit 113 (node b in FIG. 32) becomes substantially equal to the threshold voltage of the logic circuit 113. At that time, since the node a in FIG. 32 is maintained in the voltage of the input video signal Vin, 7.5V, held in the capacitor C101 is the differential voltage (2V) of the input voltage (7.5V) and the threshold voltage of the logic circuit 113 (5.5V).

Next, at time T125, the switch control circuit 112 turns the switches SW101 and SW102 ON and turns the switches SW103 to SW107 OFF. As a result, voltages at nodes d and a in FIG. 32 decrease, and since the capacitor C101 hold the differential voltage (2V), voltage at the node b also decreases. Therefore, output of the logic circuit 113 becomes the LOW level (for example, 0V), transistor Q101 turns ON, and voltage of the signal line S gradually increases. After that, since the voltage at the node b also increases with the increase in voltage of the signal line S, at time T126, voltage at the node b surpasses the threshold voltage of the logic circuit 113, and the output of the logic circuit 113 inverts to the HIGH level (for example, 10V). As a result, the transistor Q101 turns OFF, and the voltage of the signal line S does not increase any more.

As explained above, since the fourteenth embodiment connects respective ends of the capacitor C101, C103 to source/drain electrodes of the transistor Q104, respectively to control the gate electrode of the transistor Q104 in response to the output voltage of the logic circuit 113, it is possible to control the voltage at the node b and the voltage at the node e in FIG. 32 in an oppositely related manner and to set the voltage at the input terminal of the logic circuit 113 (node b in FIG. 32) to be equal to the threshold voltage of the logic circuit 113, similarly to the thirteenth embodiment. Therefore, using the circuit structure simpler than the thirteenth embodiment, it is ensured that the capacitor C101 hold the differential voltage between the threshold voltage of the logic circuit 113 and the voltage of the input video signal Vin.

Figure 34:
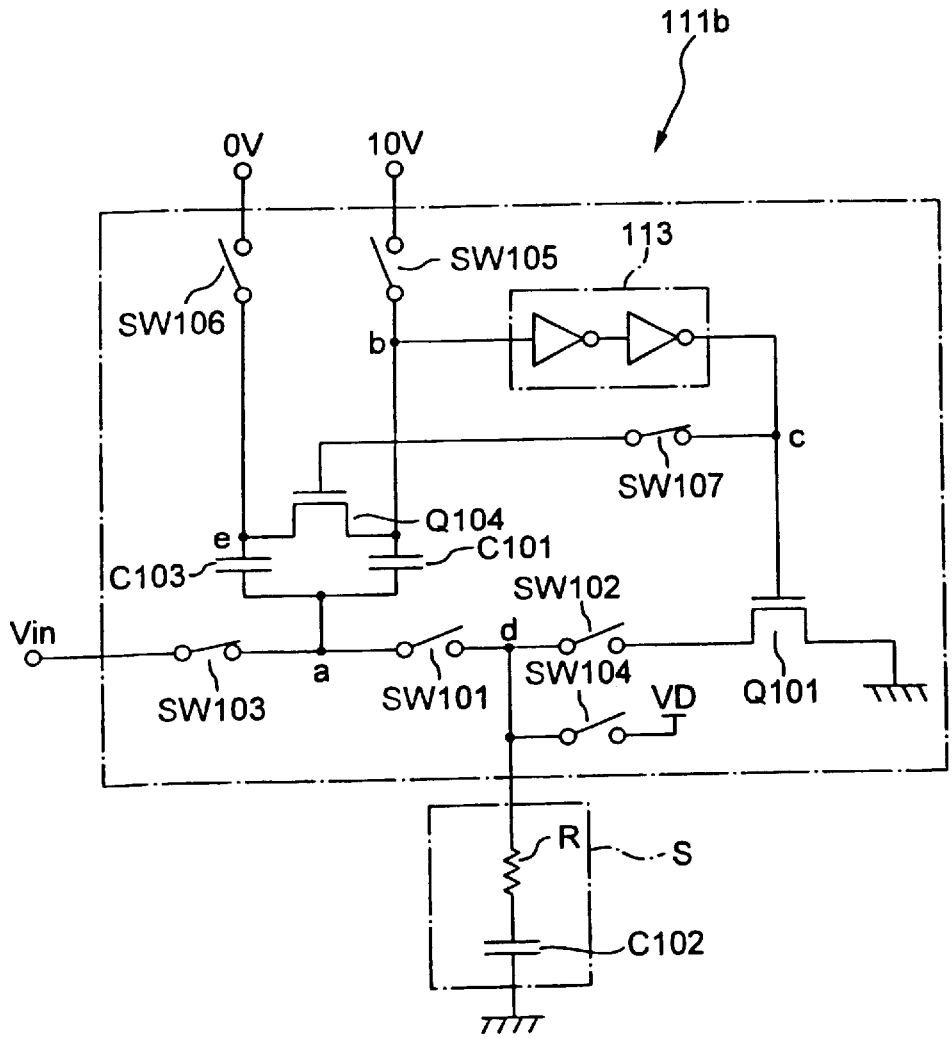
FIG. 34 is a circuit diagram showing detailed structure of a negative polarity load drive circuit in the fourteenth embodiment.

FIG. 34 is a circuit diagram showing detailed structure of the negative polarity load drive circuit 111*b*. As shown in FIG. 34, the load drive circuit 111*b* is different from the load drive circuit 111*a* of FIG. 32 in that the transistors Q101 and Q104 are n-type MOS transistors and that the source electrode of the transistor Q101 is connected to ground, but it is the same in the other respects.

Figure 35:
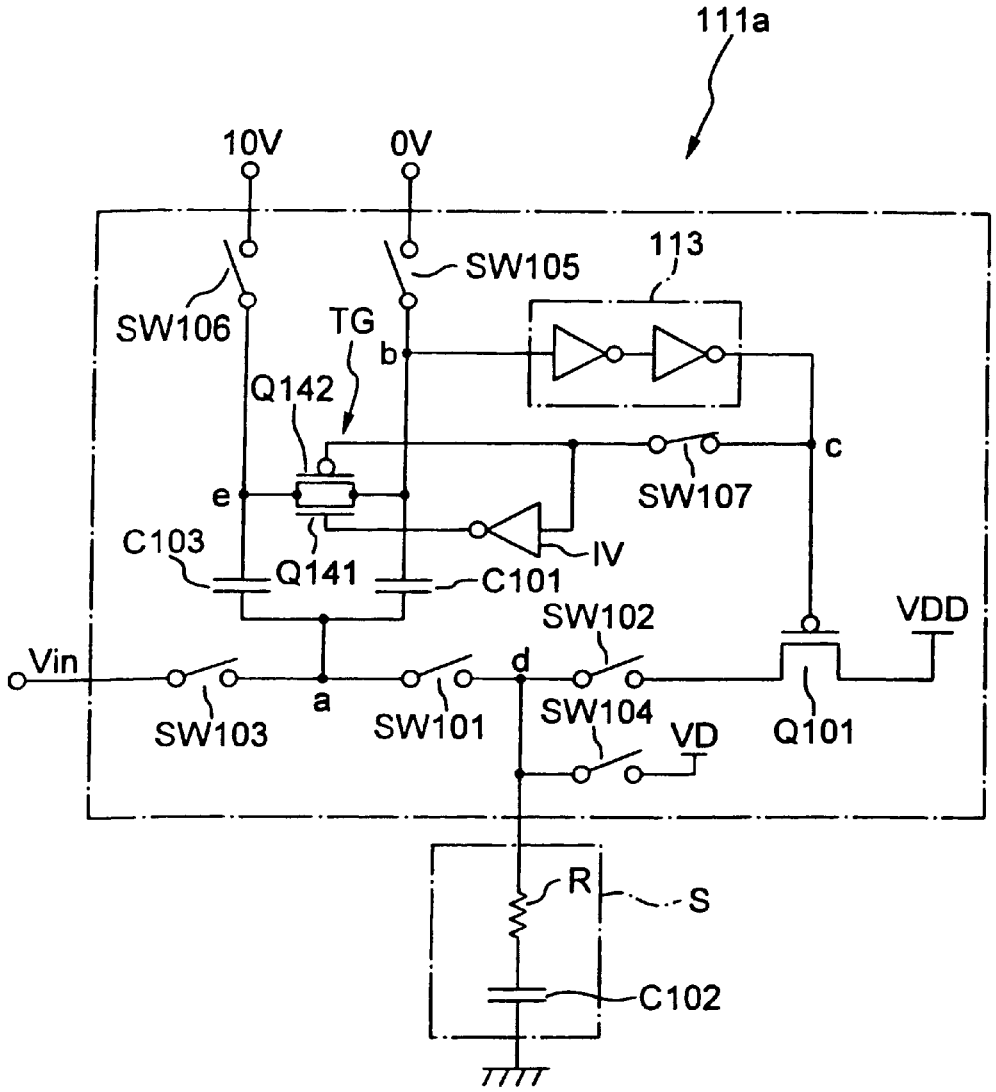
FIG. 35 is a circuit diagram showing a modification of a positive polarity load drive circuit in the fourteenth embodiment.
Figure 36:
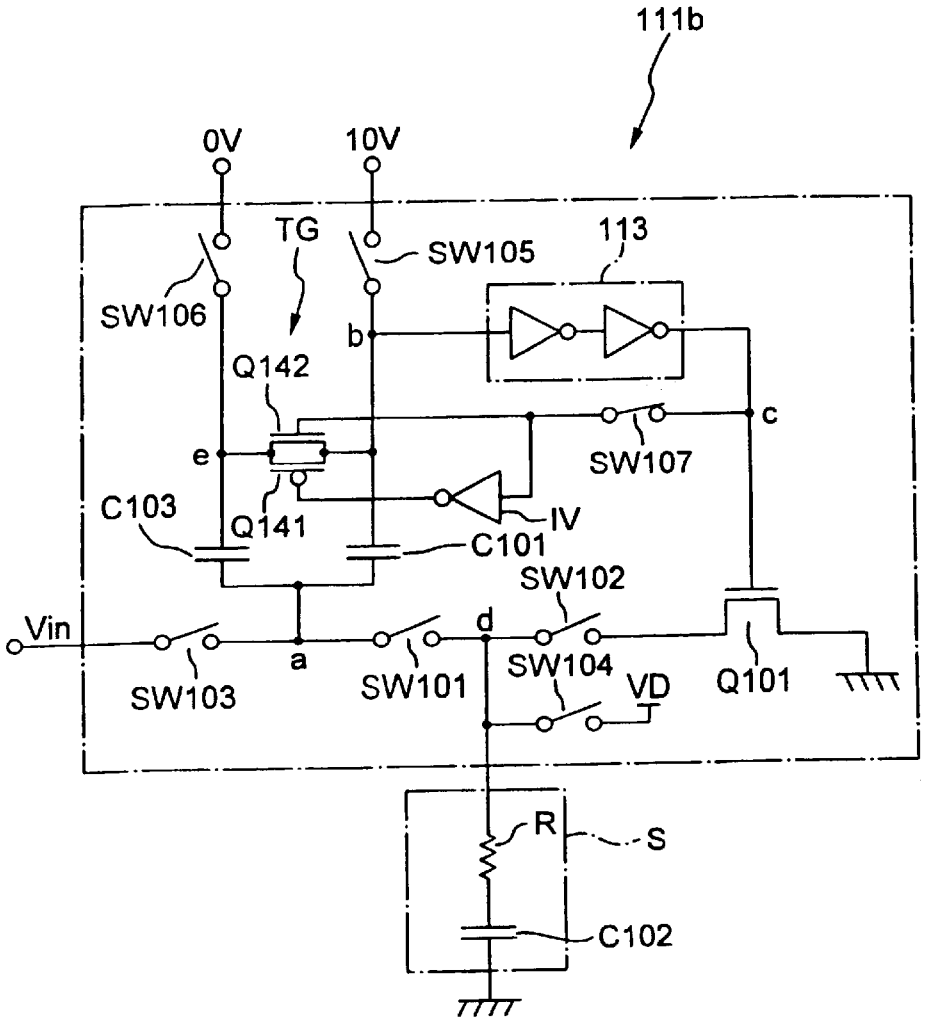
FIG. 36 is a circuit diagram showing a modification of the negative polarity load drive circuit in the fourteenth embodiment.

It is also possible to make up the transistor Q014 in this embodiment of the transfer gate TG. FIG. 35 is a circuit diagram of the positive polarity load drive circuit 111*a* using the transfer gate TG instead of the transistor Q104, and FIG. 36 is circuit diagram of the negative polarity load drive circuit 111*b* using the transfer gate TG in lieu of the transistor Q104. As shown in FIGS. 35 and 36, the transfer gate TG may be made up of a p-type MOS transistor Q141 and an n-type MOS transistor Q142 one of which is connected to the switch SWl07 via an inverter IV.

Fifteenth Embodiment

The load drive circuit according to the fifteenth embodiment is characterized in connecting an additional capacitor to one terminal of the very capacitor nearer to the input video signal and stably holding the terminal in the voltage of the input video signal when having the differential voltage between the voltage of the input video signal and the threshold voltage of the logic circuit held in the capacitor. It is explained below in greater detail.

Figure 37:
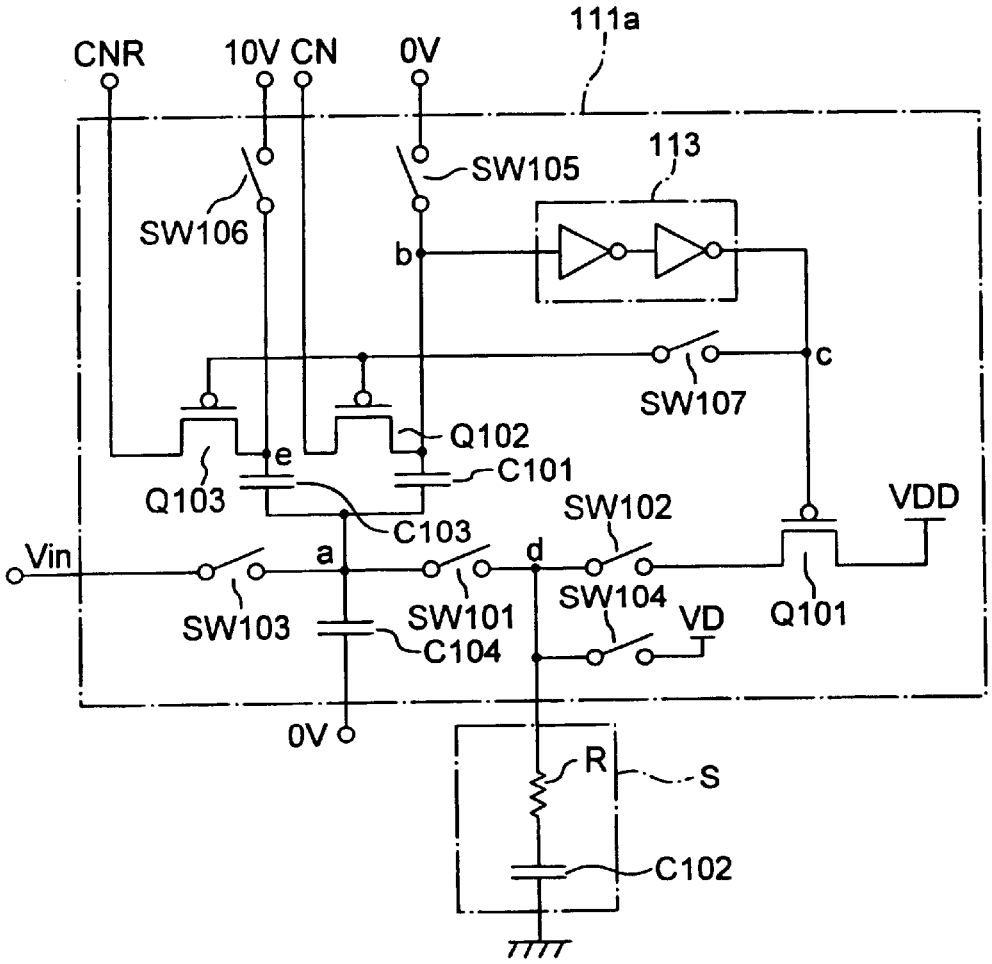
FIG. 37 is a circuit diagram of a load drive circuit as the fifteenth embodiment.

FIG. 37 is a circuit diagram of the positive polarity load drive circuit 111*a*. Each load drive circuit 111*a* includes, as shown in FIG. 37, switches SW101 to SW107, p-type MOS transistors Q101 to Q103 as an analog switch, logic circuit 113 connecting inverters in two stages, and capacitors C101 to C104. These switches SW101 to SW107 are controlled by the switch control circuit 113 shown in FIG. 23.

One end of the switch SW101 and one end of the switch SW102 are connected to the signal line S, and the other end of the switch 101 is connected to one end of the switch SW103 and respective ends of the capacitors C101, C103 and C104. Connected to the other end of the switch SW103 is the input video signal Vin.

The other end of the capacitor C101 is connected to the input terminal of the logic circuit 113, one end of the switch SW105, and the drain terminal of the transistor Q102. Output terminal of the logic circuit 113 is connected to the gate terminal of the transistor Q101 and one end of the switch SW107. Source terminal of the transistor Q101 is applied with the first voltage VDD (for example, 10V), and connected to its drain terminal is the other end of the switch SW102. Signal line S is connected to one end of the switch SW104, and the second voltage VD (for example, 5V) is applied to the other end of the switch SW104.

Source terminal of the transistor Q102 is connected to the cancel terminal CN. This cancel terminal CN is applied with a cancel voltage which linearly changes from 0V to 10V in a certain cycle. The other end of the switch SW105 is set in the third voltage (for example, 0V).

The other end of the capacitor C103 is connected to one end of the switch SW106 and source terminal of the transistor Q103. Drain terminal of the transistor Q103 is connected to the reverse cancel terminal CNR. This reverse cancel terminal CNR is applied with a reverse cancel voltage which linearly changes from 10V to 0V. The other end of the switch SW106 is set in the fourth voltage (for example, 10V). One end of the capacitor C104 is set in the fifth voltage (for example, 0V).

In FIG. 37, nodes of the switches SW101, SW103 and the capacitors C101, C103, C104 are labeled a, node of the capacitor C101 and the logic circuit 113 is b, node of the logic circuit 113 and the transistor Q101 is c, node of the switches SW101 and SW102 is d, and node of the capacitor C103 and switch SW106 is e.

The capacitor C101 forms the differential voltage hold circuit in this embodiment, the first voltage VDD forms the first voltage supply circuit in this embodiment, switches SW105 to SW107 and transistors Q102, Q103 and capacitor C103 make up the threshold voltage setting circuit in this embodiment, and capacitor C104 forms the input voltage hold circuit in this embodiment.

Figure 38:
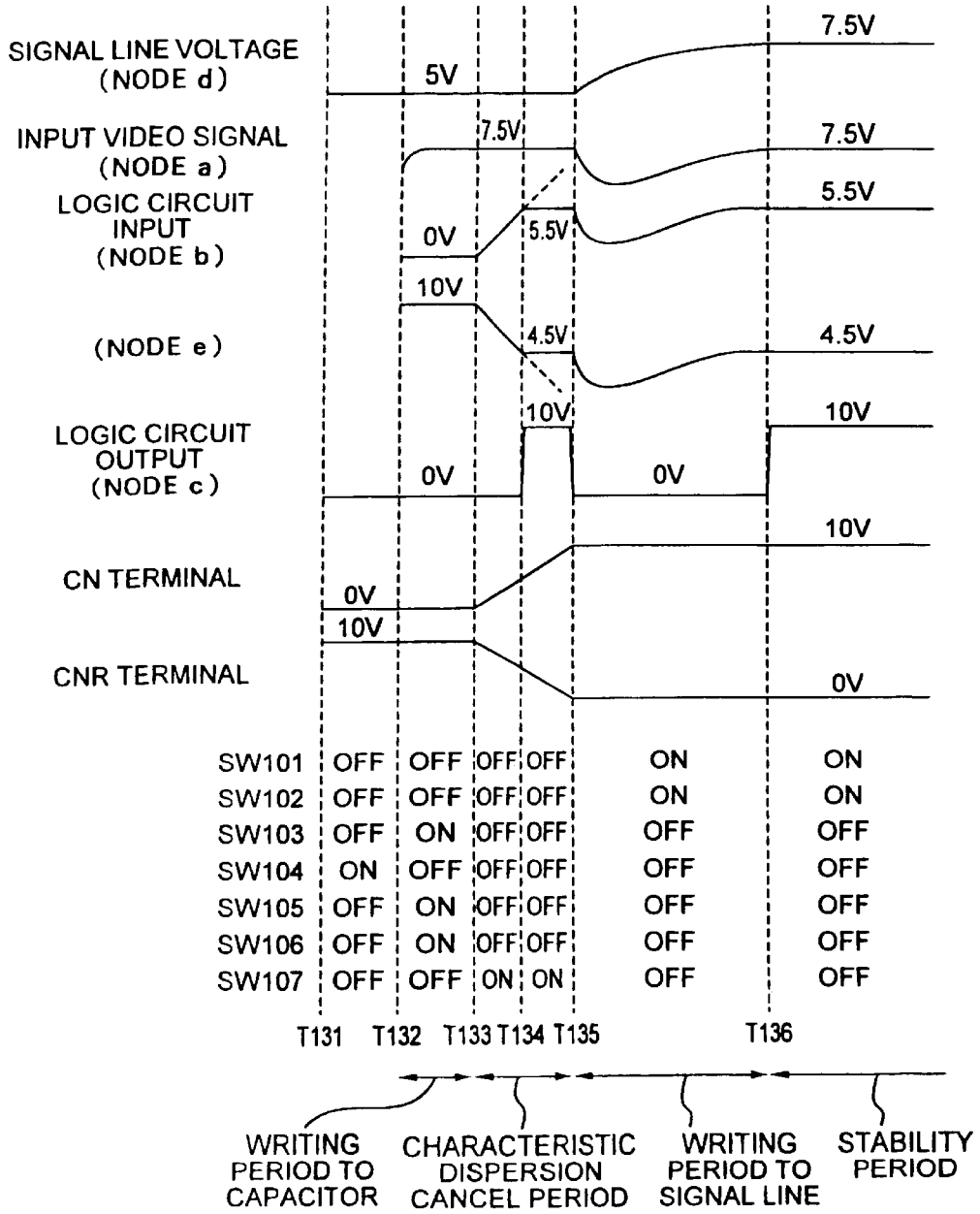
FIG. 38 is a timing chart of operations of different portions in the load drive circuit according to the fifteenth embodiment.

FIG. 38 is a timing diagram of operations of respective portions in the positive polarity load drive circuit 111*a* shown in FIG. 37. Referring to this timing diagram, operations of the load drive circuit 111*a* of FIG. 37 are explained.

First, in the period from time T131 to T132, the switch control circuit 112 turns the switch SW104 alone ON. As a result, voltage of the signal line S becomes the same voltage as the second voltage VD (for example, 5V).

Next, in the period from time T132 to T133, the switch control circuit 112 turns the switches SW101, SW102, SW104, SW107 OFF, and turns the switches SW103, SW105, SW106 ON. As a result, voltage at the node a in FIG. 37 becomes the voltage of the input video signal Vin. FIG. 37 shows an example in which the voltage of the input video signal Vin is 7.5V. As explained above, since the voltage is 7.5V larger than 5V, the positive polarity load drive circuit 111*a* drives the signal line S. Further, since the switch SW101 is OFF, voltage of the signal line (node d in FIG. 37) keeps 5V. Furthermore, since switches SW105 and SW106 ON, node of the capacitor C103 and the switch SW106 (node e in FIG. 37) becomes 10V. Since the switch SW107 is OFF, transistors Q102 and Q103 are both OFF. The capacitor C104 maintains 7.5V which is the voltage of the input signal Vin.

Next, in the period from time T133 to T135, the switch control circuit 112 turns the switch SW107 alone ON. In this period from time T133 to T135, voltage of the cancel terminal CN linearly changes from 0V to 10V, and the reverse cancel terminal CNR linearly changes from 10V to 0V. Setting of voltages of the CN terminal and the CNR terminal is done by the switch control circuit 112 or another circuit block.

At the point of time T133, since the output of the logic circuit 113 is the LOW level, transistors Q102 and Q103 both turns ON, voltage at the node of the capacitor C101 and the switch SW105 (node b in FIG. 37) gradually rises, and voltage at the node (node e in FIG. 37) of the capacitor C103 and the switch SW106 gradually decreases.

At time T134, voltage at the node b in FIG. 37 surpasses the threshold voltage of the logic circuit 113 (for example, 5.5V), output of the logic circuit 113 becomes the HIGH level (about 10V), and transistor Q101 and transistors A102, Q103 turn OFF altogether. Therefore, in the period from time T134 to T135, voltage at the node b in FIG. 37 becomes the threshold voltage of the logic circuit 113 (for example, 5.5V), and the voltage at the node e in FIG. 37 becomes a predetermined voltage (for example, 10V−5.5V=4.5V).

That is, when the input voltage of the logic circuit 113 becomes higher than the threshold voltage of the logic circuit 113, the transistor Q102 turn OFF<and the voltage at the node b in FIG. 37 is set in a voltage equal to the threshold voltage of the logic circuit 113. At that time, the voltage at the node a in FIG. 37 is stably maintained in the voltage of the input video signal Vin, i.e. 7.5V, by the capacitor C104. Therefore, the differential voltage between the threshold voltage of the logic circuit 113 (5.5V) and the voltage of the input video signal Vin (7.5V) is held in the capacitor C101.

Next, at time T135, the switch control circuit 112 turns the switches SW101 and SW102 ON, and turns the switches SW103 to SW107 OFF. At the point of time T135, since the voltage of the signal line S is 5V, and the voltage at the node a in FIG. 37 is 7.5V, voltage at the node a in FIG. 37 decreases due to influences from the voltage of the signal line S. Since the capacitor C101 holds the differential voltage (2V), the voltage at the input terminal of the logic circuit 113 (node b in FIG. 37) also decreases following the decrease in voltage at the node a. Eventually, the voltage at the input terminal of the logic circuit 113 decreases below the threshold voltage of the logic circuit 113, and output of the logic circuit 113 becomes the LOW level (about 0V). As a result, the transistor Q101 turns ON, voltage of the signal line S (node d in FIG. 37) increases, and voltages at the nodes a, b, and e also increase responsively.

Next, at time T136, voltage at the input terminal of the logic circuit 113 (node b in FIG. 37) surpasses the threshold voltage of the logic circuit 113, and output terminal of the logic circuit 113 becomes the HIGH level (about 10V). As a result, transistor Q101 turns OFF, and voltage of the signal line S (node d in FIG. 37) gradually decreases due to discharge of the capacitor C102. However, when it decreases to a certain degree, the voltage at the node d in FIG. 37 decreases below the threshold voltage of the logic circuit 113, and output terminal of the logic circuit 113 again becomes the LOW level (about 0V). Therefore, transistor Q101 again turns ON, and voltage of the signal line increases again. During a series of these operations, the capacitor C101 holds the differential voltage (2V).

After the time T136, by repeating these operations, the signal line S (node d in FIG. 37) is held in the voltage of the input video signal Vin (approximately 7.5V).

Figure 39:
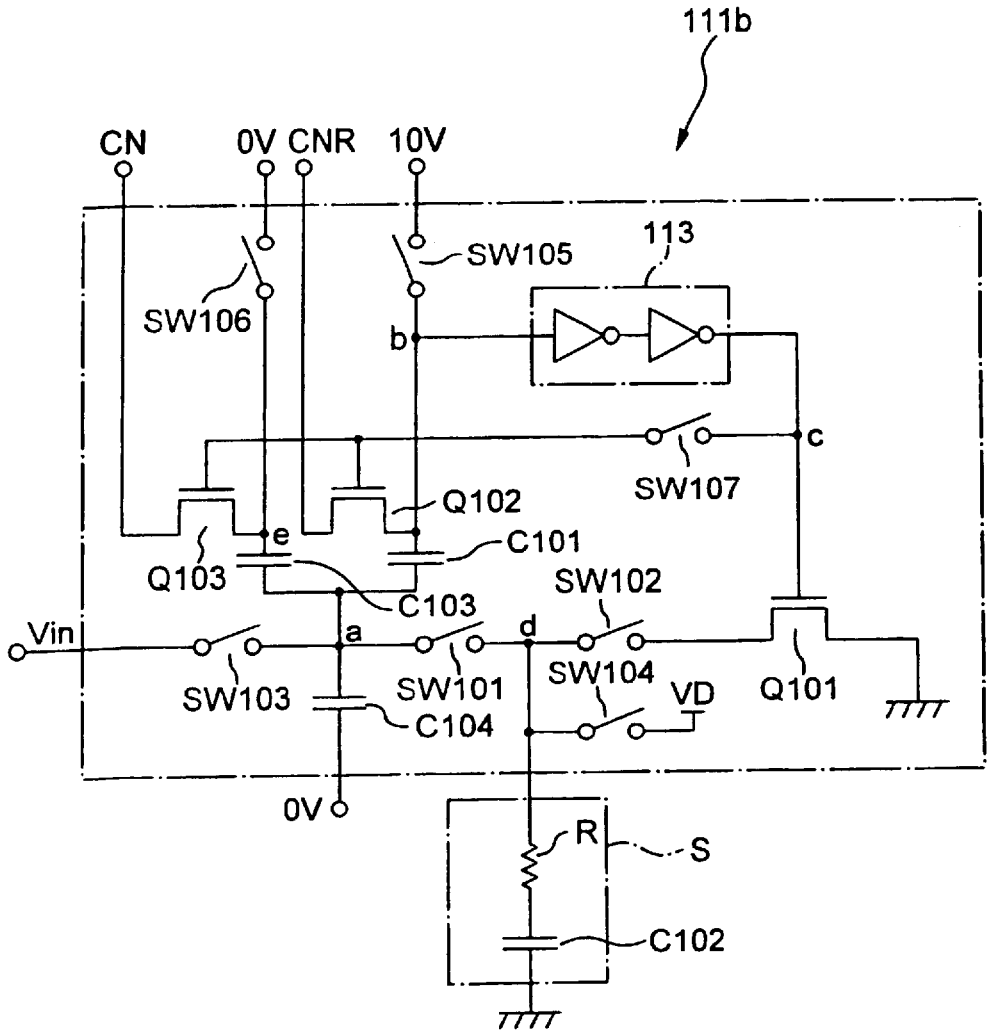
FIG. 39 is a circuit diagram showing detailed structure of a negative polarity load drive circuit in the fifteenth embodiment.

FIG. 39 is a circuit diagram of the negative polarity load drive circuit 111*b*. The negative polarity load drive circuit 111*b* is a buffet circuit which drives the signal line S in the range of 0V to 5V. For this purpose, the transistor Q101 is an n-type MOS transistor whose source terminal is connected to ground, and the transistors Q102 and Q103 are replaced with n-type MOS transistors. The switch SW105 is connected to the 10V voltage terminal, and the switch SW106 is connected to the 0V voltage terminal. Source terminal of the transistor Q102 is connected to the reverse cancel terminal CNR, and drain terminal of the transistor Q103 is connected to the cancel terminal CN. In the other respects, its structure and operations are the same as those of the positive polarity load drive circuit 111*a*, and their detailed description is omitted here.

As explained above, since the load drive circuits 111*a*, 111*b* according to this embodiment are configured to control to decrease the voltage of the signal by turning the transistor Q101 OFF when the voltage of the signal line surpasses the voltage of the input video signal Vin, and increase the voltage of the signal line S by tuning the transistor Q101 ON when he voltage of the signal line decreases below the voltage of the input video signal Vin, it is ensured to set and maintain the voltage of the signal line substantially equal to the voltage of the input video signal Vin.

Additionally, as shown in FIGS. 37 and 38, since they are configured to hold the differential voltage between the voltage of the input video signal Vin and the threshold voltage of the logic circuit 113 in the capacitor C101 in the characteristic dispersion cancel period (from time T133 to T135) and turn the transistor Q101 ON or OFF while maintaining the differential voltage in the capacitor C101, it is ensured to maintain the voltage to be supplied to the signal line S in the stable period (from time T136) in a voltage substantially equal to the voltage of the input video signal Vin even under any variation in the threshold voltage of the logic circuit 113.

Furthermore, as shown in FIGS. 37 and 38, since the capacitor C104 is connected to the node a in FIG. 37, the voltage at the node a in the characteristics dispersion cancel period (from time T133 to T135) can be held stably in the voltage of the input video signal Vin set in the writing period to the capacitor (from time T132 to T133). That is, if the capacitor C104 is not used, the voltage at the node a in FIG. 37 in the characteristic dispersion cancel period (from time T133 to T135) is somewhat variable, depending on the capacities of the transistors Q102, Q103, etc. Therefore, this embodiment connects the capacitor C104 to the node a in FIG. 37 to hold the differential voltage between the voltage of the input video signal Vin and 0V in the writing period to capacitor (from time T132 to T133) and to maintain it also in the characteristic dispersion cancel period (from time T133 to T135), so as to stably maintain the node a in the level of the input video signal Vin.

Figure 40:
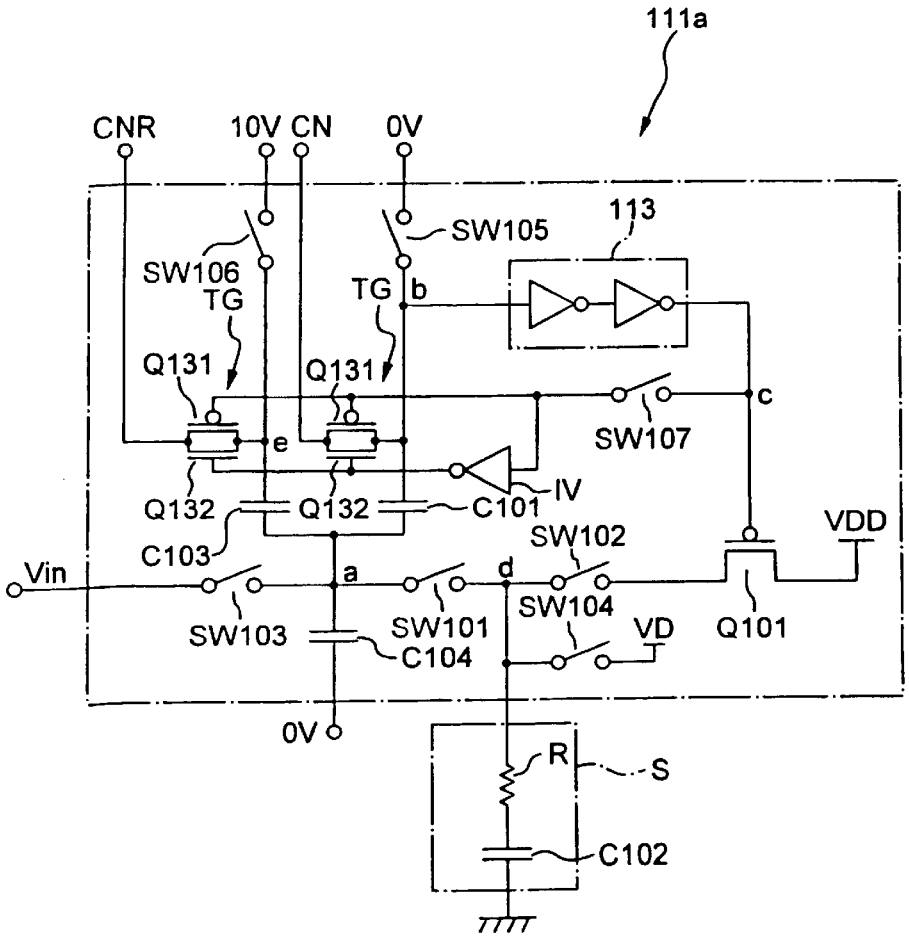
FIG. 40 is a circuit diagram showing a modification of a positive polarity load drive circuit in the fifteenth embodiment.
Figure 41:
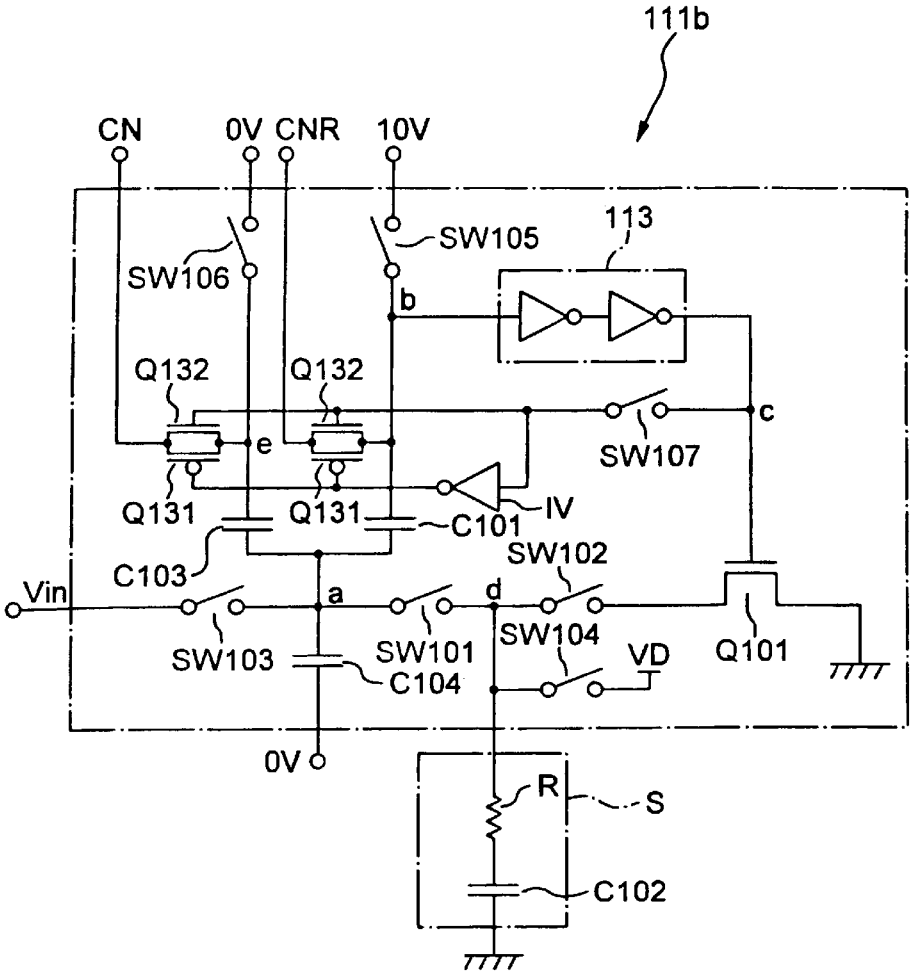
FIG. 41 is a circuit diagram showing a modification of the negative polarity load drive circuit in the fifteenth embodiment.

The transistors Q102 and Q103 in this embodiment can be made up of a transfer gate TG as well. FIG. 40 is a circuit diagram of the positive polarity load drive circuit 111*a* in which the transistors Q102 and Q103 have been replaced by the transfer gate TG, and FIG. 41 is a circuit diagram of the negative polarity load drive circuit 111*b* in which the transistors Q102 and Q103 have been replaced by the transfer gate TG. As shown in FIGS. 40 and 41, the transfer gate TG may be made up of a p-type MOS transistor Q131 and an n-type MOS transistor Q132, with the gate terminal of the p-type MOS transistor Q131 being connected to the switch SW107 via an inverter IV.

Sixteenth Embodiment

The load drive circuit according to the sixteenth embodiment of the invention is a version simplified from the load drive circuit according to the foregoing fifteenth embodiment.

Figure 42:
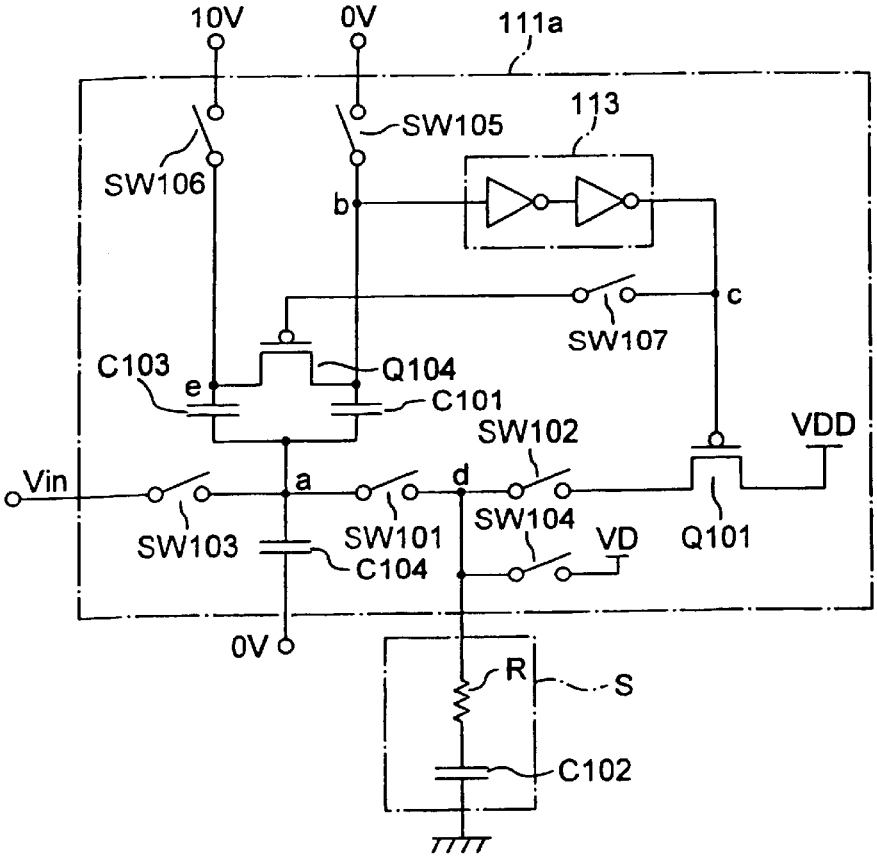
FIG. 42 is a circuit diagram of a load drive circuit as the sixteenth embodiment.

FIG. 42 is a circuit diagram of a load drive circuit according to the sixteenth embodiment, which is used as the signal line drive circuit 3 in a liquid crystal display device as shown in FIG. 4, for example, similarly to the fifteenth embodiment.

The circuit of FIG. 42 is characterized in the use of the transistor Q104 in stead of the transistors Q102 and Q103 in the circuit of FIG. 37. One f source/drain electrodes of the transistor Q104 is connected between the capacitor C101 and the switch SW105, and the other is connected between the capacitor C103 and the switch SW106. Gate terminal of the transistor Q104 is connected to one end of the switch SW107.

In FIG. 42, nodes of the switches SW101, SW103 and the capacitors C101, C103, C104 are labeled a, node of the capacitor C101 and the logic circuit 113 is b, node of the logic circuit 113 and the transistor Q101 is c, node of the switches SW101 and SW102 is d, and node of the capacitor C103 and switch SW106 is e.

The capacitor C101 forms the differential voltage hold circuit in this embodiment, the first voltage VDD forms the first voltage supply circuit in this embodiment, switches SW105 to SW107 and transistor Q104 and capacitor C103 make up the threshold voltage setting circuit in this embodiment, and capacitor C104 forms the input voltage hold circuit in this embodiment.

Figure 43:
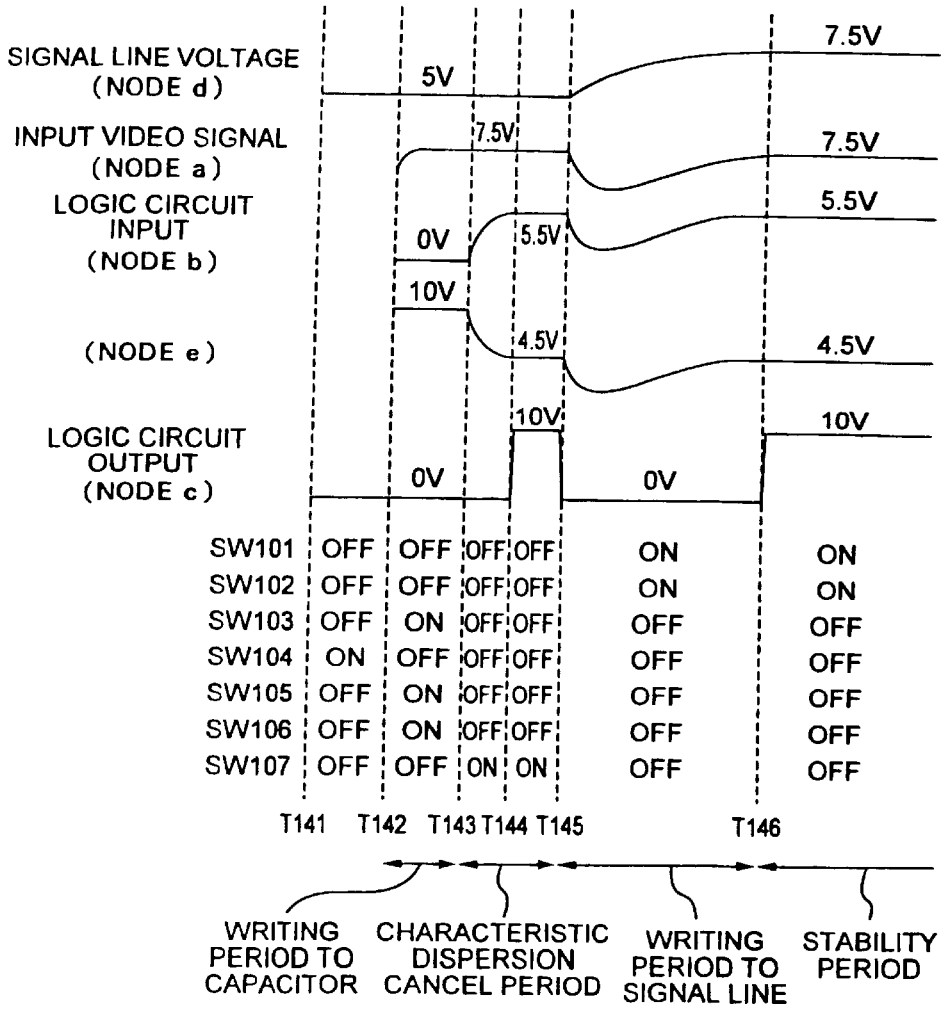
FIG. 43 is a timing chart of operations of different portions in the load drive circuit according to the sixteenth embodiment.

FIG. 43 is a timing diagram of operations of respective portions in the load drive circuit 111*a* shown in FIG. 42. Referring to this timing diagram, operations of the load drive circuit 111*a* of FIG. 42 are explained.

First, in the period from time T141 to T142, the switch control circuit 112 turns the switch SW104 alone ON. As a result, voltage of the signal line S becomes the same voltage as the second voltage VD (for example, 5V).

Next, in the period from time T142 to T143, the switch control circuit 112 turns the switches SW101, SW102, SW104, SW107 OFF, and turns the switches SW103, SW105, SW106 ON. As a result, voltage at the node a in FIG. 42 becomes the voltage of the input video signal Vin (for example, 7.5V). In this period, since the switch SW101 is OFF, voltage of the signal line S (node d in FIG. 42) maintains 5V. Further, since the switches SW105 and SW106 are ON, the node b in FIG. 42 becomes 0V, and the node e becomes 10V. Since the switch SW107 is OFF, the transistor Q104 also turns OFF. The capacitor C104 holds the voltage of the input video signal Vin, namely, 7.5V.

Next, in the period from time T143 to T145, the switch control circuit 112 turns the switch SW107 alone ON. At that time, since the transistor Q104 is ON, node b and e in FIG. 42 are short-circuited, and both voltages move toward meeting with each other. Namely, the voltage at the node b gradually increases from 0V, and the voltage at the node e gradually decreases from 10V.

At time T144, voltage at the input terminal of the logic circuit 113 (node b in FIG. 42) surpasses the threshold voltage of the logic circuit 113, output of the logic circuit 113 becomes the HIGH level (for example, 10V). As a result, the transistor Q104 turns OFF, and the voltage at the node b does not increase any more. Thus, the voltage at the input terminal of the logic circuit 113 (node b in FIG. 42) is set substantially equal to the threshold voltage of the logic circuit 113. At that time, the voltage at the node a in FIG. 42 is maintained in the voltage of the input video signal, 7.5V, by the capacitor C104. Therefore, the differential voltage (for example, 2V) between the threshold voltage of the logic circuit 113 (for example, 5.5V) and the voltage of the input video signal Vin (for example, 7.5V) is held in the capacitor C104.

Next, at time T145, the switch control circuit 112 turns the switches SW101 and SW102 ON, and turns the switches SW103 to SW107 OFF. As a result, while the capacitor C101 holds the differential voltage (2V), voltages at the nodes a and b in FIG. 42 once decrease, the transistor Q101 turns ON, and the voltage of the signal line S gradually rises.

Next, at time T146, voltage at the input terminal of the logic circuit 113 (node b in FIG. 42) surpasses the threshold voltage of the logic circuit 113, and output terminal of the logic circuit 113 becomes the HIGH level (about 10V). As a result, transistor Q101 turns OFF, and voltage of the signal line S (node d in FIG. 42) gradually decreases due to discharge of the capacitor C102. However, when it decreases to a certain degree, the voltage at the node d in FIG. 42 decreases below the threshold voltage of the logic circuit 113, and output terminal of the logic circuit 113 again becomes the LOW level (about 0V). Therefore, transistor Q101 again turns ON, and voltage of the signal line increases again.

After the time T146, by repeating these operations, the signal line S (node d in FIG. 42) is held in the voltage of the input video signal Vin (approximately 7.5V).

Figure 44:
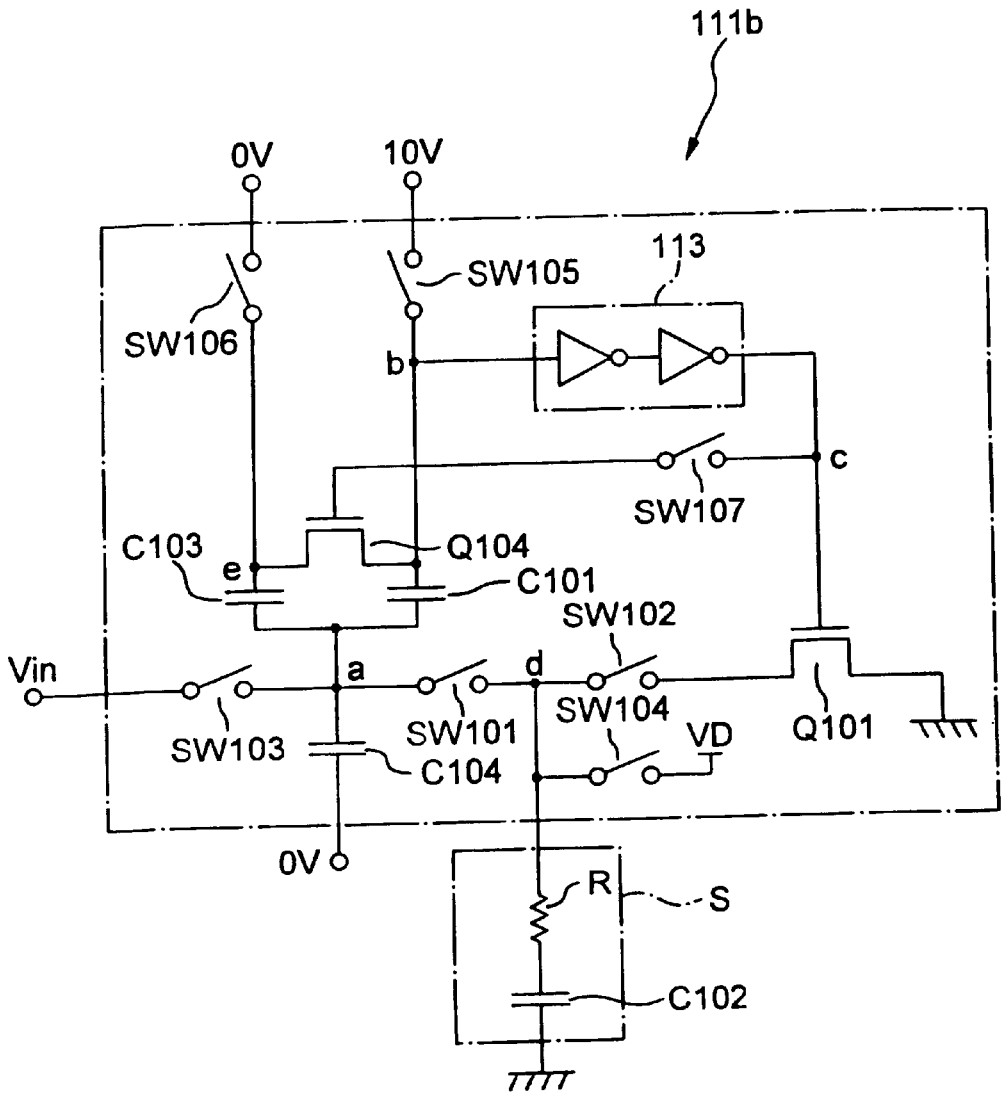
FIG. 44 is a circuit diagram showing detailed structure of a negative polarity load drive circuit in the sixteenth embodiment.

FIG. 44 is a circuit diagram of the negative polarity load drive circuit 111*b*. The negative polarity load drive circuit 111*b* is a buffer circuit which drives the signal line S in the range of 0V to 5V. For this purpose, the transistor Q101 is an n-typeMOS transistor whose source terminal is connected to ground, and the transistor Q104 is replaced with an n-type MOS transistor. The switch SW105 is connected to the 10V voltage terminal, and the switch SW106 is connected to the 0V voltage terminal. In the other respects, its structure and operations are the same as those of the positive polarity load drive circuit 111*a*, and their detailed description is omitted here.

As explained above, since the load drive circuits 111*a*, 111*b* according to this embodiment are configured to control to decrease the voltage of the signal by turning the transistor Q101 OFF when the voltage of the signal line surpasses the voltage of the input video signal Vin, and increase the voltage of the signal line S by tuning the transistor Q101 ON when he voltage of the signal line decreases below the voltage of the input video signal Vin, it is ensured to set and maintain the voltage of the signal line substantially equal to the voltage of the input video signal Vin.

Additionally, as shown in FIGS. 42 and 43, since they are configured to hold the differential voltage between the voltage of the input video signal Vin and the threshold voltage of the logic circuit 113 in the capacitor C101 in the characteristic dispersion cancel period (from time T143 to T145) and turn the transistor Q101 ON or OFF while maintaining the differential voltage in the capacitor C101, it is ensured to maintain the voltage to be supplied to the signal line S in the stable period (from time T146) in a voltage substantially equal to the voltage of the input video signal Vin even under any variation in the threshold voltage of the logic circuit 113.

Furthermore, as shown in FIGS. 42 and 43, since the capacitor C104 is connected to the node a in FIG. 42, the voltage at the node a in the characteristics dispersion cancel period (from time T143 to T145) can be held stably in the voltage of the input video signal Vin set in the writing period to the capacitor (from time T142 to T143). That is, if the capacitor C104 is not used, the voltage at the node a in FIG. 42 in the characteristic dispersion cancel period (from time T143 to T145) is somewhat variable, depending on the capacities of the transistors Q102, Q103, etc. Therefore, this embodiment connects the capacitor C104 to the node a in FIG. 42 to hold the differential voltage between the voltage of the input video signal Vin and 0V in the writing period to capacitor (from time T142 to T143) and to maintain it also in the characteristic dispersion cancel period (from time T143 to T145), so as to stably maintain the node a in the level of the input video signal Vin.

Figure 45:
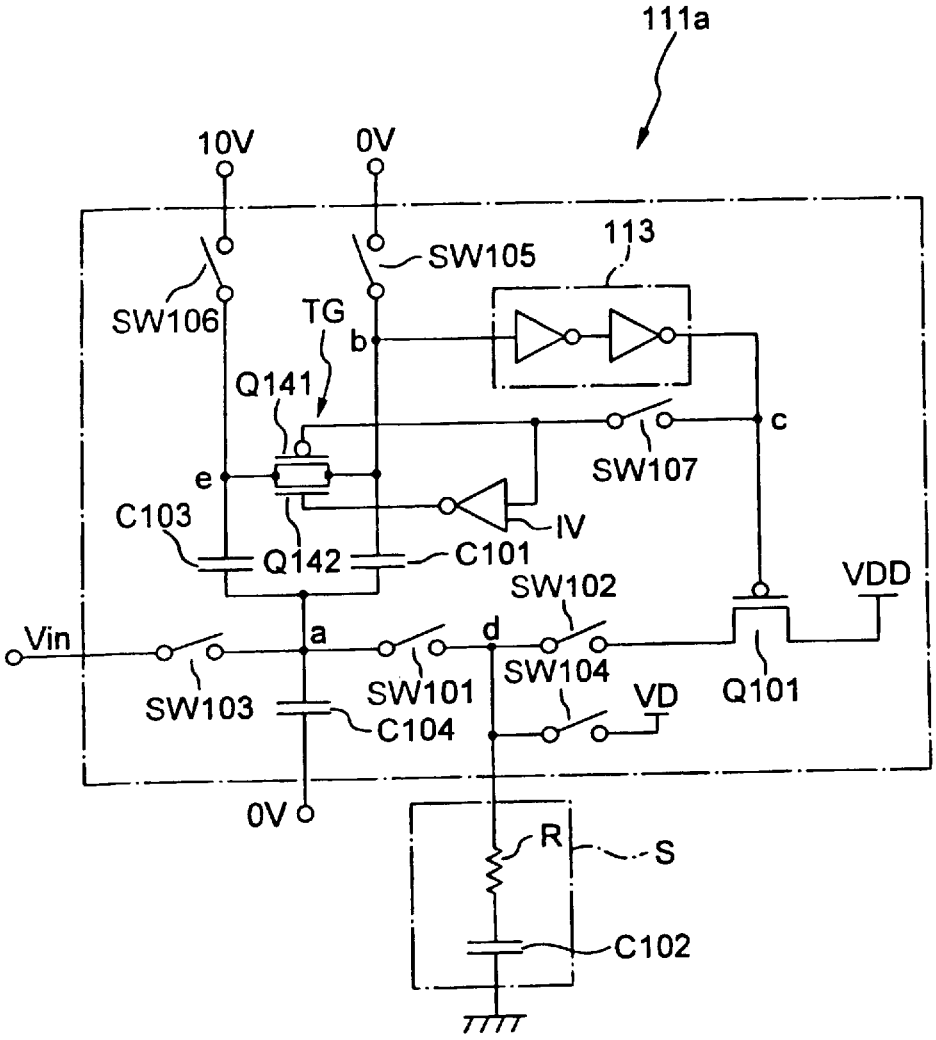
FIG. 45 is a circuit diagram showing a modification of a positive polarity load drive circuit in the sixteenth embodiment.
Figure 46:
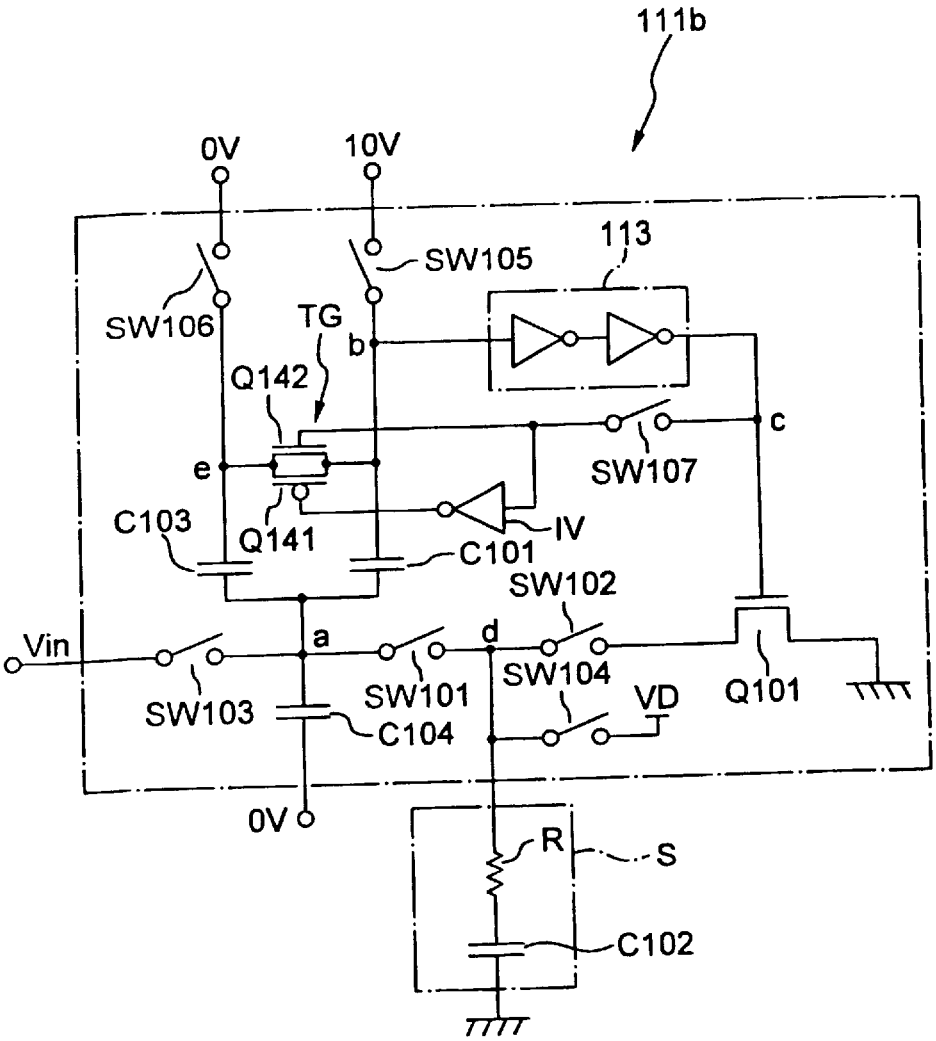
FIG. 46 is a circuit diagram showing a modification of a negative polarity load drive circuit in the sixteenth embodiment.

The transistor Q104 in this embodiment can be made up of a transfer gate TG as well. FIG. 45 is a circuit diagram of the positive polarity load drive circuit 111*a* in which the transistor Q104 has been replaced by the transfer gate TG, and FIG. 46 is a circuit diagram of the negative polarity load drive circuit 111*b* in which the transistor Q104 has been replaced by the transfer gate TG. As shown in FIGS. 45 and 46, the transfer gate TG may be made up of a p-type MOS transistor Q141 and an n-type MOS transistor Q142 one of which is connected to the switch SW107 via an inverter IV The invention is not limited to the foregoing twelfth to sixteenth embodiments, but can be modified in various modes. For example, in the twelfth to sixteenth embodiments, explanation has been made as using the load drive circuit according to the invention in the signal line drive circuit 3 in a liquid crystal display device. However, the invention is employable widely in applications other than the signal line drive circuit 3 as well.

Switches shown in FIG. 22 and others may be made by using transfer gates or analog switches.

In FIG. 22, for example, explanation has been made taking examples in which the logic circuit 113 is made by connecting inverters for inverting and amplifying input signals in two serial stages. However, there is no particular limitation to the interior structure of the logic circuit 113 as far as it can be made by a combination of transistors.

Further, the twelfth to sixteen embodiments improve the accuracy of the voltage set in the signal line S by presetting the signal line S in 5V and increasing the signal line S from 5V to the input video signal Vin when the input video signal Vin is higher than 5V by driving the positive polarity load drive circuit 111*a*, or decreasing the signal line S from 5V when the input signal line Vin is lower than 5V by driving the negative polarity load drive circuit 111*b*. However, it is not always necessary to provide both the positive polarity load drive circuit 111*a* and the negative polarity load drive circuit 111*b*. For example, it is also acceptable to preset the signal line S in 0V and raise the signal line S to the voltage of the input video signal Vin in the range of 0V to 10V only with the positive polarity load drive circuit.

In addition, the twelfth to sixteen embodiments have explained as driving one of the positive polarity load drive circuit 111*a* and the negative polarity load drive circuit 111*b* in FIG. 23, depending upon the voltage. However, both of these load drive circuits 111*a* and 111*b* may be driven simultaneously regardless of the voltage of the input video signal Vin.

As explained above in detail, according to the invention, since an external input signal is supplied to a driven load only after the voltage of the input terminal of the logic circuit is set substantially equal to the threshold voltage of the logic circuit, the voltage supplied to the driven load is not affected even under variation in threshold value of the logic circuit, if any. Therefore, when the invention is applied to a signal line drive circuit of a liquid crystal display device, for example, it is ensured to realize a liquid crystal display device integrally including a drive circuit, which is excellent in display quality free from illuminance irregularity.

Seventeenth Embodiment

The load drive circuit according to the seventeenth embodiment according to the invention is characterized in absorbing variation in threshold value of the logic circuit by means of a capacitor by supplying a voltage to the signal line only after the capacitor holds the differential voltage between the voltage of the input video signal and the threshold voltage of the logic circuit for controlling transistors to supply or stop the voltage to the signal line. Further, the circuit uses a constant current circuit between a transistor and a voltage source to level the voltage change ratio in the signal line upon supplying a voltage to the signal line and thereby ensure the linearity of the load amplifier circuit. It is explained below in greater detail.

Figure 47:
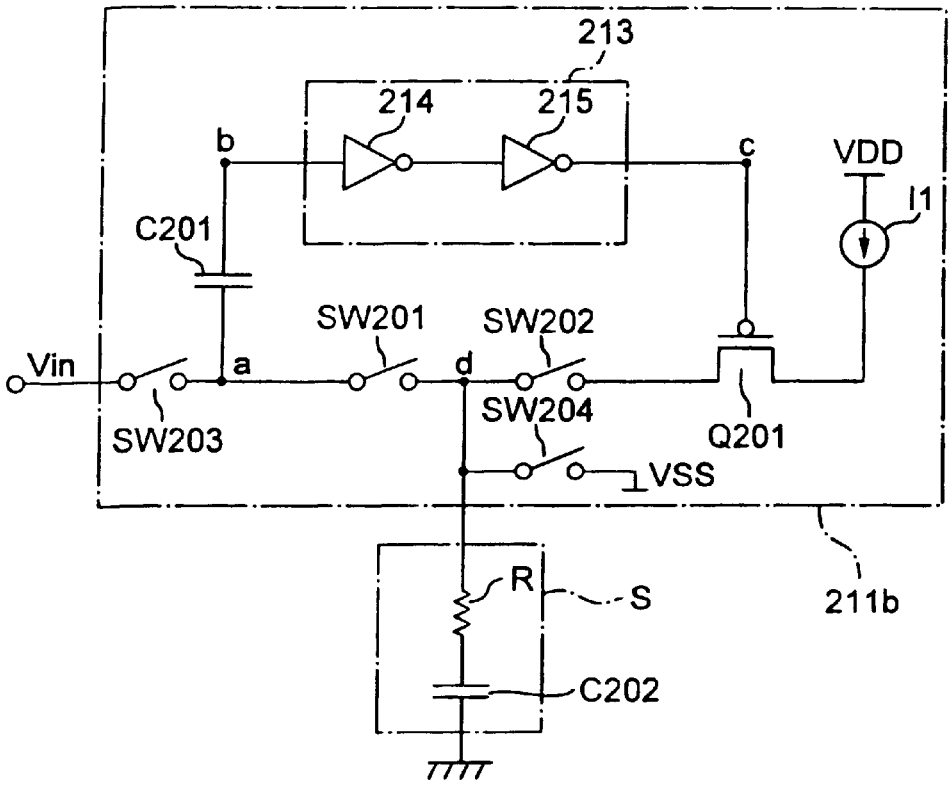
FIG. 47 is a circuit diagram showing structure of a major part of a load drive circuit as the seventeenth embodiment.
Figure 48:
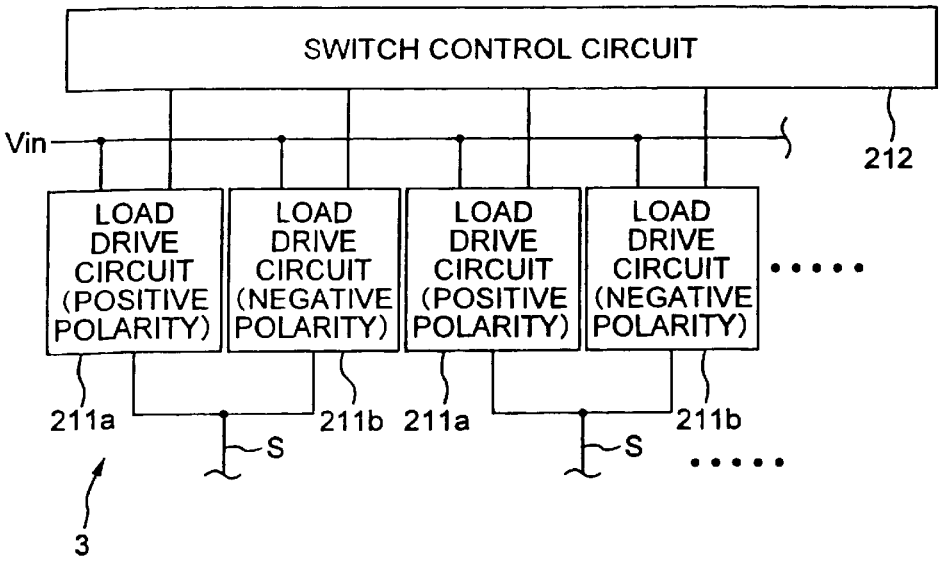
FIG. 48 is a general block diagram showing the entire structure of the load drive circuit.
Figure 49:
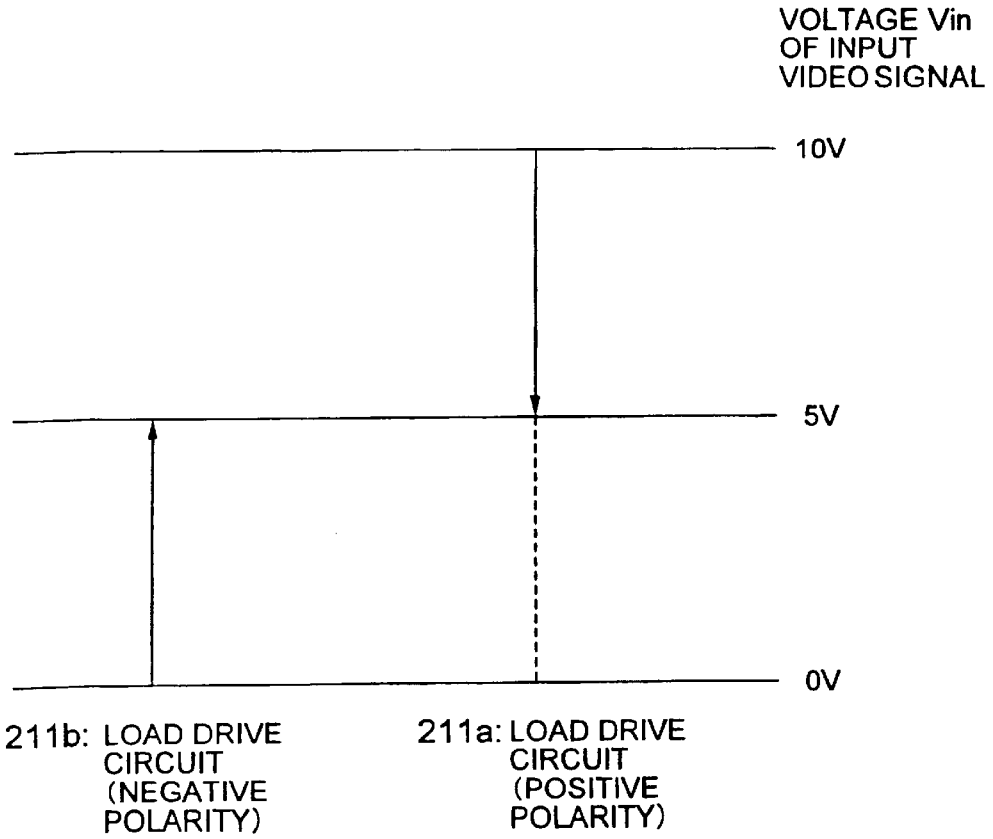
FIG. 49 is a diagram for explaining operative sections of a positive polarity load drive circuit and a negative polarity load drive circuit.

FIG. 47 is a circuit diagram showing structure of a major part of the load drive circuit according to the seventeenth embodiment of the invention, FIG. 48 is a general block diagram showing entire structure of the load drive circuit, and FIG. 49 is a diagram for explaining operation blocks or sections of the positive polarity load drive circuit and the negative polarity load drive circuit.

The signal line drive circuit 3 in FIG. 4 includes the load drive circuit shown in FIG. 48. The load drive circuit of FIG. 48 includes a positive polarity drive circuit 211*a*, negative polarity load drive circuit 211*b*, and switch control circuit 212 for switching and controlling various switches in those load drive circuits 211*a* and 211*b*, which are provided in each signal line.

FIG. 49 is a diagram explaining functional blocks or sections of the positive polarity load drive circuit 211*a* and the negative polarity load drive circuit 211*b*. As shown in FIG. 49, in this embodiment, input video signal Vin is a signal between 0V and 10V, and the input video signal Vin is divided into two, namely, a part of 0V to 5V and the other part of 5V to 10V to drive the positive polarity load drive circuit 211*a* and the negative polarity load drive circuit 111*b*, respectively.

That is, the negative polarity load drive circuit 211*b* is a buffer circuit which functions to preset the signal line S in 0V and raise the voltage of the signal line S to the voltage of the input video signal Vin when the input video signal Vin is in 0V to 5V. The positive polarity load drive circuit 211*a* is a buffer circuit which functions to preset the signal line S in 10V and lower the voltage of the signal line S to the voltage of the input video signal Vin when the input video signal Vin is in 5V to 10V. It is controlled by the switch control circuit 212 which of these load drive circuits 211*a* and 211*b* should be driven.

In this embodiment, the voltage for switching one to the other of the positive polarity load drive circuit 211*a* and the negative polarity load drive circuit 211*b* is selected in 5V which is the intermediate voltage of the input video signal Vin having the voltage amplitude of 0 to 10V; however, it may be set a voltage other than the intermediate voltage.

FIG. 47 is a circuit diagram of the negative polarity load drive circuit 211*b*. Each load drive circuit 211*b* includes, as shown in FIG. 47, switches SW201 to SW204, transistor Q201 which is a p-type MOS transistor, logic circuit 213 connecting a front stage inverter 214 and a back stage inverter 215, capacitor C201 and constant current circuit I1. Connected to the signal line S driven by the load drive circuits 211*a*, 211*b* are pixel display TFT, liquid crystal capacitance, auxiliary capacitance, and so on, as shown in FIG. 4. FIG. 47, however, illustrates the load of the signal line S in form of an equivalent circuit of the resistor R and the capacitor C202 for simplicity.

One end of the switch SW201 and one end of the switch SW202 are connected to the signal line S. The other end of the switch SW201 is connected to one end of the switch SW203 and one end of the capacitor C201. The other end of the switch SW203 is supplied with the input video signal Vin. The other end of the capacitor C201 is connected to the input terminal of the logic circuit 213, and the output terminal of the logic circuit 213 is connected to the gate terminal of the transistor Q201. The source terminal of the transistor Q201 is supplied with a voltage VDD (for example, 10V) via the constant current circuit I1, and the drain terminal of it is connected to the other end of the switch SW202. One end of the switch SW204 is connected to the signal line S, and the other end of the switch SW204 is supplied with a voltage VSS (for example, 0V). These switches SW201 to SW204 are controlled by the switch control circuit 212 shown in FIG. 48.

In FIG. 47, node of the switch SW201 and the capacitor C201 is labeled a, node of the capacitor C201 and the logic circuit 213 is labeled b, node of the logic circuit 213 and the transistor Q201 is labeled c, and node of the switches SW201 and SW202 is labeled d.

The capacitor C201 forms the differential voltage hold circuit in this embodiment, the voltage source of the voltage VDD and the constant current circuit I1 make up a voltage change circuit for changing the voltage of the signal line S in this embodiment by a constant ratio, and the switch SW203 forms the input voltage setting circuit in this embodiment.

Figure 50:
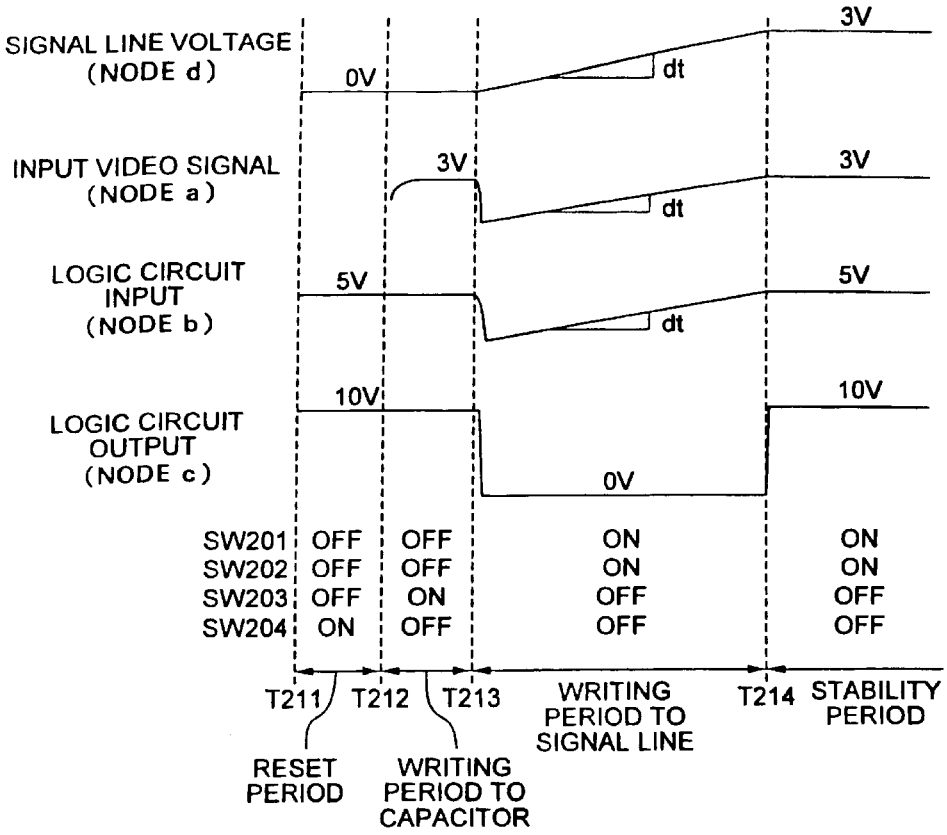
FIG. 50 is a timing chart of operations of different portions in the load drive circuit according to the seventeenth embodiment.

FIG. 50 is a timing diagram of operations of respective portions in the load drive circuit 211*b*. Explained below are operations of the circuit of FIG. 47, using this timing diagram.

First, in the period from time T201 to T212 (reset period), the switch control circuit 212 turns the switches SW201 to SW203 OFF and turns the switch 204 ON. As a result, voltage of the signal line S (node d in FIG. 47) becomes the same voltage as the voltage VSS (for example, 0V).

Next, in the period from time T212 to T213 (writing period to capacitor), the switch control circuit 212 turns the switch SW203 alone ON. As a result, voltage at the node a in FIG. 47 becomes equal to the voltage of the input video signal Vin. FIG. 50 shows an example in which the voltage of the input video signal Vin is 3V. However, since the switch SW201 is OFF, voltage of the signal line S (node d in FIG. 47) maintains 0V.

Assuming here that the threshold voltage of the front stage inverter 214 is 5V, voltage at the input terminal of the front stage inverter 214 (node b in FIG. 47) is set in the threshold voltage of the front stage inverter 214 by some means. A technique for setting the node b in FIG. FIG. 47 in the threshold voltage of the front stage inverter 214 will be explained later with another embodiment. Once the input terminal of the front stage inverter 214 is set in the threshold voltage, voltage at the output terminal of the logic circuit 213 (node c in FIG. 47) becomes 10V which is approximately equal to the source voltage. In this period, therefore, the transistor Q201 is OFF. In this case, since the switch SW203 is ON, voltage at the node a in FIG. 47 is the voltage of the input video signal Vin, 3V. As a result, the capacitor C201 holds the differential voltage (for example, 2V) between the voltage of the input video signal Vin (for example, 3V) and the threshold voltage of the front stage inverter 214 (for example, 5V).

Next, after the time T213, the switch control circuit 112 turns the switches SW201 and SW202 ON and turns the switches SW203 and SW204 OFF. At the point of time T213, the node a in FIG. 47 is 3V whereas the node d is 0V. Therefore, when the switch SW201 turns ON, voltage at the node a drops due to affection by the node d. Since the capacitor C201 maintains the above-mentioned differential voltage (2V), voltage at the node b in FIG. 47, which is the opposite end of the capacitor C201, also drops following the voltage at the node a, and output of the logic circuit 213 inverts and becomes the LOW level (for example, 0V). As a result, the transistor Q201 turns ON, and a constant current is supplied to the signal line S via the transistor Q201 and the switch SW202. Therefore, voltage of the signal line S (node d in FIG. 47) rises by a constant gradient dt.

As the voltage of the signal line S rises by the constant gradient dt, voltages at the node a and the node b in FIG. 47 also rise responsively. Eventually, at time T214, voltage of the signal line S becomes equal to the voltage of the input video signal Vin, i.e., 3V, and the voltage at the node a in FIG. 47 also becomes equal to 3V. Since the capacitor C201 holds the differential voltage (2V), voltage at the node b in FIG. 47 becomes the threshold voltage, 5V. Therefore, output of the logic circuit 213 again inverts and becomes HIGH level (for example, 10V). As a result, the transistor Q201 turns OFF, and the supply of the current to the signal line S from the constant current circuit I1, that is, supply of a voltage, is blocked. Through these operations, the signal line S is set in 3V, substantially equal to the voltage of the input video signal Vin.

Figure 51:
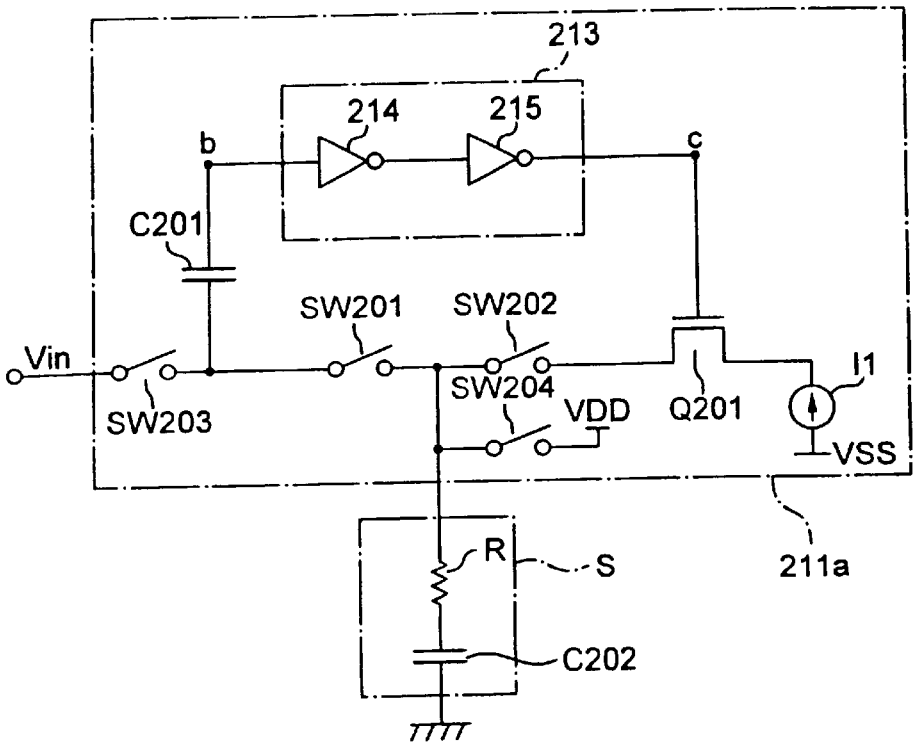
FIG. 51 is a circuit diagram showing detailed structure of a positive polarity load drive circuit in the seventeenth embodiment.

FIG. 51 is a circuit diagram showing detailed structure of the positive polarity load drive circuit 211*a*. As shown in FIG. 51, the load drive circuit 211*a* is different from the load drive circuit 211*b* of FIG. 47 in that the transistor Q201 is n-type and the constant current circuit I1 is connected to the voltage VSS. In the other respects, it is identical to the negative polarity load drive circuit 211*b* explained above, and their detailed explanation is omitted.

As explained above, since the load drive circuit 211*b* according to the seventeenth embodiment of the invention is configured to make up a feedback loop by switches SW201, SW202, logic circuit 213 and transistor Q201 while holding the differential voltage in the capacitor C201 so as to supply the voltage VDD to the signal line S via the transistor Q201 only after presetting the voltage of the signal line S in 0V and thereafter turn the transistor Q201 OFF to block the supply of the voltage VDD when the voltage of the signal line S becomes substantially equal to the voltage of the input video signal Vin, it is ensured to set the signal line S substantially equal to the voltage of the input video signal Vin.

Additionally, since the input video signal Vin is supplied to the signal line after the differential voltage between the threshold voltage of the front stage inverter 214 and the voltage of the input video signal is held in the capacitor C201, the voltage of the signal line S is not influenced from variation, if any, in threshold voltage of the front stage inverter 214.

Furthermore, according to the load drive circuit 211*b* according to this embodiment, since the voltage VDD to the signal line S is supplied via the constant current circuit I1, voltage of the signal line S can be raised with a change of a constant gradient dt regardless of the voltage of the input video signal Vin and the voltage of the signal line S. That is, if the constant current circuit I1 is not used, it may occur that the ON resistance of the transistor Q201 increases as the voltage of the signal line S becomes closer to the voltage VDD, and the voltage increase gradient of the signal line S decreases. In short, the voltage increase gradient of the signal line S varies with voltage set in the signal line S.

In addition, since the logic circuit 213 has a circuit delay, a certain time is required after the voltage at the input terminal of the logic circuit 213 (node b in FIG. 47) until the transistor Q201 is actually turns OFF. Accordingly, in a strict sense, the voltage set in the signal line S undesirably becomes slightly higher than the voltage of the input video signal Vin.

Therefore, any change in voltage increase gradient of the signal line S causes the difference between the voltage actually set in the signal line S and the voltage of the input video signal Vin to vary with the level of the voltage set in the signal line S. That is, it result in deteriorating the linearity of the load drive circuit 211*a*. When such variation in the difference between the voltage set in the signal line S and the voltage of the input video signal Vin occurs, so-called writing error may occur.

In contrast, in the load drive circuit 211*b* according to this embodiment, since the voltage increase gradient dt of the signal line S is constant regardless of the voltage of the signal line S, it is ensured that the difference between the voltage actually set in the signal line S and the voltage of the input video signal Vin be constant. Therefore, linearity of the load drive circuit 211*a* is ensured, and so-called writing error can be prevented.

Moreover, according to the load drive circuit 211*b* according to this embodiment, since the threshold voltage of the front inverter 214 and the voltage of the input video signal Vin are sampled in the same cycle when setting in the capacitor C201 the differential voltage the capacitor C201 should hold, it is possible to set the differential voltage more precisely than setting these two voltages in different cycles.

Eighteenth Embodiment

The eighteenth embodiment of the invention is directed to showing a specific technique for setting the voltage at the input terminal of the front stage inverter 214 (node b in FIG. 47) in the foregoing seventeenth embodiment in the threshold voltage of the front stage inverter 214.

Figure 52:
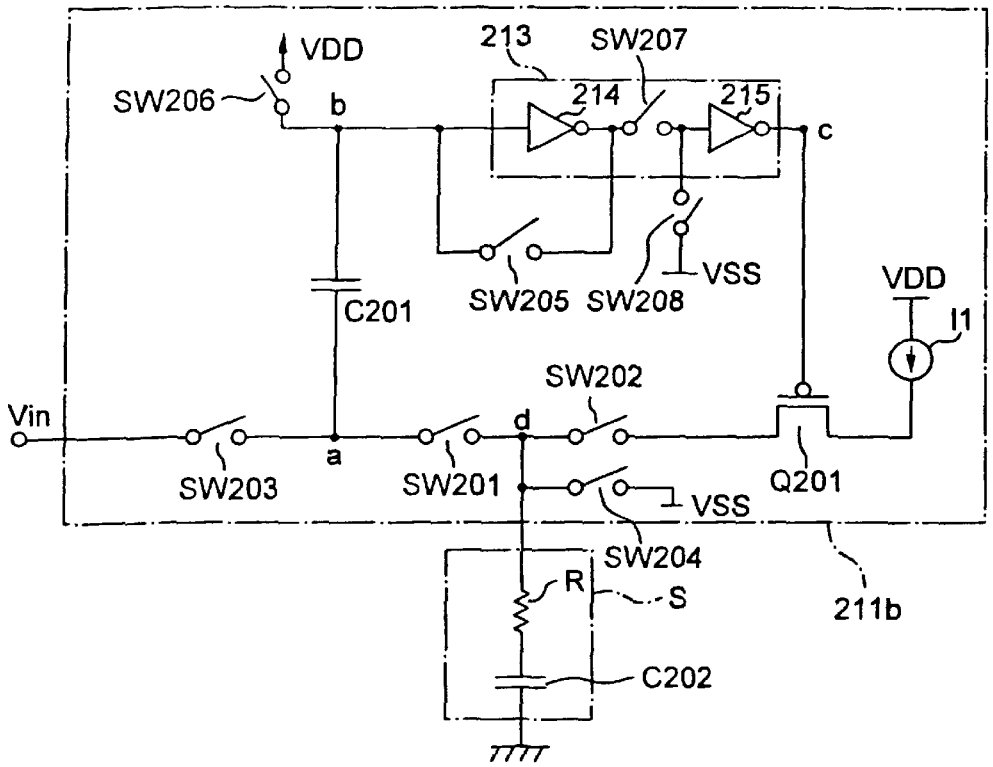
FIG. 52 is a circuit diagram of a load drive circuit according to the eighteenth embodiment.

FIG. 52 is a circuit diagram of the negative polarity load drive circuit 211*b* according this embodiment. The load drive circuit 211*b* according to this embodiment includes switches SW205 to SW208 in addition to the load drive circuit 211*b* shown in FIG. 47.

One end of the switch SW206 is connected to the other end of the capacitor C201, and the other end of the switch SW206 is connected to the voltage VDD (for example, 10V). One end of the switch SW205 is connected to the input terminal of the front end inverter 214, and the other end of the switch SW205 is connected to the output terminal of the front stage inverter 214. One end of the switch SW207 is connected to the output terminal of the front stage inverter 214, and the other end of the switch SW207 is connected to the input terminal of the back stage inverter 215. One end of the switch SW208 is connected to the input terminal of the back stage inverter 215, and the other end of the switch SW208 is connected to the voltage VSS (for example, 0V).

These switches SW207 to SW208 are also controlled by the switch control circuit 212 shown in FIG. 48.

In FIG. 52, node of the switch SW201 and the capacitor C201 is labeled a, node of the capacitor C201 and the logic circuit 213 is b, node of the logic circuit 213 and the transistor Q201 is c, and node of the switches SW201 and SW202 is d.

The capacitor C201 forms the differential voltage hold circuit in this embodiment, the voltage source of the voltage VDD and the constant current circuit I1 make up a voltage change circuit for changing the voltage of the signal line S by a constant ratio in this embodiment, the switch SW203 forms the input voltage setting circuit in this embodiment, and the feedback loop of the switch SW205 forms the threshold voltage setting circuit in this embodiment.

Figure 53:
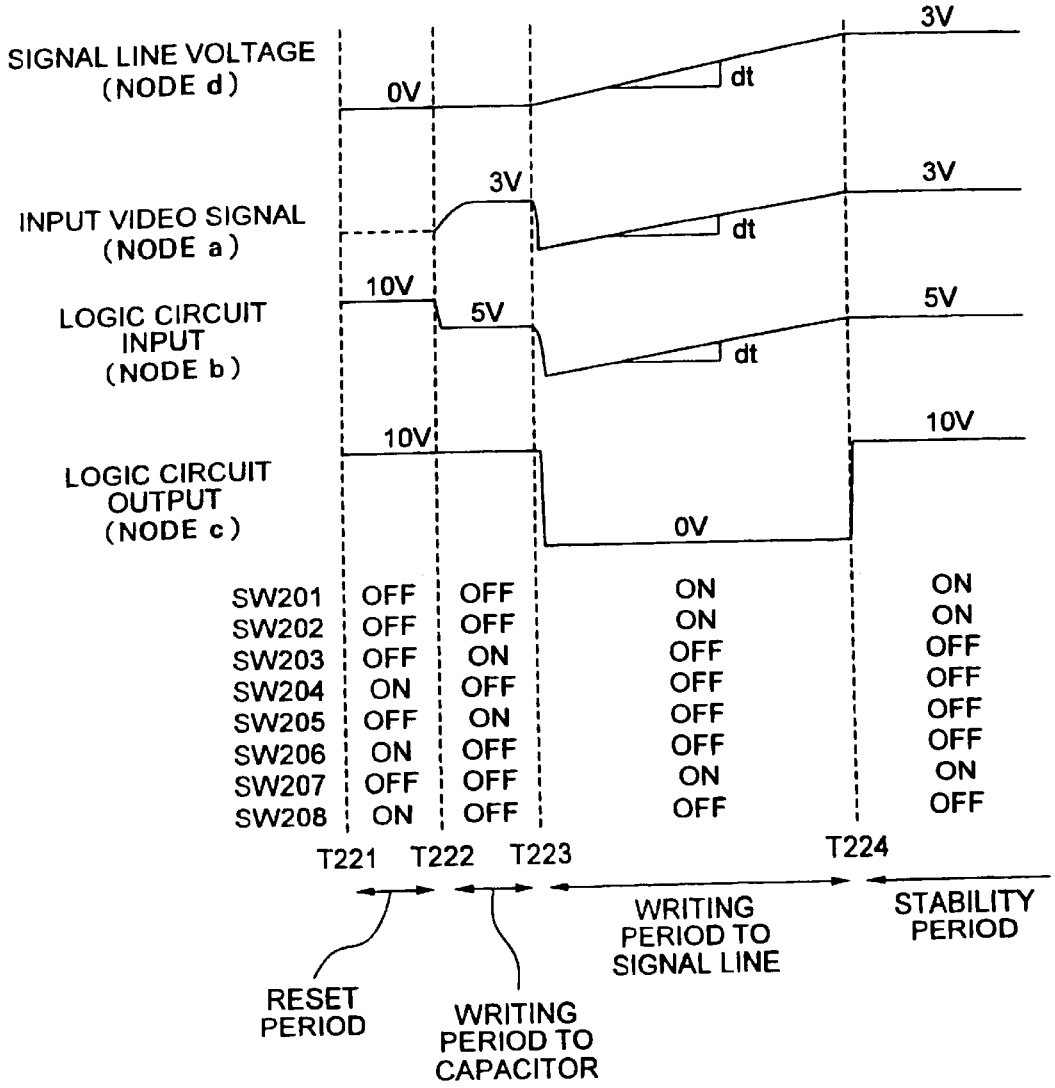
FIG. 53 is a timing chart of operations of different portions in the load drive circuit according to the eighteenth embodiment.

FIG. 53 is a timing diagram of operations of respective portions in the load drive circuit 211*b* of FIG. 52. Using this timing diagram, operations of the load drive circuit 211*b* of FIG. 52 are explained below.

First, in the period from time T221 to T222 (reset period), the switch control circuit 212 turns the switches SW204, SW206 and SW208 ON, and turns the switches SW201 to SW203, SW205 and SW207 OFF. As a result, voltage of the signal line S (node d in FIG. 52) becomes the same voltage as the voltage VSS (for example, 0V). Voltage at the input terminal of the front stage inverter 214 becomes the same voltage as the voltage VDD (for example, 10V), and voltage at the input terminal of the back stage inverter 215 becomes the same voltage as the voltage VSS (for example, 0V). The purpose of setting the voltage at the input terminal of the front stage inverter 214 in the voltage VDD and setting the voltage at the input terminal of the back stage inverter 215 in the voltage VSS lies in preventing that a through current flows in CMOS transistors forming the front stage inverter 214 and the back stage inverter 215. That is, by ensuring one of the p-type MOS transistor and the n-type MOS transistor forming each CMOS transistor to take a sufficient OFF condition, a through current is prevented from flowing therein. In this manner, power consumption of the load drive circuit 211*b* can be reduced. Therefore, voltages applied to the input terminal of the front stage inverter 214 and the input terminal of the back stage inverter 215 may be any of the voltage VDD (for example, 10V) and the voltage VSS (for example, 0V).

Next, within the period from time T222 to T223 (writing period to capacitor), the switch control circuit 212 turns the switches SW203 and SW205 ON, and turns the switches SW201, SW202, SW204 and SW206 to SW208 OFF. As a result, voltage at the node a in FIG. 52 becomes substantially equal to the voltage of the input video signal Vin. FIG. 53 shows an example in which the voltage of the input video signal Vin is 3V. However, since the switch SW201 is OFF, voltage of the signal line S (node d in FIG. 47) maintains 0V.

Further, since the switch SW205 is ON, voltage at the node b in FIG. 52 is set in a voltage approximately equal to the threshold voltage of the front stage inverter 214 (5V in this example). That is, by feeding the output of the front stage inverter 214 back to its input, voltages at the input terminal and the output terminal of the front stage inverter 214 are set to voltages substantially equal to the threshold voltage of the front stage inverter 214. Therefore, held in the capacitor C201 is the differential voltage (for example, 2V) between the voltage of the input video signal Vin (for example, 3V) and the threshold voltage of the front stage inverter 214 (for example, 5V).

Next, after the time T223 (writing period and stable period), the switch control circuit 212 turns the switches SW201, SW202 and SW207 ON and turns the switches SW203 to SW206 and SW208 OFF. At the point of time T223, the node a in FIG. 52 is 3V, but the node d is 0V. Therefore, when the switch SW201 turns ON, voltage at the node a decreases following the node d. Since the capacitor C201 maintains the above-mentioned differential voltage (2V), voltage at the node b in FIG. 52, which is the other end of the capacitor C201, also decreases following the voltage at the node a, and output of the logic circuit 213 inverts to the LOW level (for example, 0V). As a result, transistor Q201 turns ON, and a constant current is supplied to the signal line S from the constant current circuit I1 via the transistor Q201 and the switch SW202. Therefore, voltage of the signal line S (node d in FIG. 52) rises by a constant gradient dt.

When the voltage of the signal line S rises by the constant gradient dt, voltages at the nodes a and b in FIG. 52 also increase by the constant gradient dt. Eventually, at time T224, voltage of the signal line S becomes equal to the voltage of the input video signal Vin, namely 3V, and voltage at the node a in FIG. 52 also becomes equal to 3V. since the capacitor C201 holds the above-mentioned differential voltage (2V), voltage at the node b in FIG. 52 becomes 5V, which is the threshold voltage of the front stage inverter 214. Therefore, output of the logic circuit 213 is inverted again to the HIGH level (for example, 10V). As a result, transistor Q201 turns OFF, and the supply of the current, i.e. the supply of the voltage, from the constant current circuit I1 to the signal line S is blocked. By these operations, the signal line S is set in 3V substantially equal to the voltage of the input video signal Vin.

Figure 54:
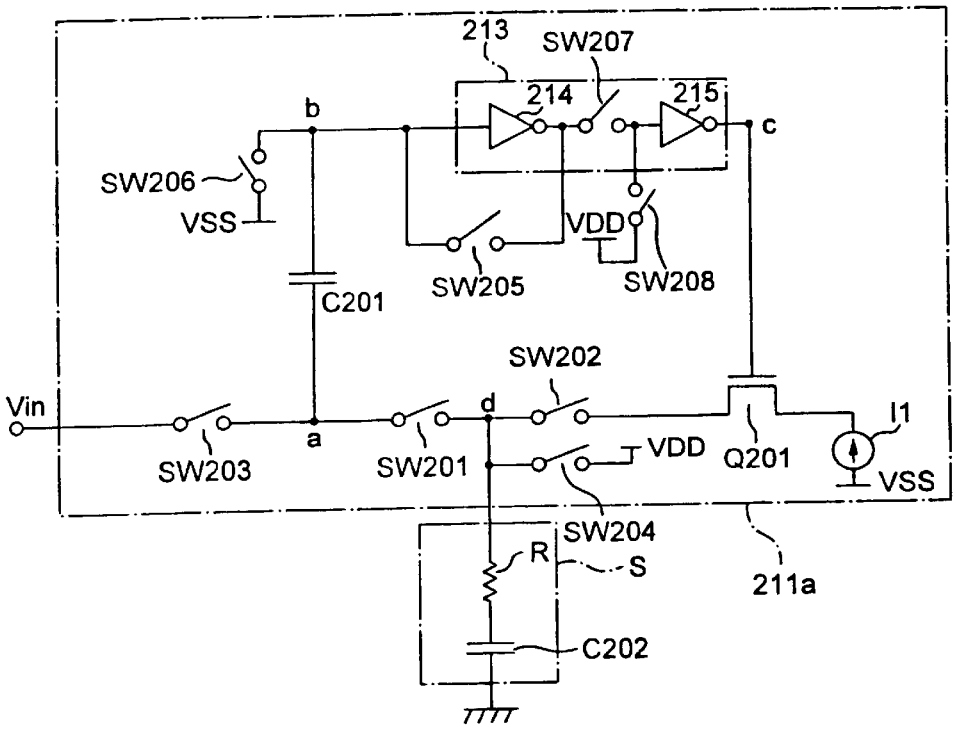
FIG. 54 is a circuit diagram showing detailed structure of a positive polarity load drive circuit in the eighteenth embodiment.

FIG. 54 is a circuit diagram showing detailed structure of the positive polarity load drive circuit 211*a*. As shown in FIG. 54, the positive polarity load drive circuit 211*a* is different from the negative polarity load drive circuit 211*b* in that the transistor Q201 is the n-type, and the constant current circuit I1 is connected to the voltage VSS. In the other respects, it is the same as the negative polarity load drive circuit 211*b*, and detailed explanation thereof is omitted.

As explained above, even with the load drive circuit 211*b* according to the eighteenth embodiment of the invention, similarly to the foregoing seventeenth embodiment, it is ensured to set the signal line S substantially equal to the voltage of the input video signal Vin.

Additionally, since the input video signal Vin is supplied to the signal line S after having the capacitor C201 hold the differential voltage between the threshold voltage of the front stage inverter 214 and the voltage of the input video signal Vin, the voltage of the signal line S can be held free from influences of any variation in threshold voltage of the front stage inverter 214.

Further, in the load drive circuit 211*b* according to this embodiment, since the voltage VDD to the signal line S is supplied through the constant current circuit I1, the voltage of the signal line S can be raised by a constant gradient dt irrespectively of the voltage of the input video signal Vin or the voltage of the signal line S. Therefore, linearity of the load drive circuit 211*a* is ensured, and so-called writing error can be prevented.

In addition, in the load drive circuit 211*b* according to this embodiment, since the threshold voltage of the front stage inverter 214 and the voltage of the input video signal Vin are sampled in the same cycle when setting in the capacitor C201 the differential voltage the capacitor C201 should hold, it is possible to set the differential voltage more precisely than setting these two voltages in different cycles.

The invention is not limited to the seventeenth embodiment and the eighteenth embodiment, but can be modified in various modes. For example, although the seventeenth embodiment and the eighteenth embodiment have been explained as adopting the load drive circuit according to the invention to the signal line drive circuit 3 in a liquid crystal display device, the invention can be widely used for applications other than the signal line drive circuit 3.

Further, various switches shown in the seventeenth embodiment and the eighteenth embodiment can be made by using transfer gates or analog switches. Additionally, although those embodiments have been explained as constructing the logic circuit 213 by serially connecting in two stages the inverters for inverting and amplifying input signals, the interior structure of the logic circuit 213 is not limited particularly as long as it is made by combining transistors.

Furthermore, in the seventeenth and eighteenth embodiments, accuracy of the voltage to be set in the signal line S is improved by driving the positive polarity load drive circuit 211*a* to increase the voltage of the signal line S from 10V to the input video signal Vin when the input video signal Vin is higher than 5V while driving the negative polarity load drive circuit 211*b* to decrease the voltage of the signal line S from 0V to the input video signal Vin when the input signal line Vin is lower than 5V. However, it is not always necessary to use both the positive polarity load drive circuit 211*a* and the negative polarity load drive circuit 211*b*. For example, it is also acceptable to preset the signal line S in 0V to thereby increase the voltage of the signal line S to the voltage of the input video signal Vin in the range from 0V to 10V by using the positive polarity load drive circuit alone.

Moreover, although the seventeenth and eighteenth embodiments have been explained as driving one of the positive polarity load drive circuit 211*a* and the negative polarity load drive circuit 211*b* in FIG. 48, depending on the voltage of the input video signal Vin, both of these load drive circuits 211*a* and 211*b* may be driven regardless of the voltage of the input video signal Vin.

As described above, according to the invention, since a voltage change circuit change the voltage of the signal line by a constant ratio after the differential voltage between the voltage of an input signal and the threshold voltage of a front stage invert/amplifier circuit forming the logic circuit, voltage of the signal line can be set substantially equal to the voltage of the input signal even when the threshold value of the logic circuit varies. Additionally, difference between the input signal and the voltage actually set in the signal line is constant, and the linearity is improved. Therefore, when the invention is applied to a signal line drive circuit of a liquid crystal display device, it is ensured to realize a liquid crystal display device having an integral drive circuit, excellent in display quality without illuminance irregularity.

What is claimed is:

1. A signal amplitude amplifier circuit supplied with a digital input signal and outputting a digital output signal, the digital input signal having a first amplitude and the digital output signal having a second amplitude which is larger than the first amplitude, comprising:

an amplitude amplifying logic circuit including a first node supplied with an internal signal and a second node outputting the digital output signal, said amplitude amplifying logic circuit amplifying the amplitude of the internal signal having said first amplitude to generate the digital output signal having said second amplitude;

a differential voltage hold circuit including a third node connected to the first node of said amplitude amplifying logic circuit, and a fourth node, the differential voltage hold circuit temporarily holding a differential voltage between a reference voltage of a voltage value for switching said digital input signal between a HIGH and a LOW and a voltage substantially equal to a threshold voltage for switching a logic of said amplitude amplifying logic circuit between the HIGH and the LOW;

a digital input switch including a fifth node supplied with the digital input signal and a sixth node connected to the fourth node of said differential voltage hold circuit, said digital input switch turning ON to supply the digital input signal to the fourth node under a condition where said differential voltage hold circuit holds the differential voltage, so that said differential voltage hold circuit supplies the internal signal to said amplitude amplifying logic circuit, the internal signal being generated by adding the differential voltage to the digital input signal;

a threshold voltage setting circuit configured to set the third node of said differential voltage hold circuit to a voltage substantially equal to the threshold voltage of said amplitude amplifying logic circuit when setting the differential voltage in said differential voltage hold circuit; and a reference voltage setting circuit configured to set the fourth node of said differential voltage hold circuit to the reference voltage when setting the differential voltage in said differential voltage hold circuit, wherein said differential voltage hold circuit includes a first capacitor having one end connected to the first node of said amplitude amplifying logic circuit and the other end connected to the sixth node of said digital input switch.

2. A signal amplitude amplifier circuit supplied with a digital input signal and outputting a digital output signal, the digital input signal having a first amplitude and the digital output signal having a second amplitude which is larger than the first amplitude, comprising:

an amplitude amplifying logic circuit including a first node supplied with an internal signal and a second node outputting the digital output signal, said amplitude amplifying logic circuit amplifying the amplitude of the internal signal having said first amplitude to generate the digital output signal having said second amplitude;

a differential voltage hold circuit including a third node connected to the first node of said amplitude amplifying logic circuit, and a fourth node, the differential voltage hold circuit temporarily holding a differential voltage between a reference voltage of a voltage value for switching said digital input signal between a HIGH and a LOW and a voltage substantially equal to a threshold voltage for switching a logic of said amplitude amplifying logic circuit between the HIGH and the LOW;

a digital input switch including a fifth node supplied with the digital input signal and a sixth node connected to the fourth node of said differential voltage hold circuit, said digital input switch turning ON to supply the digital input signal to the fourth node under a condition where said differential voltage hold circuit holds the differential voltage, so that said differential voltage hold circuit supplies the internal signal to said amplitude amplifying logic circuit, the internal signal being generated by adding the differential voltage to the digital input signal;

a threshold voltage setting circuit configured to set the third node of said differential voltage hold circuit to a voltage substantially equal to the threshold voltage of said amplitude amplifying logic circuit when setting the differential voltage in said differential voltage hold circuit; and a reference voltage setting circuit configured to set the fourth node of said differential voltage hold circuit to the reference voltage when setting the differential voltage in said differential voltage hold circuit, wherein said threshold voltage setting circuit includes:

a first switch having one end connected to said third node of said differential voltage hold circuit and another end connected to a cancel terminal that changes linearly from a first voltage to a second voltage when setting the differential voltage in said differential voltage hold circuit, said first switch turning ON when setting the differential voltage in said differential voltage hold circuit and turning OFF when a voltage of said third node of said differential voltage hold circuit is substantially equalized by the threshold voltage of said amplitude amplifying logic circuit.

3. The signal amplitude amplifier circuit according to claim 2, wherein said threshold voltage setting circuit further includes:

a second capacitor having one end connected to said fourth node of said differential voltage hold circuit; and a second switch having one end connected to another end of said second capacitor and another end connected to a reverse cancel terminal that changes linearly from said second voltage to said first voltage when the differential voltage is set in said differential voltage hold circuit, said second switch turning ON when the differential voltage is set in said differential voltage hold circuit and turning OFF when said voltage of said third node of said differential voltage hold circuit is substantially equalized by the threshold voltage of said amplitude amplifier circuit.

4. The signal amplitude amplifier circuit according to claim 3, further comprising:

a reference voltage hold circuit configured to maintain a voltage of said fourth node of said differential voltage hold circuit in the reference voltage when setting the differential voltage in said differential voltage hold circuit.

5. The signal amplitude amplifier circuit according to claim 4, wherein each of said first switch and said second switch is a transfer gate having a p-type MOS transistor and an n-type MOS transistor.

6. The signal amplitude amplifier circuit according to claim 1, wherein said threshold voltage setting circuit includes:

a third capacitor having one end connected to said another end of said first capacitor; and a third switch having one end connected to said one end of said first capacitor and another end connected to another end of said third capacitor, said one end of said third switch being connected to a third voltage and said another end of said third switch being connected to a fourth voltage when setting the differential voltage in said first capacitor, said third switch turning ON when setting the differential voltage in said first capacitor and turning OFF when said one end of said first capacitor reaches a voltage substantially equal to the threshold voltage of said amplitude amplifier circuit.

7. The signal amplitude amplifier circuit according to claim 1, wherein said threshold voltage setting circuit comprises:

a fourth switch having one end connected to said one end of said first capacitor, said one end of said fourth switch being connected to a third voltage and another end of said fourth switch being connected to a fourth voltage when setting the differential voltage in said first capacitor, said fourth switch turning ON when setting the differential voltage in said first capacitor and turning OFF when said one end of said first capacitor reaches a voltage substantially equal to the threshold voltage of said amplitude amplifier circuit.

8. The signal amplitude amplifier circuit according to claim 7, further comprising:

a reference voltage hold circuit configured to maintain a voltage at said another end of said first capacitor in said reference voltage when setting the differential voltage in said first capacitor.

9. The signal amplitude amplifier circuit according to claim 8, wherein said fourth switch is a transfer gate having a p-type MOS transistor and an n-type MOS transistor.

10. The signal amplitude amplifier circuit according to claim 1, wherein said reference voltage setting circuit comprises:

a fifth switch having one end connected to said other end of said first capacitor and another end connected to a supply terminal of the reference voltage, said fifth switch turning ON when setting the difference voltage in said differential voltage hold circuit.

* * * * *

UNITED STATES PATENT AND TRADEMARK OFFICE

CERTIFICATE OF CORRECTION

PATENT NO. : 6,603,456 B1
DATED : August 5, 2003
INVENTOR(S) : Aoki et al.

It is certified that error appears in the above-identified patent and that said Letters Patent is hereby corrected as shown below:

Title page,
Item [75], Inventors, information should read:
-- [75] Inventors: Yoshiro Aoki, Saitama-ken (JP);
Masao Karube, Saitama-ken (JP) --

Signed and Sealed this

Second Day of December, 2003

JAMES E. ROGAN
*Director of the United States Patent and Trademark Office*